US011515139B2

(12) United States Patent
Lange

(10) Patent No.: US 11,515,139 B2
(45) Date of Patent: Nov. 29, 2022

(54) METHOD FOR DETERMINING A PARAMETER TO PERFORM A MASS ANALYSIS OF SAMPLE IONS WITH AN ION TRAPPING MASS ANALYSER

(71) Applicant: Thermo Fisher Scientific (Bremen) GmbH, Bremen (DE)

(72) Inventor: Oliver Lange, Bremen (DE)

(73) Assignee: THERMO FISHER SCIENTIFIC (BREMEN) GMBH, Bremen (DE)

( * ) Notice: Subject to any disclaimer, the term of this patent is extended or adjusted under 35 U.S.C. 154(b) by 0 days.

(21) Appl. No.: 17/196,896

(22) Filed: Mar. 9, 2021

(65) Prior Publication Data

US 2021/0287897 A1 Sep. 16, 2021

(30) Foreign Application Priority Data

Mar. 10, 2020 (EP) ..... 20162126

(51) Int. Cl.
*H01J 49/42* (2006.01)
*H01J 49/00* (2006.01)
*H01J 49/02* (2006.01)

(52) U.S. Cl.
CPC ..... *H01J 49/4225* (2013.01); *H01J 49/0009* (2013.01); *H01J 49/0031* (2013.01); *H01J 49/027* (2013.01)

(58) Field of Classification Search
CPC .. H01J 49/0009; H01J 49/027; H01J 49/0027; H01J 49/0031; H01J 49/0036; H01J 49/4225
See application file for complete search history.

(56) References Cited

U.S. PATENT DOCUMENTS

2004/0217272 A1* 11/2004 Horning ..... H01J 49/4265 250/281
2007/0203652 A1 8/2007 Horning et al.
(Continued)

FOREIGN PATENT DOCUMENTS

DE 10027545 C1 10/2001
WO 2007/000587 A2 1/2007

OTHER PUBLICATIONS

Gorshkov et al., "Calibration Function for the Orbitrap FTMS Accounting for the Space Charge Effect," J Am Soc Mass Spectrom 2010, 21, 1846-1851.

*Primary Examiner* — David E Smith
(74) *Attorney, Agent, or Firm* — Thomas F. Cooney

(57) ABSTRACT

A method for determining a compensation factor parameter, c, for controlling an amount of ions ionised that are injected from an ion storage unit into mass analyser, where c is an adjustment factor that is applied to optimized injection times that are based on an optimized visible charge of a reference sample, the method comprising: detecting at least one mass spectrum for at least one amount of injected ions; determining from the at least one detected mass spectrum, a slope, s(sample), of a linear correlation of a relative m/z shift with visible total charge $Q_v$ of detected mass spectra; determining the compensation factor c as c=s(reference)/s(sample) where s(reference) is the slope of a linear correlation between reference-sample relative m/z shift values and reference-sample visible charge values determined from a plurality of mass spectra detected from a plurality of respective pre-selected amounts of a clean reference sample.

14 Claims, 14 Drawing Sheets

(56) References Cited

U.S. PATENT DOCUMENTS

| | | | | |
|---|---|---|---|---|
| 2008/0203293 | A1 | 8/2008 | Makarov | |
| 2012/0326027 | A1 | 12/2012 | Sugiyama et al. | |
| 2013/0234014 | A1* | 9/2013 | Remes | H01J 49/0036 250/281 |
| 2014/0061460 | A1* | 3/2014 | Hauschild | H01J 49/425 250/281 |
| 2014/0367564 | A1 | 12/2014 | Green et al. | |
| 2015/0206728 | A1* | 7/2015 | Kaneko | H01J 49/0009 250/281 |
| 2016/0233078 | A1 | 8/2016 | Hauschild et al. | |

* cited by examiner

METHOD FOR DETERMINING A PARAMETER TO PERFORM A MASS ANALYSIS OF SAMPLE IONS WITH AN ION TRAPPING MASS ANALYSER

CROSS REFERENCE TO RELATED APPLICATION

This application claims the right of foreign priority, under 35 U.S.C. § 119(a), to European Patent Office application EP20162126, which was filed on Mar. 10, 2020.

TECHNICAL FIELD OF THE INVENTION

This invention relates to methods, which are determining a parameter to perform a mass analysis of sample ions with an ion trapping mass analyser. The investigated sample ions are ions, which have been ionised from a sample. The determined parameter can be used for controlling an amount of sample ions injected from an ion storage unit into the ion trapping mass analyser at the beginning of the mass analysis.

The invention also relates to a method of performing a mass analysis of sample ions with an ion trapping mass analyser. An amount of the sample ions is injected from an ion storage unit into the ion trapping mass analyser to perform the mass analysis, which is adapted by the parameter determined by the methods mentioned before.

The invention relates also to a method to correct the m/z shift observed in a mass spectrum of sample ions detected by an ion trapping mass analyser.

Furthermore the invention relates to a control unit which is executing an inventive method for determining the parameter and a mass spectrometer which is able to execute the inventive methods.

BACKGROUND OF THE INVENTION

In certain types mass analysers of mass spectrometers, which trap ions to analyse their mass-to-charge ratios (m/z), named ion trapping mass analyser, the ions can be transferred into the mass analysers, e.g. preferably injected from an ion storage unit, e.g. via an ion optical means, mostly in a very short time, which is typically in the range of 0.03 to 300 milliseconds as an ion package.

Though the mass-to-charge ratios of the ions (termed m/z) are detected by the mass analyser, the ratio will be sometimes be referred to as "mass" in this patent application, which is known by skilled persons, e.g. in the term mass spectrum.

Fourier transform mass analysers are examples of such ion trapping mass analysers, which detect the trapped ions by an image current. Typically the image current is induced on at least one detector electrode by the oscillations of the stored ions. By a Fourier transform of the detected image current, often called a transient, the frequencies of the oscillations of the ions can be obtained, which depend on the m/z values of the ions. Thus, the m/z values of the ions and hence the mass spectrum of the ions can be deduced from the Fourier transform. A mass spectrum of ions is providing at least the information of the m/z values and relative abundances of at least some of the investigated ions, typically by a peak, often named mass peak, of each of these ions.

Examples of Fourier transform mass analysers are in particular FTICR (Fourier Transform Ion Cyclotron Resonance) mass analysers and electrostatic trap mass analysers, e.g. the Orbitrap™ mass analysers of Thermo Fisher Scientific Inc. It should be noted that other mathematical transformations of the transient could be used, such as a Filter Diagonalisation Method (FDM) or Linear Prediction (LP) scheme or the methods described in WO 2013/171313. Accordingly, as used herein, the term Fourier transform mass analyser means any mass analyser that records a transient signal, which is capable of Fourier transformation to provide a mass spectrum, whether a Fourier transformation or other transformation is actually used to obtain the mass spectrum.

Typically used ion storage units are ion traps and trapping cells. Ion traps can be linear ion traps comprising straight linear electrodes, e.g. quadrupole or octopole ion traps. Ion traps can be also curved linear ion traps, often called C-traps, comprising curved electrodes. The ion storage unit can be for storing an ion package of ions, which are typically ionised from a sample, named in this patent application sample ions, before the ion package is injected into the ion trapping mass analyser.

The amount of ions and in particular the total charge of the ions of the ion package transferred into the mass analyser is essential for the performance of the mass analysis, in particular the mass resolution, mass accuracy and the reproducibility. Typically the mass analysis is performed by detecting a mass spectrum of the stored ions.

To achieve a high quality performance of the mass analyser, control systems, often called automatic gain control (AGC) systems, are known from the prior art to control the amount of injected ions and in particular the total charge of the ions of the injected ion package. They control the amount of the ions in an injected ion package such that a sufficient amount of ions is injected into the mass analyser to improve the statistics of the investigated ions and therefore to achieve mass peaks or mass values of highest intensity and/or high signal-to-noise ratio whilst at the same time minimising negative effects appearing when too many ions are injected into the mass analyser reducing the quality of the performed mass analysis, in particular the quality of the detected mass spectra, e.g. the accuracy of the observed m/z values of ions or the precision of the observed ion intensities. One very important effect is the space charge effect described in detail below. Accordingly, the AGC system controls the total charge $Q_{real}$ of the ions of an injected ion package, wherein an optimised total charge $Q_{opt}$, in particular an optimal charge, of the ions has to be achieved. The value of the optimised total charge $Q_{opt}$ depends on the intended mass analysis, e.g. on the investigated sample and the mass range which shall be detected by the mass analysis. The value of the optimised total charge $Q_{opt}$ can be determined by pre-experiments or the experience from similar mass analysis executed before.

The total charge $Q_{real}$ of an ion package is defined as the sum of the electric charge of all ions in the ion package.

Mostly samples shall by investigated by the mass analyser of a mass spectrometer. Normally a neutral sample is provided to the mass spectrometer and in an ion source ions are generated from the sample by an ionisation process. Sometimes such ions are generated by an ionisation process from a sample outside of a mass spectrometer and the generated ions are then provided to the mass spectrometer. All these ions are named in this patent application sample ions. They are ionised from a sample, which shall be investigated, by any kind of ionisation process which is generating ions from a sample. In the mass analyser is then a mass analysis of the sample ions performed. The invention of this patent application is related to ion trapping mass analysers.

In particular known ionisation methods providing such ionisation processes are Electron Ionisation (EI), Electrospray Ionisation (ESI), Chemical Ionisation (CI), in particular Atmospheric Pressure Chemical Ionisation (APCI), Matrix-Assisted Laser Desorption/Ionisation (MALDI), in particular Atmospheric Pressure Matrix-Assisted Laser Desorption/Ionisation (AP-MALDI) and High Pressure Matrix-Assisted Laser Desorption/Ionisation (HP-MALDI), Photoionisation (PI), in particular Atmospheric Pressure Photoionisation (APPI), Heated Electrospray Ionisation (HESI), Field Ionisation in particular Field Desorption (FD), spark ionisation, plasma ionisation, in particular glow discharge ionisation, Inductive Coupled Plasma (ICP) ionisation, Microwave Coupled Plasma (MIP) ionisation and Thermal Ionisation (TI).

Sometimes an investigated sample might comprise at least one specific standard component—often named lock mass —, which can be e.g. a specific molecule in the sample, which might be gaseous, which might be liquid or can have a solid state. For each specific standard component comprised in the sample at least one specific sample ion is generated by ionisation. In some cases different species of sample ions may by generated by ionisation from one standard component.

These different species of sample ions may be generated from one standard component by an ionisation process, because the standard component may be charged in different ways during the ionisation process.

Different species of sample ions may be also generated from one standard component by an ionisation process, because the standard component may react in different ways with reagent ions present in an ion source during the ionisation process.

Different species of sample ions may be generated from one standard component by an ionisation process, because the standard component may react with different reagent ions present in an ion source during the ionisation process.

Different species of sample ions may be generated from one standard component by an ionisation process, because the standard component may be fragmented in parts during the ionisation process.

The same specific sample ions may by generated with all ionisation methods from one standard component by ionisation of the standard component.

Mostly with each ionisation method one or more specific sample ions may be generated by ionisation of the standard component, which are characteristic for the ionisation method or specific parameters of the ionisation method, with which the ionisation method is executed to generate the sample ions. So when e.g. the specific samples ions are generated by fragmentation of the standard component, they have a characteristic pattern of fragmented ions, which can be related to the executed ionisation method or specific parameters of the executed ionisation method.

For example for the ionisation method of Electrospray Ionisation the specific parameters, on which the characteristic pattern of the generated specific samples ions of a standard component may depend, are the sample flow rate provided to the capillary of the ion source, the electric field between the tip of the capillary of the ion source and the further electrode of the ion source, the polarity of the capillary and the material of the further electrode.

So by any ionisation of a standard component any specific ionisation process is generating one or several specific species of sample ions and the ratio of different species of the generated sample ions is also provided with a method-related tolerance by the applied ionisation process. Accordingly any specific ionisation process is generating a specific pattern of the sample ions from a standard component, which have specific m/z values and specific relative abundances. These patterns of the sample ions of a standard component comprised in an investigated sample can be detected in a mass analyser by a mass spectrum of the sample ions of the investigated sample as peak pattern of the sample ions of the standard component. This peak pattern is part of the complete mass spectrum of the sample ions of the investigated sample.

Accordingly the sample ions of each specific standard component have one or more m/z ratios, which are known and related to the used ionisation process.

The peak patterns of the sample ions of the standard component can be derived e.g. from detected mass spectra of a sample, which is only comprising the pure standard component or by comparison of mass spectra of different samples comprising the standard component. The peak patterns of sample ions of standard components derived from a specific ionisation process can be stored in data libraries as standard peak patterns. The standard peak patterns are providing the real physical m/z values of the sample ions because any m/z shift of the detected sample ions due to space charge effects—which will be described in detail below—observed during the detection of mass spectra has been corrected in the standard peak patterns of sample ions of standard components.

The at least one standard component might be mixed to the investigated samples during a sample preparation stage. A frequently used standard component is for example PFTBA (Perfluorotributylamine), which is decomposed in fragments of specific masses with a repeatable pattern which have a relatively low mass compared to other sample ions. Accordingly the peak pattern of the sample ions of PFTBA can be easily identified in a mass spectrum of sample ions.

Other standard components might be contaminations, resulting from the sample preparation and might have their origin from used sample containers, sample supply systems (e.g. lines and tubes of the supply system), chromatography means like chromatography columns, ionisation sources which emit the contaminations. A typical contamination emitted from the tubes provided in one of these devices can be polydimethylcyclosiloxane, which can be used as standard component detectable in every investigated sample.

Also emissions of the laboratory surroundings might add contaminations to the investigated samples, which are then standard components in the investigated samples. This can be e.g. substances of floor cleaning products and glues, which are used in the laboratory and are found as standard components in investigated samples The sample ions of these standard components can be identified in a mass spectrum due to specific high abundances, the specific peak structure of their peak pattern and/or their m/z values.

If it is known that the sample ions of a standard component have a very high abundance in a detected mass spectrum and such high intensity peaks occur in a mass range close to the expected m/z values of the sample ions, these peaks can be identified as the peaks of the sample ions.

In general the mass peak of a sample ion of a standard component having an expected m/z value can be identified in a detected mass spectrum as the peak of highest intensity in mass range close to the expected m/z values of the sample ion. There might be applied additional criteria to define if this identification is correct, because it might be possible that the identified peak results from another sample ion for which the m/z value is unknown, which has also an m/z value in the in mass range close to the expected m/z values of the sample ion of the standard component.

If the peaks of sample ions of a standard component are expected in a mass range, where no peaks or no peaks with a relevant abundance are expected from the sample ions of the other molecules of the sample, then these peaks can be identified as the peaks of the sample ions of the standard component. In particular sometimes the sample ions of a standard component are generated by a fragmentation of the standard component into small fragments, so that these sample ions have lower m/z values than the sample ions of other components of the sample, which are only fragmented in fragments of similar low m/z values with at most a very small probability. Accordingly the observed peak intensity of the sample ions of the standard component in the mass range of the observed lower m/z values is at least 3 times, preferably 5 times and particular preferably 10 times higher than the observed maximum peak intensity of the sample ions of the other components of the sample. This difference of the peak intensities can be used to identify the peaks of the sample ions of the standard component.

One approach of an automatic gain control (AGC) is described in the US patent application US2004/0217272 A1, wherein at the beginning of a mass analysis sample ions are supplied in a pre-experiment from an ion source along an ion path to an ion storage unit, acting as an ion accumulator in a first sampling time interval. Then the accumulated sample ions are ejected from the ion accumulator and at least a portion of the ejected sample ions is detected at a separate ion detector detecting the ion current and therefore the total charge $Q_{real}$ of all detected sample ions. From the detected total charge $Q_{real}$ of all detected sample ions it can be derived how the sampling time interval of the pre-experiment has to be changed to an injection time interval, in which sample ions are supplied in a main experiment from the ion source along the ion path to the ion storage unit to investigate in the mass analyser an ion package with optimised total charge $Q_{opt}$.

Another approach of an automatic gain control (AGC) is described in the international patent application WO2012/160001 A1 which is hereby incorporated to description. In this approach no additional detector is required. Instead, in a pre-scan experiment at the beginning of a mass analysis sample ions are supplied from an ion source along an ion path to an ion storage unit, acting as an ion accumulator in a first sampling time interval tpre. Then the accumulated sample ions are ejected from the ion accumulator to a Fourier transform mass analyser, which detects a mass spectrum of the accumulated sample ions. The pre-scan with the Fourier transform mass analyser is executed with a reduced amount of accumulated sample ions and from the detected mass spectrum a visible total charge $Q_v$ is derived. The visible total charge $Q_v$ can be derived from the detected mass spectrum by specific features of the mass spectrum which are related to the charge of sample ions visible in the mass spectrum, e.g. by the mass peaks of the sample ions. Normally the peak intensity is then proportional to the number of the observed sample ions. Typically the visible total charge $Q_v$ can be derived from the detected mass spectrum by summing up all signals of the mass spectrum above a specific signal-to-noise (S/N) threshold and converting to charge using a conversion factor (determined during calibration).

All methods to derive the visible total charge $Q_v$ from a mass spectrum disclosed in WO2012/160001 A1 are part of this description and can be used by the invention.

From the determined visible total charge $Q_v$ can be derived the optimised accumulation time $t_{opt}$ to inject ions in the ion storage unit, during which the optimised total charge $Q_{opt}$ of ions is accumulated:

$$t_{opt} = \frac{Q_{opt}}{Q_v} \times t_{pre}. \tag{1}$$

One of the major factors that limit the mass resolution, mass accuracy and the reproducibility in such devices is the space charge effect, which can alter the storage, trapping conditions, or ability to accurately mass analyse of an ion trapping mass analyser, from each experiment, and consequently vary the results attained.

Space charge effects arise from the influence of the electric fields of trapped ions upon each other. The combined or bulk charge of the final population of ions causes shifts in m/z values in mass spectra detected by an ion trapping mass analyser, the m/z shift, compared with the real physical m/z value of the observed ions. In a Fourier transform mass analyser the shift of the m/z values of the trapped ions is a shift of the frequency of the trapped ions and therefore their m/z value detected by an image current using e.g. a Fourier transform. Details are described e.g. in U.S. Pat. No. 8,759,752 B2. The detected shift of the m/z value mainly referred to in this disclosure is in particular a relative shift. The relative m/z shift is defined for an ion of the mass-to-charge ratio m/z by $$\frac{\Delta(m/z)}{m/z} \tag{2}$$

wherein Δm/z is the absolute value by which m/z ob observed in a mass spectrum is shifted compared to the real physical mass-to-charge ratio m/z of the ion. Usually the value of the relative m/z shift is for all ions observed in a mass spectrum with an ion trapping mass analyser the same. This is particular the case for electrostatic trap mass analysers, in particular for such as disclosed in the international patent application WO96/30930, wherein the electric field in the electrostatic trap is having a hyper-logarithmic form, which content is hereby incorporated in this description, e.g. the Orbitrap™ mass analysers provided by Thermo Fisher Scientific Inc.

At very high levels of space charge in Fourier transform mass analysers, the obtainable resolution will deteriorate and peaks close in frequency (m/z) can at least partially coalesce. The measured peak positions are then additionally shifted as a result of the strong interaction of ions having nearly the same m/z value and accordingly same frequency by their electrostatic fields. This can result in mass shifts of a few ppms to 10's of ppms.

Unless space charge is either taken into account or regulated, high mass accuracy, precision mass and intensity measurements cannot be reliably achieved. To avoid this, ion packages of the ions injected into the ion trapping mass analyser are having the optimised total charge $Q_{opt}$.

For the m/z shift due to the space charge effect it is further known that the relative m/z shift is correlated with the total charge $Q_{real}$ of the ion package. This correlation is linear for ion trapping mass analysers and this correlation is used to correct the measured m/z values of a mass spectrum when the total charge $Q_{real}$ is derived from a detected mass spectrum.

A significant magnitude of the space charge can arise from fluctuations in trapped ion density, caused by changes in the number of ions provided to the ion storage unit over time.

This approach of an automatic gain control (AGC) to determine and use the optimised accumulation time $t_{opt}$ is based on the assumption that the visible total charge $Q_v$ derived from the mass spectrum of the pre-scan experiment is the real total charge $Q_{real}$ of the investigated ion package.

But in specific experiments, often the total charge $Q_{real}$ of all sample ions in the ion package cannot be derived from a detected mass spectrum. In particular samples might comprise small amounts of certain molecules, whose sample ions have a small peak intensity close to the noise level of the measured mass spectrum. Therefore the signal-to-noise of the sample ions of these molecules might be below the specific signal-to-noise (S/N) threshold, used to derive the visible total charge $Q_v$ from the measured mass spectrum. So the charge of the sample ions of the small amounts of molecules is not included in the visible total charge $Q_v$ and therefore "invisible", when a mass spectrum is evaluated. Small amounts occur in particular in samples eluted from a chromatography experiment, in particular a liquid chromatography experiment, at high retention times, when large molecules are eluted having various compositions of small amounts. So in particular, in this situation, the charge of the sample ions of a lot of different large molecules cannot be accurately derived from a mass spectrum of the sample and therefore the visible total charge $Q_v$ might deviate considerably from the real total charge $Q_{real}$ of the investigated ion package.

Furthermore it is possible that in a sample are molecules, from which sample ions are produced that have nearly the same m/z value. Then in a mass spectrum of a Fourier transform mass analyser the sample ions may interfere and their peaks in a mass spectrum overlap. Then their separate peaks cannot be completely separated e.g. by deconvolution and the intensity of the peaks might be reduced by destructive interference of the image current signals. Accordingly for the sample ions of the interfering peaks their charge is underestimated and their visible total charge $Q_v$ reduced.

Also due to high charge states of the sample ions of the investigated sample the visible total charge $Q_v$ may be lowered because high charge is not taken into account, in particular due to small occurrence, interfering and/or non-resolved peaks. For example a peak of small intensity, which might be related to a sample ion having a high charge state, can interfere with a peak of high intensity. Then the peak of the small intensity is not resolved and its charge will not be taken into account when calculating the visible total charge $Q_v$ of an ion package.

It is therefore an object of the invention to provide improved methods to control the amount of sample ions injected into an ion trapping mass analyser to improve the performance of the mass analysis by the ion trapping mass analyser, when the complete total charge $Q_{real}$ of an ion package of sample ions injected into the mass analyser is not visible in and/or derivable from a detected mass spectrum.

In particular it is an object of the invention to provide methods, which determine a parameter, which is improving the control of the amount of sample ions injected into an ion trapping mass analyser to perform a mass analysis of the sample ions, when the complete total charge $Q_{real}$ of the sample ions is not visible in and/or derivable from a detected mass spectrum.

It is another object of the invention to use the improved methods without additional equipment to detect or derive the complete total charge $Q_{real}$ of an investigated ion package of sample ions beside an ion storage unit, ion trapping mass analyser and at least one control and/or evaluation unit.

Another object of the invention is to provide an improved methods to correct the mass shift observed in a detected mass spectrum, when the complete total charge $Q_{real}$ of an ion package of sample ions injected into the mass analyser is not visible in and/or derivable from a detected mass spectrum.

SUMMARY OF THE INVENTION

The first three objects are solved by the methods of the claims 1, 2 and 5.

The inventive method of claim 1 determines a compensation factor, which is a parameter for controlling the amount of sample ions ionised from a sample, which are injected from an ion storage unit of a mass spectrometer into its ion trapping mass analyser, which then performs a mass analysis of the injected sample ions.

The inventive method of claim 1 comprises the steps:

In the first step, at least one mass spectrum is detected for at least one amount of the sample ions by the ion trapping mass analyser. The at least one amount of the sample ions is injected from the ion storage unit into the ion trapping mass analyser.

In a preferred embodiment of the inventive method the at least one mass spectrum is detected for at least one pre-selected amount of the sample ions. The amounts of sample ions for which the mass spectra are detected in the first step are selected before the detection of the mass spectra is started. In particular all amounts for which the mass spectra are detected in the first step are selected before the first mass spectrum is detected. The selection of the pre-selected amounts can be e.g. provided by a control unit, by a user via an interface of a control unit or by the user selecting a specific method for mass analysis or a specific class of samples to be analysed with the ion trapping mass analyser. The preselection of the at least one amount of the sample ions can be also provided by the preselection of at least one injection time period of the sample ions into the ion storage unit, when a constant sample ion flow is provided to the ion storage unit.

In general any amount of sample ion or any injection time period can be used to detect the at least one mass spectrum in the first step. It is preferred to use amounts of sample ions, which have a real total charge $Q_{real}$, which is below the optimised total charge $Q_{opt}$. It is also preferred to use injection time periods of the sample ions into the ion storage unit, which are below the optimised injection time period $t_{opt,real}$, when an ion package of the optimised total charge $Q_{opt}$ is accumulated in the ion storage unit.

In another embodiment of the method of claim 1 the at least one amount of sample ions, for which in the first step the at least one mass spectrum is determined, is not selected. Instead at least one specific instant of time may be selected, when in a certain time period, which is a defined time period, the sample ions are supplied from an ion source along an ion path, may be via ion optics or another ion storage unit, to the ion storage unit, wherein a different amount of sample ions is accumulated in the ion storage unit at each specific moment. Depending on the flow of the sample ions provided to the ion storage unit a specific amount of sample ions can be accumulated in the ion storage unit for each specific instant of time during the certain time period and then injected into the ion trapping mass analyser. If e.g. an ion source is providing an ion flow with a fluctuation, different amounts of sample ions will be accumulated in the ion storage unit at different moments. By the visible total charge $Q_v$ of an accumulated amount of the sample ions and/or an observed shift of the m/z values of the mass peaks of the sample ions derived from their detected mass spectrum can be observed if a small or large amount of sample ions has been accumulated.

In the next step, the at least one detected mass spectrum is used to determine the sample slope of the linear correlation of the relative m/z shift with the visible total charge $Q_v$ of mass spectra of sample ions detected with the ion trapping mass analyser, which is the slope of the linear correlation of the relative m/z shift with the visible total charge $Q_v$ of mass spectra detected with the ion trapping mass analyser, when ions are investigated, which are ionised from the sample. Accordingly each sample has its specific sample slope value. The value of the sample slope depends on the ratio of the visible total charge $Q_v$ of the investigated sample ions derived from the mass spectra detected with the ion trapping mass analyser to the total charge $Q_{real}$ of the investigated sample ions.

Both correlated parameters, the relative m/z shift and the visible total charge $Q_v$, are observed in the mass spectra of the sample ions when detected with an ion trapping mass analyser and depend on the amount of the sample ions in the mass analyser.

The sample slope describes for the sample, for which the mass analysis shall be performed, how the relative m/z shift observed in the mass spectra of the sample ions is correlated with the visible total charge $Q_v$ which can be determined from detected mass spectra of the sample ions. Embodiments to determine and in particular to calculate the sample slope are described below.

Because the correlation of the relative m/z shift with the visible total charge $Q_v$ of a sample is a linear function by means of the sample slope of the linear function, the relative m/z shift can be determined for any observed visible total charge $Q_v$ of an amount of investigated sample ions.

In an embodiment of the inventive method of claim 1 only the observable difference of the relative m/z shift induced by the space charge, which is explained in detail below, is observed from two detected mass spectra of different amounts of the sample ions. The observable difference of the relative m/z shift of the two amounts of sample ions is evaluated from the two detected mass spectra by determination of the relative difference of m/z values of at least one species of sample ions from the two detected mass spectra of the two amounts of sample ions. When the relative difference of m/z values is determined for more than one species of sample ions, then the observable difference of the relative m/z shift of the two amounts of sample ions is derived from the determined relative differences of m/z values of the more than one species of sample ions by deriving from the determined relative differences of m/z values of the more than the one species of sample ions a typical value of the relative differences of m/z values of sample ions. This typical value—the observable difference of the relative m/z shift of the two amounts of sample ions—is preferably derived from the determined relative differences of m/z values the more than the one species of sample ions by averaging the determined relative differences of m/z values.

A visible total charge $Q_v$ is evaluated from the at least one detected mass spectrum and/or the difference of a visible total charge $Q_v$ is evaluated from the detected mass spectrav of two different amounts of sample ions.

The correlation of the observable difference of the relative m/z shift observed from two detected mass spectra of different amounts of the sample ions with the visible total charge $Q_v$ evaluated from the two detected mass spectra or the difference of a visible total charge $Q_v$ evaluated from the two detected mass spectra can be used to determine the sample slope of the linear correlation of the relative m/z shift with the visible total charge $Q_v$ of mass spectra of sample ions. This correlation can be derived from mass spectra of different amounts of sample ions, wherein the observable difference of the relative m/z shift is observed from pairs of two detected mass spectra. Also the corresponding difference of a visible total charge $Q_v$ is evaluated from these pairs of two detected mass spectra.

In another embodiment of the inventive method of claim 1 the relative m/z shift can be evaluated directly from a detected mass spectrum, because the m/z ratio of at least one sample ion is known and the mass peak of this at least one sample ion can be identified in the at least one detected mass spectrum. The visible total charge $Q_v$ is also evaluated from this detected mass spectrum.

The evaluation of the relative m/z shift is based on the determination of a relative difference of m/z values of at least one sample ion, for which the m/z ratio is known, in the detected mass spectrum to its known m/z ratio. More details, how to determine the relative m/z shift from a detected mass spectrum, when the m/z ratio of at least one sample ion is known, are described below and can be applied in this embodiment.

The correlation of the relative m/z shift observed from the at least one detected mass spectrum with the visible total charge $Q_v$ evaluated from the at least one detected mass spectrum can be used to determine the sample slope of the linear correlation of the relative m/z shift with the visible total charge $Q_v$ of mass spectra of sample ions. This correlation can be derived from mass spectra of different amounts of sample ions, in particular mass spectra of two different amounts of sample ions.

In one embodiment of the inventive method the mass spectra of two amounts of sample ions are used to calculate the sample slope of the linear correlation of the relative m/z shift with the visible total charge $Q_v$ of mass spectra of sample ions detected with the ion trapping mass analyser, as exemplified before. Preferably in this method two amounts of sample ions have been selected, for which mass spectra will be detected. Then the sample slope of the linear correlation can be calculated by evaluating the two detected mass spectra. The investigated amounts of sample ions can be e.g. selected by defining two injection time periods, in which sample ions are injected into the ion storage unit, which are then injected into the ion trapping mass analyser to detect their mass spectra.

Also the mass spectra of more than two different amounts of sample ions can be used to determine the sample slope of the linear correlation of the relative m/z shift with the visible total charge $Q_v$ of mass spectra of sample ions detected with the ion trapping mass analyser.

So it is possible, that in an embodiment, in a first step of determining the sample slope the ratio of the observable difference of the relative m/z shift and the difference of the visible total charge $Q_v$ is determined for mass spectra of different pairs of two of the different amounts of sample ions and then the sample slope of the linear correlation of the relative m/z shift with the visible total charge $Q_v$ of mass spectra of sample ions detected with the ion trapping mass analyser is calculated by averaging the ratios determined for the different pairs of two of the different amounts of sample ions.

In another embodiment, when the m/z ratio of at least one sample ion is known, it is possible that in a first step of determining the sample slope the ratio of the relative m/z shift determined from an detected mass spectrum and the visible total charge $Q_v$ evaluated from this detected mass spectrum is determined for the mass spectra of at least two different amounts of sample ions and then the sample slope of the linear correlation of the relative m/z shift with the visible total charge $Q_v$ of mass spectra of sample ions detected with the ion trapping mass analyser is calculated by averaging the ratios determined for the mass spectra of the at least two different amounts of sample ions.

In another embodiment the mass spectra detected for the different amounts of sample ions are used to determine the sample slope of the linear correlation of the relative m/z shift with the visible total charge $Q_v$ of mass spectra of sample ions detected with the ion trapping mass analyser, wherein a linear fit is used. This fit is taking into account the evaluated observable difference of the relative m/z shift and the evaluated visible total charges $Q_v$ and/or the differences of a visible total charge $Q_v$. For the determination of the sample slope of the linear correlation it is not important to know the values of the relative m/z shift of the sample ions in their mass spectra detected with the ion trapping mass analyser. It would be sufficient to know the differences of the relative m/z shift and the correlated differences of the visible total charge $Q_v$ and as explained below it is also sufficient in this embodiment of the inventive method of the claim 1 to know the observable difference of the relative m/z shift of detected mass spectra and the correlated differences of the visible total charge $Q_v$ of the detected mass spectra for the determination of the sample slope of the linear correlation of the relative m/z shift with the visible total charge $Q_v$ of mass spectra of sample ions detected with the ion trapping mass analyser. Based on these values can be created a two-dimensional data set of observable differences of the relative m/z shift and correlated values of visible total charges $Q_v$ or correlated differences of a visible total charge $Q_v$ (to a total visible charge $Q_{v,sp}$ explained below) of mass spectra of sample ions detected with the ion trapping mass analyser, to which a linear fit method can be applied which is determining the sample slope of the linear correlation of the relative m/z shift with the visible total charge $Q_v$ of the these mass spectra as the slope of the fitted linear function. What is not required for this data set is to define, when the observable differences of the relative m/z shift has the value 0. So it can be defined that for a specific visible total charge $Q_{v,sp}$ of an amount of sample ions in the mass analyser the observable difference of the relative m/z shift shall have the value 0. It is irrelevant, for which total charge $Q_v$ the observable difference of the relative m/z is set to the value 0. Due to the definition, when the observable difference of the relative m/z shift has the value 0, the value of the observable difference of the relative m/z shift is defined for all mass spectra in the two-dimensional data set. The observable difference of the relative m/z shift is defined for all spectra in relation to that mass spectrum, in which the specific visible total charge $Q_{v,sp}$ of the sample ions is determined. Accordingly the observable difference of the relative m/z shift of each mass spectrum can be evaluated by the determination of the relative difference of m/z values of at least one species of sample ions in the mass spectrum and in that mass spectrum, in which the specific visible total charge $Q_{v,sp}$ of the sample ions is observed.

In another embodiment, when the m/z ratio of at least one sample ion is known, the mass spectra detected for the different amounts of sample ions are used to determine the sample slope of the linear correlation of the relative m/z shift with the visible total charge $Q_v$ of mass spectra of sample ions detected with the ion trapping mass analyser by a linear fit. This linear fit is taking into account the evaluated relative m/z shift and the corresponding evaluated visible total charges $Q_v$ of the detected mass spectra and is determining the slope of their correlation, which is the sample slope.

In the following step of the inventive method of claim 1, a compensation factor c is determined, which is used for adjusting the ion injection time period $t_{opt,v}$ of sample ions injected into the ion storage unit to perform a mass analysis. The ion injection time period $t_{opt,v}$ is the injection time period, which is related to the optimised visible charge $Q_{ref,opt}$ of a reference sample. The optimised visible charge $Q_{ref,opt}$ of the reference sample is that amount of the visible total charge $Q_v$, which is visible in a mass spectrum of the reference sample, when the real total charge $Q_{real}$ of investigated amount of reference ions, which are the ions ionised from the reference sample, has the value of the optimised total charge $Q_{opt}$. Accordingly when the optimised visible charge $Q_{ref,opt}$ of the reference ions is visible in a mass spectrum of the reference sample, the mass spectrum has been detected with the optimised total charge $Q_{opt}$ of the investigated reference ions. In this case of the amount of the investigated reference ions the mass spectrum of the reference sample is detected with a high quality performance. The ion injection time period $t_{opt,v}$, in which sample ions are injected into the ion storage unit to perform the mass analysis, is defining that ion injection time period, due to which the optimised visible charge $Q_{ref,opt}$ of a reference sample ions is observed as visible total charge $Q_v$ in a mass spectrum of the sample ions, when the sample ions injected in the ion storage unit have been ejected into the ion trapping mass analyser for the detection of the mass spectrum. Because normally another ratio of the real total charge $Q_{real}$ is visible as visible total charge $Q_v$ in the mass spectrum of the sample ions compared with the ratio of real total charge $Q_{real}$ visible as visible total charge $Q_v$ in the mass spectrum of the reference ions, the mass spectrum of the sample ions is not detected with optimised real total charge $Q_{opt}$, when they are injected into the ion storage unit during the ion injection time period $t_{opt,v}$. Accordingly the inventive method of claim 1 is determining the compensation factor c to adjust the ion injection time period $t_{opt,v}$ in that way, that an amount of the sample ions of the optimised total charge $Q_{opt}$ is injected into the ion storage unit and then analysed with the ion trapping mass analyser. The ion injection time period $t_{opt,v}$ is determined only from the visible total charge $Q_v$ evaluated from at least one mass spectrum detected with the ion trapping mass analyser of at least one amount of the sample ions and the corresponding injection time period of the sample ions. The linear correlation between the visible total charge $Q_v$ in the detected mass spectra and the injection time period of the sample ions is used to define the ion injection time period $t_{opt,v}$, when the optimised visible total charge $Q_{ref,opt}$ of the reference ions is visible in a mass spectrum of sample ions.

For the reference sample the optimised visible total charge $Q_{ref,opt}$ is known, which is the value of the visible total charge $Q_v$ of the reference sample, when an ion package of the reference sample has the optimized total charge $Q_{opt}$. The injection time period $t_{opt,v}$ is the injection time period of the sample ions into the ion storage unit, when the visible total charge $Q_v$ observed from the mass spectrum of sample ions has the value of the optimised visible total charge $Q_{ref,opt}$ of the reference sample. If for the sample and the reference sample a different portion of the real total charge $Q_{real}$ is observed as visible total charge $Q_v$ in their mass spectra, the determined injection time period $t_{opt,v}$ is not the optimal injection time period $t_{opt,real}$ of the sample ions, when the injected ions of the sample really comprise the optimised real total charge $Q_{opt}$.

At least one amount of the sample ions is injected into the ion trapping mass analyser to determine the injection time period $t_{opt,v}$, wherein this amount is correlated with the injection time period of the sample ions. For each of these amounts of sample ions the ion trapping mass analyser is detecting a mass spectrum and then from these mass spectra is evaluated the visible total charge $Q_v$. From the observed visible total charge $Q_v$ of the amounts of the sample ions and their corresponding injection time period is the ion injection time period $t_{opt,v}$ determined using their correlation.

The ion injection time period $t_{opt,v}$ is preferably determined using the at least one detected mass spectrum of at least one amount of sample ions of the first step.

Other embodiments to determine the ion injection time period $t_{opt,v}$ can be also used, which are described in detail below regarding the inventive method of claim 2, but can be also used in the inventive method of claim 1.

In particular the reference sample used in inventive method of claim 1 can be a clean sample, for the real total charge $Q_{real}$ of the trapped ions, the clean sample ions, is visible or at least substantially visible as visible total charge $Q_v$ in the mass spectra of the clean sample ions detected with the ion trapping mass analyser. The clean sample ions are generated from the clean sample by an ionisation process.

If the real total charge $Q_{real}$ of the sample ions is visible in the detected spectrum, the ion injection time period $t_{opt,v}$ which is related to the optimised visible charge $Q_{opt}$ of a clean sample and determined from the visible total charge $Q_v$ evaluated from mass spectra of sample ions is the optimised accumulation time $t_{opt,real}$ for the optimised total ion charge $Q_{opt}$ because the optimised visible charge $Q_{clean,opt}$ is also the optimised total charge $Q_{opt}$. Accordingly the compensation factor c is then 1.

But the compensation factor c can be determined by the inventive method of claim 1 also for experiments, wherein the complete real total charge $Q_{real}$ of an ion package of sample ions is not visible in the detected spectrum, so that $Q_v<Q_{real}$. Accordingly the observed relative m/z shift is larger than expected from the visible total charge value $Q_v$ evaluated from mass spectra of sample ions, if the visible total charge value $Q_v$ would be the real total charge $Q_{real}$ of the sample ions. Further the optimised ion injection time period $t_{opt,v}$, which is related to the optimised visible charge $Q_{opt}$ of a clean sample, determined from the visible total charge $Q_v$ based on formula (1) has a value of $t_{opt,v}$, which is too high, because $Q_v$ is not representing the complete total charge $Q_{real}$ as required to determine $t_{opt,real}$. To compensate this, the compensation factor c is provided. It is determined by dividing the clean slope, which is the slope of the linear correlation of the relative m/z shift with the visible total charge $Q_v$ of mass spectra of clean sample ions trapped in the ion trapping mass analyser by the sample slope determined before.

A clean sample, from which the clean slope is determined, is a sample, for which the real total charge $Q_{real}$ of an ion package is visible, or substantially visible, in its mass spectra detected with the ion trapping mass analyser as visible total charge $Q_v$. For a clean sample preferably at least 95% of the real total charge $Q_{real}$ of an ion package is visible in the mass spectra as visible total charge $Q_v$, more preferably at least 99% of the real total charge $Q_{real}$ of an ion package is visible and most preferably 99.8% of the real total charge $Q_{real}$ of an ion package is visible. Accordingly the optimized accumulation time $t_{opt,real}$ can be directly determined for a clean sample from the visible total charge $Q_v$ evaluated from a mass spectrum of a prescan experiment as described before.

In general in this step of the inventive method, the compensation factor c is also determined from any kind of reference sample, not only a clean sample. For such a reference sample the complete total charge $Q_{real}$ of an ion package of the reference ions, which are the ions generated from the reference sample by ionisation, may not be visible in its detected spectrum. Accordingly the ion injection time period $t_{opt,v}$, which is related to the optimised visible charge $Q_{ref,opt}$ of a reference sample, can be defined by equation (1) taking into account the optimised value of visible total charge $Q_{ref,opt}$ for detecting mass spectra of the reference sample replacing in the equation the optimised total charge $Q_{opt}$ of a clean sample. So the ion injection time period $t_{opt,v}$, which is related to the optimised visible charge $Q_{ref,opt}$ of the reference sample, is the injection time period of sample ions to perform the mass analysis, when for the ion package of sample ions the optimised visible charge $Q_{ref,opt}$ of the reference sample is visible in their detected mass spectrum. The ion injection time period $t_{opt,v}$ is determined only from the visible total charge $Q_v$ trapped in the ion trapping mass analyser evaluated from the detected mass spectrum of at least one amount of the sample ions and the corresponding injection time periods of the sample ions. So when sample ions are injected to the ion storage unit with the determined ion injection time period $t_{opt,v}$ the optimised visible total charge $Q_{ref,opt}$ for detecting mass spectra of the reference sample is also visible in the mass spectrum of the analysed sample as visible total charge $Q_v$.

But when the ratio of the total charge of the trapped sample ions visible in the mass spectra to the real total charge of the trapped sample ions deviates from the ratio of the total charge of the trapped reference ions visible in the mass spectra to the real total charge of the trapped reference ions, the assumption is not correct, that the sample is also analysed with the optimised ion injection time period $t_{opt,real}$ which is the case for the reference sample. In particular if the ratio of the total charge of the trapped sample ions visible in the mass spectra to the real total charge of the trapped sample ions is lower than the ratio of the total charge of the trapped reference ions visible in the mass spectra to the real total charge of the trapped reference ions, the ion injection time period $t_{opt,v}$ of sample ions, which is related to the optimised visible charge $Q_{ref,opt}$ of the reference sample, has a value of $t_{opt,v}$, which is too high, because $Q_v$ is not representing the complete total charge $Q_{v,ref}$ visible for the reference sample in its mass spectra which is required to determine $t_{opt,real}$. To compensate this the compensation factor c is determined by dividing the reference slope, which is the slope of the linear correlation of the relative m/z shift with the visible total charge $Q_v$ of mass spectra of reference ions ionised from the reference sample detected with the ion trapping mass analyser, by the sample slope of the linear correlation of the relative m/z shift with the visible total charge $Q_v$ of mass spectra of sample ions detected with the ion trapping mass analyser. Then the optimised ion injection time period $t_{opt,real}$ to analyse sample ions and in particular to detect mass spectra of sample ions is determined by multiplication of the ion injection time period $t_{opt,v}$ of sample ions, which is related to the optimised visible charge $Q_{ref,opt}$ of the reference sample, with the determined compensation factor c.

The reference slope of the linear correlation of the relative m/z shift with the visible total charge $Q_v$ of mass spectra of reference ions detected with the ion trapping mass analyser is the slope of the linear correlation of the relative m/z shift with the visible total charge $Q_v$ of mass spectra detected with the ion trapping mass analyser, when reference ions are investigated, which are ionised from the reference sample. Details, how to determine the reference slope of a reference sample are provided below. The determination of the reference slope can be performed in all inventive methods in the same way.

A reference sample, for which the reference slope of the linear correlation of the relative m/z shift with the visible total charge $Q_v$ of mass spectra of its reference ions detected with the ion trapping mass analyser is determined, is a sample, for which a specific portion of the real total charge $Q_{real}$ of an investigated ion package of the reference ions is visible in its mass spectra, the visible total charge $Q_v$. For a reference sample preferably at least 20% of the real total charge $Q_{real}$ of an investigated ion package of the reference ions is visible, more preferably at least 65% of the real total charge $Q_{real}$ of an investigated ion package of the reference ions is visible and most preferably 90% of the real total charge $Q_{real}$ of an investigated ion package of the reference ions is visible.

The inventive method of claim 2 determines a compensation factor, which is a parameter for controlling the amount of sample ions ionised from a sample, which are injected from an ion storage unit of a mass spectrometer into its ion trapping mass analyser, which then performs a mass analysis of the injected sample ions.

The inventive method of claim 2 comprises the steps:

In the first step, mass spectra are detected for different amounts of the sample ions by the ion trapping mass analyser. The different amounts of the sample ions are injected from the ion storage unit into the ion trapping mass analyser.

In a preferred embodiment of the inventive method the mass spectra are detected for different pre-selected amounts of the sample ions. The amounts of sample ions for which the mass spectra are detected in the first step are selected before the detection of the mass spectra is started. In particular all amounts for which the mass spectra are detected in the first step are selected before the first mass spectrum is detected. The selection of the pre-selected amounts can be e.g. provided by a control unit, by a user via an interface of a control unit or by the user selecting a specific method for mass analysis or a specific class of samples to be analysed with the ion trapping mass analyser. The preselection of the different amounts of sample ions can be also provided by the preselection of different injection time periods of the sample ions into the ion storage unit, when a constant sample ion flow is provided to the ion storage unit.

In general any amount of sample ions or any injection time periods can be used to detect the mass spectra in the first step. It is preferred to use amounts of sample ions, which have a real total charge $Q_{real}$, which is below the optimised total charge $Q_{opt}$. It is also preferred to use injection time periods of the sample ions into the ion storage unit, which are below the optimised injection time period $t_{opt,real}$, when an ion package of the optimised total charge $Q_{opt}$ is accumulated in the ion storage unit.

In another embodiment of the method of claim 2 the different amounts of sample ions, for which in the first step mass spectra are determined, are not selected. Instead specific instants of time may be selected, when in a certain time period, which is a defined time period, the sample ions are supplied from an ion source along an ion path, may be via ion optics or another ion storage unit, to the ion storage unit, wherein different amounts of sample ions are accumulated in the ion storage unit at each specific moment. Depending on the flow of the sample ions provided to the ion storage unit a specific amount of sample ions can be accumulated in the ion storage unit for each specific instant of time during the certain time period and then injected into the ion trapping mass analyser. If e.g. an ion source is providing an ion flow with a fluctuation, different amounts of sample ions will be accumulated in the ion storage unit at different moments. By the visible total charge $Q_v$ of an accumulated amount of the sample ions and/or an observed shift of the m/z values of the mass peaks of the sample ions derived from their detected mass spectrum can be observed if a small or large amount of sample ions has been accumulated.

In a following step, the mass spectra of at least two of the different amounts of the sample ions are compared to evaluate the observable difference of a relative m/z shift—which is defined below—from at least one species of sample ions observed in the mass spectra. The m/z shift of the sample ions, which is the shift of the m/z values of the peaks of the sample ions in a mass spectrum, is induced by the space charge of the sample ions detected in the mass analyser. In this step, the dependency of the relative m/z shift on the amounts of the sample ions is investigated.

For this evaluation the relative difference of the m/z values of the at least one species of sample ions observed in two compared mass spectra is determined, wherein the observed m/z value of a sample ion is the m/z value of its peak in a mass spectrum. At the beginning of this determination peaks or peak structures are identified in the two compared mass spectra, which are assigned to the same sample ions in both mass spectra, which are in particular the same isotopologues of an isotopic distribution of sample ions, which have an isotopic distribution. Then the difference of the m/z values of the peaks of the same sample ions is determined by comparing the two mass spectra. This difference is also the difference of the m/z shift of the peak induced by the space charge of the amounts of analysed sample ions observed in the two compared detected mass spectra. Then from the difference of the m/z values of the identified peaks of the sample ions the observable difference of the relative m/z shift of the two compared mass spectra is evaluated by determination of the relative difference of the m/z values of the peaks from the determined difference of the m/z values of the peaks of the same sample ions and a method which is deriving from these relative differences of the at least one species of ions a typical relative difference of the m/z values, preferably by averaging the determined relative differences.

This typical relative difference of the m/z values of two compared mass spectra—in this specification named the observable difference of the relative m/z shift of the two mass spectra—corresponds nearly exactly to the difference of the relative m/z shift of the two compared mass spectra, because the relative m/z shift values of the detected mass spectra are in a range of ppm, mostly below 20 ppm, preferably below 10 ppm and particularly below 6 ppm. The relative m/z shift values of the detected mass spectra are calculated by formula (2) shown before regarding the physical m/z values of the ions. Due to the space charge effect present for every investigated amount of sample ions the physically correct m/z values cannot be measured in the mass spectra detected by an ion trapping mass analyser. But the difference of the m/z values of the peaks of the same sample ions can be determined by comparing the two mass spectra.

When for the first of the two mass spectra MS1 for a peak of an sample ion a m/z shift Δm/z (1) is observed regarding the physically correct mass-to-charge value m/z of the ion due to the observed m/z value $$m/z_{obs}(1)=m/z+\Delta m/z(1) \tag{3}$$

and for the second of the two mass spectra MS2 for a peak of the same sample ion an m/z shift Δm/z(2) is observed regarding the physically correct mass-to-charge value m/z of the ion due to the observed m/z value $$m/z_{obs}(2)=m/z+\Delta m/z(2) \tag{4}$$

the relative m/z shift values of the sample ion according to the formula (2) are for the first mass spectrum MS1:

$$\frac{\Delta m/z(1)}{m/z} \tag{5}$$

and for the second mass spectrum MS2:

$$\frac{\Delta m/z(2)}{m/z} \tag{6}$$

Hence the difference of the relative m/z shift of the two compared mass spectra MS1 and MS2 is:

$$\frac{\Delta m/z(2)-\Delta m/z(1)}{m/z}. \tag{7}$$

The difference of the m/z values of the peaks of the sample ion, which can be determined by comparing the two detected mass spectra MS1 and MS2 is $$m/z_{obs}(1)-m/z_{obs}(2)=m/z+\Delta m/z(1)-(m/z+\Delta m/z(2))=\Delta m/z(1)-\Delta m/z(2) \tag{8}$$

Further can be determined the relative difference of the m/z values of the peaks of the sample ion of two compared mass spectra M1 and M2. In general this relative difference is determined usually regarding the peaks of the first mass spectrum MS1 or regarding the peaks of the second mass spectrum MS2 or regarding the average value of the peaks of the first mass spectrum MS1 and the peaks of the second mass spectrum MS2.

If the relative difference of the m/z values of the peaks of the sample ion of the two compared mass spectra M1 and M2 is determined regarding the peak of the ion of the first mass spectrum MS1, the relative difference of the m/z values of the peaks of the ion is:

$$\frac{\frac{m}{z_{obs}}(2)-\frac{m}{z_{obs}}(1)}{\frac{m}{z_{obs}}(1)}=\frac{\Delta m/z(2)-\Delta m/z(1)}{m/z+\Delta m/z(1)} \tag{9}$$

If the relative difference of the m/z values of the peaks of the sample ion of the two compared mass spectra M1 and M2 is determined regarding the peak of the ion of the second mass spectrum MS2, the relative difference of the m/z values of the peaks of the ion is:

$$\frac{\frac{m}{z_{obs}}(1)-\frac{m}{z_{obs}}(2)}{\frac{m}{z_{obs}}(2)}=\frac{\Delta m/z(1)-\Delta m/z(2)}{m/z+\Delta m/z(2)} \tag{10}$$

If the relative difference of the m/z values of the peaks of the sample ion of the two compared mass spectra M1 and M2 is determined regarding average value of the peaks of the first mass spectrum MS1 and the peaks of the second mass spectrum MS2, the relative difference of the m/z values of the peaks of the ion is:

$$\{m/z_{obs}(2)-m/z_{obs}(1)\}/\left\{\frac{m/z_{obs}(1)+m/z_{obs}(2)}{2}\right\}=\{\Delta m/z(2)-\Delta m/z(1)\}/\left\{\frac{m/z+\Delta m/z(1)+m/z+\Delta m/z(2)}{2}\right\}=\frac{\{\Delta m/z(2)-\Delta m/z(1)\}}{\left\{m/z+\frac{\Delta m/z(1)+\Delta m/z(2)}{2}\right\}} \tag{11}$$

Regardless of the detailed way, in which the relative difference of the m/z values of the peaks of the sample ion of two compared mass spectra M1 and M2 is determined, this relative difference deviates from the difference of the relative m/z shift of the two compared mass spectra MS1 and MS2 only by the values Δ m/z(1), Δm/z(2) and (Δm/z(1)+Δm/z(2)/2 in the denominator of the values. Because the relative m/z shift values of the detected mass spectra are in a range of ppm, the values Δm/z(1), Δm/z(2) and (Δm/z(1)+Δm/z(2)/2 in the denominator are accordingly only in the ppm range compared to the m/z value in the denominator, which is accordingly 5 to 6 orders of magnitude smaller than the physically correct mass-to-charge value m/z of the ion. Due to this the value of the relative difference of the m/z values of the peaks of the sample ion of two compared mass spectra M1 and M2, and accordingly the observable difference of the relative m/z shift of the two mass spectra MS1 and MS2 is nearly exactly the difference of the relative m/z shift of the two compared mass spectra MS1 and MS2.

The inventive method of claim 2 is using the observable difference of the relative m/z shift of detected mass spectra which is derived from the relatives differences of the m/z values of the at least one species of sample ions to determine the sample slope of a linear correlation of the relative m/z shift with the visible total charge $Q_v$ of mass spectra of sample ions detected with the ion trapping mass analyser. Instead of the difference of the relative m/z shift of mass spectra of sample ions the observable difference of the relative m/z shift of detected mass spectra is used. The influence of this replacement is so small, that the inventive method of claim 2 is able to determine from detected mass spectra of different amounts of sample ions a parameter to optimise the amount of sample ions injected into the storage unit and then analysed by an ion trapping mass spectrometer, the compensation factor c explained in detail below, with such accuracy, that the performance of a mass analysis with the ion trapping mass spectrometer of a sample, for which not the complete total charge $Q_{real}$ of its ions is visible by the mass analysis is at least nearly equal to the performance of the mass analysis of a clean sample. This is a sample for which the complete total charge $Q_{real}$ of its sample ions is visible by the mass analysis.

In another step, the detected mass spectra of the at least two of the different amounts of the sample ions are evaluated to determine the visible total charge $Q_v$ of the sample ions trapped in the ion trapping mass analyser during the detection of the mass spectra. Then the difference of the visible total charge $Q_v$ can be evaluated for at least some of the at least two of the different amounts of the sample ions.

In the next step, the results of the two preceding steps are used to determine the sample slope of the linear correlation of the relative m/z shift with the visible total charge $Q_v$ of mass spectra of sample ions detected with the ion trapping mass analyser, which is the slope of the linear correlation of the relative m/z shift with the visible total charge $Q_v$ of mass spectra detected with the ion trapping mass analyser, when ions are investigated, which are ionised from the sample. Accordingly each sample has its specific sample slope value. The value of the sample slope depends on the ratio of the visible total charge $Q_v$ of investigated sample ions derived from the mass spectra detected with the ion trapping mass analyser to the total charge $Q_{real}$ of the investigated sample ions.

Both correlated parameters, the relative m/z shift and the visible total charge $Q_v$ are observed in the mass spectra of the sample ions when detected with an ion trapping mass analyser and depend on the amount of the sample ions in the mass analyser.

This sample slope can be in one embodiment of the inventive method of claim 2 calculated as the ratio of the observable difference of the relative m/z shift induced by the space charge of the sample ions and the difference of the visible total charge $Q_v$ of two amounts of sample ions injected and trapped in the ion trapping mass analyser, which are evaluated in the two preceding steps from the two detected mass spectra of the two amounts of sample ions detected in the ion trapping mass analyser. The observable difference of the relative m/z shift of the two amounts of sample ions is evaluated from the two detected mass spectra by determination of the relative difference of m/z values of at least one species of sample ions from the two detected mass spectra of the two amounts of sample ions. When the relative difference of m/z values is determined for more than the one species of sample ions, then the observable difference of the relative m/z shift of the two amounts of sample ions is derived from the determined relative differences of m/z values of the more than the one species of sample ions by deriving from the determined relative differences of m/z values of the more than the one species of sample ions a typical value of the relative differences of m/z values of sample ions. This typical value—the observable difference of the relative m/z shift of the two amounts of sample ions—is preferably derived from the determined relative differences of m/z values of the more than the one species of sample ions by averaging the determined relative differences of m/z values.

The sample slope describes for the sample, for which the mass analysis shall be performed, how the relative m/z shift observed in the mass spectra of the sample ions is correlated with the visible total charge $Q_v$ which can be determined from detected mass spectra of the sample ions. Further embodiments to determine and in particular to calculate the sample slope are described below.

Because the correlation of the relative m/z shift with the visible total charge $Q_v$ of a sample is a linear function by means of the sample slope of the linear function, the relative m/z shift can be determined for any observed visible total charge $Q_v$ of an amount of investigated sample ions.

In one embodiment of the inventive method the mass spectra of two amounts of sample ions are used to calculate the sample slope of the linear correlation of the relative m/z shift with the visible total charge $Q_v$ of mass spectra of sample ions detected with the ion trapping mass analyser, as exemplified before. Preferably in this method two amounts of sample ions have been selected, for which mass spectra will be detected. Then the sample slope of the linear correlation can be calculated by evaluating the two detected mass spectra. The investigated amounts of sample ions can be e.g. selected by defining two injection time periods, in which sample ions are injected into the ion storage unit, which are then injected into the ion trapping mass analyser to detect their mass spectra.

Different amounts of sample, for which in the inventive methods mass spectra are detected with the ion trapping mass analyser are preferably selected in that way, that the amount of sample ions or the injection time periods typically have a difference of at least 10% regarding its smaller value, preferably have a difference of at least 30% regarding its smaller value and more preferably have a difference of at least 50% regarding its smaller value.

Also the mass spectra of more than two different amounts of sample ions can be used to determine the sample slope of the linear correlation of the relative m/z shift with the visible total charge $Q_v$ of mass spectra of sample ions detected with the ion trapping mass analyser.

So it is possible, that in another embodiment, in a first step of determining the sample slope the ratio of the observable difference of the relative m/z shift and the difference of the visible total charge $Q_v$ is determined for mass spectra of different pairs of two of the different amounts of sample ions and then the sample slope of the linear correlation of the relative m/z shift with the visible total charge $Q_v$ of mass spectra of sample ions detected with the ion trapping mass analyser is calculated by averaging the ratios determined for the different pairs of two of the different amounts of sample ions.

In another embodiment the mass spectra detected for the different amounts of sample ions are used to determine the the sample slope of the linear correlation of the relative m/z shift with the visible total charge $Q_v$ of mass spectra of sample ions detected with the ion trapping mass analyser, wherein a linear fit is used. This fit is taking into account the evaluated observable difference of the relative m/z shift and the evaluated visible total charges $Q_v$ and/or the differences of a visible total charge $Q_v$. For the determination of the sample slope of the linear correlation it is not important to know the values of the relative m/z shift of the sample ions in their mass spectra detected with the ion trapping mass analyser. It would be sufficient to know the differences of the relative m/z shift and the correlated differences of the visible total charge $Q_v$ and as explained before it is also sufficient in the inventive method of the claim 2 to know the observable difference of the relative m/z shift of detected mass spectra and the correlated differences of the visible total charge $Q_v$ of the detected mass spectra for the determination of the sample slope of the linear correlation of the relative m/z shift with the visible total charge $Q_v$ of mass spectra of sample ions detected with the ion trapping mass analyser. Based on these values can be created a two-dimensional data set of observable differences of the relative m/z shift and correlated values of visible total charges $Q_v$ or correlated differences of a visible total charge $Q_v$ (to a total visible charge $Q_{v,o}$) of mass spectra of sample ions detected with the ion trapping mass analyser, to which a linear fit method can be applied which is determining the sample slope of the linear correlation of the relative m/z shift with the visible total charge $Q_v$ of the these mass spectra, which is the slope of the fitted linear function. What is not required for this data set is to define, when the observable differences of the relative m/z shift has the value 0. So it can be defined that for a specific visible total charge $Q_{v,sp}$ of an amount of sample ions in the mass analyser the observable difference of the relative m/z shift shall have the value 0. It is irrelevant, for which total charge $Q_v$ the observable difference of the relative m/z is set to the value 0. Due to the definition, when the observable difference of the relative m/z shift has the value 0, the value of the observable difference of the relative m/z shift is defined for all mass spectra in the two-dimensional data set. The observable difference of the relative m/z shift is defined for all spectra in relation to that mass spectrum, in which the specific visible total charge $Q_{v,sp}$ of the sample ions is determined. Accordingly the observable difference of the relative m/z shift of each mass spectrum can be evaluated by the determination of the relative difference of m/z values of at least one species of sample ions in the mass spectrum and in that mass spectrum, in which the specific visible total charge $Q_{v,sp}$ of the sample ions is observed.

In the following step of the inventive method of claim 2, a compensation factor c is determined, which is used for adjusting the ion injection time period $t_{opt,v}$ of sample ions injected into the ion storage unit to perform a mass analysis. The ion injection time period $t_{opt,v}$ is the injection time period, which is related to the optimised visible charge $Q_{ref,opt}$ of a reference sample. The optimised visible charge $Q_{ref,opt}$ of the reference sample is that amount of the visible total charge $Q_v$, which is visible in a mass spectrum of the reference sample, when the real total charge $Q_{real}$ of investigated amount of reference ions, which are the ions ionised from the reference sample, has the value of the optimised total charge $Q_{opt}$. Accordingly when the optimised visible charge $Q_{ref,opt}$ of the reference ions is visible in a mass spectrum of the reference sample, the mass spectrum has been detected with the optimised total charge $Q_{opt}$ of the investigated reference ions. In this case of the amount of the investigated reference ions the mass spectrum of the reference sample is detected with a high quality performance. The ion injection time period $t_{opt,v}$, in which sample ions are injected into the ion storage unit to perform the mass analysis, is defining that ion injection time period, due to which the optimised visible charge $Q_{ref,opt}$ of a reference sample is observed as visible charge in a mass spectrum of the sample ions, when the sample ions injected in the ion storage unit have been ejected into the ion trapping mass analyser for the detection of the mass spectrum. Because normally another ratio of the real total charge $Q_{real}$ is visible as visible total charge $Q_v$ in the mass spectrum of the sample ions compared with the ratio of real total charge $Q_{real}$ visible as visible total charge $Q_v$ in the mass spectrum of the reference ions, the mass spectrum of the sample ions is not detected with optimised total charge $Q_{opt}$, when they are injected into the ion storage unit during the ion injection time period $t_{opt,v}$. Accordingly the inventive method of claim 2 is determining the compensation factor c to adjust the ion injection time period $t_{opt,v}$ in that way, the an amount of the sample ions of the optimised total charge $Q_{opt}$ is injected into the ion storage unit and then analysed with the ion trapping mass analyser. The ion injection time period $t_{opt,v}$ is determined only from the visible total charge $Q_v$ evaluated from at least one mass spectrum detected with the ion trapping mass analyser of at least one amount of the sample ions and the corresponding injection time period of the sample ions. The linear correlation between the visible total charge $Q_v$ in the detected mass spectra and the injection time period of the sample ions is used to define the ion injection time period $t_{opt,v}$, when the optimised visible total charge $Q_{ref,opt}$ of the reference ions is visible in a mass spectrum of sample ions.

For the reference sample the optimised visible total charge $Q_{ref,opt}$ is known, which is the value of the visible total charge $Q_v$ of the reference sample, when an ion package of the reference sample has the optimized total charge $Q_{opt}$. The optimised injection time period $t_{opt,v}$ is the injection time period of the sample ions in the ion storage unit, when the visible total charge $Q_v$ observed from the mass spectrum sample ions has the value of the optimised visible total charge $Q_{ref,opt}$ of the reference sample. If for the sample and the reference sample a different portion of the real total charge $Q_{real}$ is observed as visible total charge $Q_v$ in their mass spectra, the determined injection time period $t_{opt,v}$ is not the optimal injection time period $t_{opt,real}$ of the sample ions, when the injected sample ions really comprise the optimised real total charge $Q_{opt}$.

At least one amount of the sample ions is injected into the ion trapping mass analyser to determine the injection time period $t_{opt,v}$, wherein this amount is correlated with the injection time period of the sample ions. For each of these amounts of sample ions the ion trapping mass analyser is detecting a mass spectrum and then from these mass spectra is evaluated the visible total charge $Q_v$. From the observed visible total charge $Q_v$ of the amounts of the sample ions and their corresponding injection time period is the ion injection time period $t_{opt,v}$ determined using their correlation.

The ion injection time period $t_{opt,v}$ is preferably determined using at least of the detected mass spectra of the different amounts of sample ions of the first step.

The ion injection time period $t_{opt,v}$ can be also determined, wherein further mass spectra are detected for at least some of the at least one amount of the sample ions providing additional values of the visible total charge $Q_v$. This can be done to improve the accuracy of the visible total charge $Q_v$ of an amount of sample ions by improved statistics. Preferably an average value is determined from the values of the visible total charge $Q_v$ of an amount of sample ions. This method has to be applied to determine the ion injection time period $t_{opt,v}$, when an ion flow with fluctuations is providing sample ions to the ion storage unit.

In a preferred embodiment the ion injection time period $t_{opt,v}$, which is related to the optimised visible charge $Q_{ref,opt}$ of the reference sample, is only determined from the mass spectrum of one amount of the sample ions. Then the formula (1) can be used to determine the ion injection time period $t_{opt,v}$.

If more than one amount of sample ions is used for the determination of the ion injection time period $t_{opt,v}$, in one preferred embodiment an linear fit can be used to determine the linear correlation of the visible total charge $Q_v$ with corresponding injection time period of the different amounts of the sample ions and then from this linear correlation can be derived the ion injection time period $t_{opt,v}$, which is correlated with the optimised visible charge $Q_{ref,opt}$ of the reference sample.

In particular a reference sample can be a clean sample, in which the real total charge $Q_{real}$ of the trapped clean sample ions is visible or at least substantially visible in its mass spectra as visible total charge $Q_v$.

If the actual total charge $Q_{real}$ of the sample ions is visible in the detected spectrum, the ion injection time period $t_{opt,v}$ which is related to the optimised visible charge $Q_{opt}$ of the clean sample, determined from the visible total charge $Q_v$ evaluated from mass spectra of sample ions is the optimised accumulation time $t_{opt,real}$ for the optimised total ion charge $Q_{opt}$ because the optimised visible charge $Q_{clean,opt}$ is also the optimised total charge $Q_{opt}$. Accordingly the compensation factor c is then 1.

But the compensation factor c can be determined by the inventive method of claim 2 also for experiments, wherein the complete total charge $Q_{real}$ of an ion package of sample ions is not visible in the detected spectrum, so that $Q_v<Q_{real}$. Accordingly the observed relative m/z shift is larger than expected from the visible total charge value $Q_v$ evaluated from mass spectra of sample ions, if this value would be the value of the real total charge $Q_{real}$. Further the optimised ion injection time period $t_{opt,v}$, which is related to the optimised visible charge $Q_{opt}$ of a clean sample, determined from the visible total charge $Q_v$ based on the formula (1) has a value of $t_{opt,v}$, which is too high, because $Q_v$ when equal to $Q_{opt}$ is not representing the complete total charge $Q_{real}$ of the sample ions as required to determine $t_{opt}$. To compensate this, the compensation factor c is provided. It is determined by dividing the clean slope of the linear correlation of the relative m/z shift with the visible total charge $Q_v$ of mass spectra of a clean sample ions detected with the ion trapping mass analyser, which is the slope of the linear correlation of the relative m/z shift with the visible total charge $Q_v$ of mass spectra of the clean sample detected with the ion trapping mass analyser by the sample slope determined before.

A clean sample, from which the clean slope is determined, is a sample, for which the real total charge $Q_{real}$ of an ion package of its sample ions is visible, or substantially visible, in its mass spectra detected with the ion trapping mass analyser. For a clean sample preferably at least 95% of the real total charge $Q_{real}$ of an ion package is visible as visible total charge $Q_v$ in its mass spectra, more preferably at least 99% of the real total charge $Q_{real}$ of an ion package is visible and most preferably 99.8% of the real total charge $Q_{real}$ of an ion package is visible. Accordingly the optimized accumulation time $t_{opt,real}$ can be directly determined for a clean sample from the visible total charge $Q_v$ evaluated from a mass spectrum of a prescan experiment as described before.

In general in this step of the inventive method, the compensation factor c is also determined from any kind of reference sample, not only a clean sample. For such a reference sample the complete total charge $Q_{real}$ of an ion package of reference ions may not be visible in its detected spectrum. Accordingly the ion injection time period $t_{opt,v}$ is defined based on equation (1) taking into account the optimised value of visible total charge $Q_{ref,opt}$ for detecting mass spectra of the reference sample replacing in the equation the optimised total charge $Q_{opt}$ of a clean sample. So the ion injection time period $t_{opt,v}$, which is related to the optimised visible charge $Q_{ref,opt}$ of the reference sample, is the injection time period of sample ions to perform the mass analysis, when for the ion package of sample ions the optimised visible charge $Q_{ref,opt}$ of the reference sample is visible in their detected mass spectrum. The ion injection time period $t_{opt,v}$ is determined only from the visible total charge $Q_v$ trapped in the ion trapping mass analyser evaluated from the detected mass spectrum of at least one amount of the sample ions and the corresponding injection time periods of the sample ions. So when sample ions are injected to the ion storage unit with the optimised ion injection time period $t_{opt,v}$, which is related to the optimised visible charge $Q_{ref,opt}$ of the reference sample, the optimised visible total charge $Q_{ref,opt}$ for detecting mass spectra of the reference sample is also visible in the mass spectrum of the analysed sample.

But when the ratio of the total charge of the trapped sample ions visible in the mass spectra to the real total charge of the trapped sample ions of the analysed sample deviates from the ratio of the total charge of the trapped reference ions visible in the mass spectra to the real total charge of the trapped reference ions of the reference sample, the assumption is not correct, that the sample is also analysed at the optimised ion injection time period $t_{opt,real}$ which is the case for the reference sample. In particular if the ratio of the total charge of the trapped sample ions visible in the mass spectra to the real total charge of the trapped sample ions is lower than the ratio of the total charge of the trapped reference ions visible in the mass spectra to the real total charge of the trapped reference ions, the determined ion injection time period $t_{opt,v}$ of sample ions, which is related to the optimised visible charge $Q_{ref,opt}$ of the reference sample, has a value of $t_{opt,v}$, which is too high, because $Q_v$ is not representing the complete total charge $Q_{v,ref}$ visible for the reference sample in its mass spectra which is required to determine $t_{opt,real}$. To compensate this the compensation factor c is determined by dividing the reference slope of the linear correlation of the relative m/z shift with the visible total charge $Q_v$ of mass spectra of reference ions ionised from the reference sample detected with the ion trapping mass analyser by the the sample slope of the linear correlation of the relative m/z shift with the visible total charge $Q_v$ of mass spectra of sample ions detected with the ion trapping mass analyser. The optimised ion injection time period $t_{opt,real}$ to analyse sample ions and in particular to detect mass spectra of sample ions is determined by multiplication of the ion injection time period $t_{opt,v}$ of sample ions, which is related to the optimised visible charge $Q_{ref,opt}$ of the reference sample, with the determined compensation factor c.

The reference slope of the linear correlation of the relative m/z shift with the visible total charge $Q_v$ of mass spectra of reference ions detected with the ion trapping mass analyser is the slope of the linear correlation of the relative m/z shift with the visible total charge $Q_v$ of mass spectra detected with the ion trapping mass analyser, when reference ions are investigated, which are ionised from the reference sample.

A reference sample, for which the reference slope of the linear correlation of the relative m/z shift with the visible total charge $Q_v$ of mass spectra of its reference ions detected with the ion trapping mass analyser is determined, is a sample, for which a specific portion of the real total charge $Q_{real}$ of an investigated ion package of the reference ions is visible in its mass spectra, the visible total charge $Q_v$. For a reference sample preferably at least 20% of the real total charge $Q_{real}$ of an investigated ion package of the reference ions is visible, more preferably at least 65% of the real total charge $Q_{real}$ of an investigated ion package of the reference ions is visible and most preferably 90% of the real total charge $Q_{real}$ of an investigated ion package of the reference ions is visible.

The inventive method of claim 5 determines a compensation factor, which is a parameter for controlling the amount of sample ions ionised from a sample, which are injected from an ion storage unit of a mass spectrometer into its ion trapping mass analyser, which then performs a mass analysis of the injected sample ions. The sample investigated with this method comprises at least one specific standard component—also named lock mass.

For each specific standard component comprised in the sample at least one specific sample ion is generated by ionisation. In some cases different species of sample ions may by generated by ionisation from one standard component.

Each specific sample ion of the at least one specific standard component comprised in the sample has an m/z ratio, which may be known and is related to the used ionisation process. So accordingly the inventive method of claim 5 can be used for a sample, wherein the m/z ratio of at least one of the sample ions is known.

The inventive method of claim 5 comprises the steps:

In the first step, at least one mass spectrum is detected for at least one amount of the sample ions by the ion trapping mass analyser. The at least one amount of the sample ions is injected from the ion storage unit into the ion trapping mass analyser.

In a preferred embodiment of the inventive method the at least one mass spectrum is detected for at least one pre-selected amount of the sample ions. The amounts of sample ions for which mass spectra are detected in the first step are selected before the detection of the mass spectra is started. In particular all amounts for which the mass spectra are detected in the first step are selected before the first mass spectrum is detected. The selection of the pre-selected amounts can be e.g. provided by a control unit, by a user via an interface of a control unit or by the user selecting a specific method for mass analysis or a specific class of samples to be analysed with the ion trapping mass analyser. The preselection at least one amount of the sample ions can be also provided by the preselection of at least one injection time period of the sample ions into the ion storage unit, when a constant sample ion flow is provided to the ion storage unit.

In general any amount of sample ions or any injection time period can be used to detect the at least one mass spectrum in the first step. It is preferred to use amounts of sample ions, which have a total charge $Q_{real}$, which is below the optimised total charge $Q_{opt}$. It is also preferred to use injection time periods of the sample ions into the ion storage unit, which are below the optimised injection time period $t_{opt,real}$, when an ion package of sample ions of the optimised total charge $Q_{opt}$ is accumulated in the ion storage unit.

In another embodiment of the method of claim 5 the at least one amount of sample ions, for which in the first step at least one mass spectrum is determined, is not selected. Instead at least one specific instant of time may be selected, when in a certain time period, which is a defined time period, the sample ions are supplied from an ion source along an ion path, may be via ion optics or another ion storage unit, to the ion storage unit, wherein different amounts of sample ions are accumulated in the ion storage unit at each specific moment. Depending on the flow of the sample ions provided to the ion storage unit a specific amount of sample ions is accumulated in the ion storage unit for each specific instant of time during the certain time period and then injected into the ion trapping mass analyser. If e.g. an ion source is providing an ion flow with a fluctuation, different amounts of sample ions will be accumulated in the ion storage unit at different moments. By the visible total charge $Q_v$ of an accumulated amount of the sample ions and/or an observed shift of the m/z values of the mass peaks of the sample ions derived from their detected mass spectrum can be observed if a small or large amount of sample ions has been accumulated.

In a following step, the relative m/z shift induced by a space charge of the sample ions is evaluated from at least one detected mass spectrum of the at least one amount of the sample ions. The relative m/z shift is evaluated by determination of a relative difference of m/z values of at least one sample ion, for which the m/z ratio is known, in the at least one detected mass spectrum to its known m/z ratio.

In this step, the dependency of the relative m/z shift on the amounts of the sample ions is investigated.

The relative difference of a m/z value of a sample ion, for which the m/z ratio is known, in a detected mass spectrum to its known m/z ratio is determined by identifying a peak of the sample ion in the detected mass spectrum, determining the m/z value of the peak from the detected mass spectrum and calculating the relative difference $d_r$ of m/z value $m/z_{ob}$ of the peak to the known m/z ratio m/z of the sample ion. This calculated relative difference $d_r$ is the value of the relative m/z shift of the sample ion in the detected mass spectrum:

$$d_r = \frac{|m/z_{ob} - m/z|}{m/z} = \frac{\Delta m/z}{m/z} \tag{12}$$

The peak of the sample ion, for which the m/z ratio is known, can be identified in the detected mass spectrum due its specific high relative abundance, the specific peak structure of the peak pattern of sample ions, which are generated by ionisation of that specific standard component, from which the sample ion is generated by the ionisation and/or the known m/z ratio of the sample ion.

If it is known that the sample ion has a very high relative abundance in a detected mass spectrum, because it is ionised from a standard component, and such a peak of very high relative abundance occurs in a mass range close to the expected m/z values of the sample ions, this peak can be identified as the peak of the sample ion. The very high relative abundance can be defined by the threshold value of the relative abundance, which can be e.g. related to the total relative abundance of all ions in the mass spectrum or a range of the mass spectrum or to the highest value of the relative abundance of another peak of sample ions, which are preferably sample ions not generated from a standard component of sample by ionisation. Only a peak with a relative abundance over the threshold value is a peak having a very high relative abundance. The threshold value of the relative abundance related to the total relative abundance of all ions in the mass spectrum can higher be than 2% of the total relative abundance of all ions in the mass spectrum, preferably higher than 5% of the total relative abundance of all ions in the mass spectrum, more preferably higher than 10% of the total relative abundance of all ions in the mass spectrum and most preferably higher than 15% of the total relative abundance of all ions in the mass spectrum. The threshold value of the relative abundance related to the total relative abundance of all ions in a range of the mass spectrum can higher than 2% of the total relative abundance of all ions in the range of the mass spectrum, preferably higher than 10% of the total relative abundance of all ions in the range of the mass spectrum, more preferably higher than 20% of the total relative abundance of all ions in the range of the mass spectrum and most preferably higher than 30% of the total relative abundance of all ions in the range of the mass spectrum. The mass range, for which the threshold value is defined, is typically below 50 Thomson, preferably below 20 Thomson, more preferably below 5 Thomson and most preferably below 1 Thomson. In relation to the known m/z ratio of the sample ion the mass range, for which the threshold value is defined, is typically below 10% of the known m/z ratio, preferably below 1% of the known m/z ratio, more preferably below 1,000 ppm of the known m/z ratio and most preferably below 50 ppm of the known m/z ratio. The threshold value of the relative abundance related to the highest value of the relative abundance of another peak of sample ions is typically 30% higher than the highest value of the relative abundance of another peak of sample ions, preferably 70% higher than the highest value of the relative abundance of another peak of sample ions, more preferably 100% higher than the highest value of the relative abundance of another peak of sample ions and most preferably 200% higher than the highest value of the relative abundance of another peak of sample ions.

Preferably the mass range, in which the peak of very high abundance is identified as the peak of the sample ion, is around the known m/z ratio of the sample ion. Typically the mass range can be symmetric to the known m/z ratio of the sample ion, so that the known m/z value is in the center of the mass range. Of course the known m/z value may be not correctly in the center of the mass range, but in the central section of the mass range, which encompasses 10% of the mass range, preferably 5% of the mass range. Typically is the maximum distance between the borders of the mass range and its center is below 20 ppm of the known m/z value of the sample ion, preferably below 15 ppm of the known m/z value of the sample ion, more preferably below 10 ppm of the known m/z value of the sample ion and most preferably below 6 ppm of the known m/z value of the sample ion. For an ion trapping mass analyser a maximum m/z shift value may be possible or defined as a threshold value, which is accepted. Then maximum distance between the borders of the mass range and its center is typically below 100% of the maximum m/z shift value, preferably below 80% of the maximum m/z shift value and particular preferably below 60% of the maximum m/z shift value.

But the mass range can extended from the known m/z value of the sample ion preferably to higher m/z values, at which the m/z value of the peak of sample ion is expected in the detected mass spectra due to the m/z shift. In this case the distance between the lower border of the mass range and its center is typically below 20% of the mass range, preferably below 10% of the mass range, more preferably below 5% of the mass range and most preferably below 2% of the mass range.

In general the peak of a sample ion having a known m/z value can be identified in a detected mass spectrum as the peak of highest relative abundance in mass range close to the known m/z value of the sample ion. There might be applied additional criteria to define if this identification is correct, because it might be possible that the identified peak arises from another sample ion for which the m/z value is unknown, which has also an m/z value in the in mass range close to the known m/z value of the sample ion of the standard component.

Preferably the mass range, in which the peak of the sample ion is identified as the peak of highest relative abundance, is around the known m/z ratio of the sample ion. Typically the mass range can be symmetric to the known m/z ratio of the sample ion, so that the known m/z value is in the center of the mass range. Of course the known m/z value may be not correctly in the center of the mass range, but in the central section of the mass range, which encompasses 10% of the mass range, preferably 5% of the mass range. Typically is the maximum distance between the borders of the mass range and its center is below 20 ppm of the known m/z value of the sample ion, preferably below 15 ppm of the known m/z value of the sample ion, more preferably below 10 ppm of the known m/z value of the sample ion and most preferably below 6 ppm of the known m/z value of the sample ion. For an ion trapping mass analyser a maximum m/z shift value may be possible or defined as a threshold value, which is accepted. Then maximum distance between the borders of the mass range and its center is typically below 100% of the maximum m/z shift value, preferably below 80% of the maximum m/z shift value and particular preferably below 60% of the maximum m/z shift value.

But the mass range can extended from the known m/z value of the sample ion preferably to higher m/z values, at which the m/z value of the peak of sample ion is expected in the detected mass spectra due to the m/z shift. In this case the distance between the lower border of the mass range and its center typically below 20% of the mass range, preferably below 10% of the mass range, more preferably below 5% of the mass range and most preferably below 2% of the mass range.

If the peaks of sample ions of a standard component are expected in a mass range, where no peaks are expected from the sample ions of the other molecules of the sample, then these peaks can be identified as the peaks of the sample ions of a standard component. In particular sometimes the sample ions of a standard component are generated by a fragmentation of the standard component into small fragments, so that these sample ions have lower m/z values than the sample ions of other components of the sample, which are only fragmented in fragments of similar low m/z values with at most a very small probability. Accordingly the observed maximum peak intensity of the sample ions of the standard component in the mass range of the observed lower m/z values is at least 3 times, preferably 5 times and particular preferably 10 times higher than the observed maximum peak intensity of the sample ions of the other components of the sample.

The m/z value of a peak identified as peak of the sample ion is determined by methods known by a skilled person, in particular by defining the centroid or local maximum of the peak. The m/z value of the centroid of local maximum is then the m/z value of the peak.

Then from the determined relative difference of the m/z value of the at least one sample ion, for which the m/z ratio is known, in a detected mass spectrum to its known m/z ratio the relative m/z shift of the detected mass spectrum is evaluated by a method which is deriving from these relative differences of the m/z value of the at least one sample ion in the detected mass spectrum a typical relative difference of the m/z values in the detected mass spectrum, preferably by averaging the determined relative differences of the at least one sample ion.

In another step, the at least one detected mass spectrum of the at least one amount of the sample ions is evaluated to determine the visible total charge $Q_v$ of the sample ions trapped in the ion trapping mass analyser during the detection of the mass spectrum.

In the next step, the results of the two preceding steps are used to determine the sample slope of the linear correlation of the relative m/z shift with the visible total charge $Q_v$ of mass spectra of sample ions detected with the ion trapping mass analyser. Each sample has its specific sample slope value. The value of the sample slope depends on the ratio of the visible total charge $Q_v$ of investigated sample ions derived from the mass spectra detected with the ion trapping mass analyser to the real total charge $Q_{real}$ of the investigated sample ions.

Both correlated parameters, relative m/z shift and the visible total charge $Q_v$, are observed in the mass spectra of the sample when detected with an ion trapping mass analyser and depend on the amount of the sample ions in the mass analyser.

This sample slope can be in one embodiment of the inventive method calculated as the ratio of the relative m/z shift induced by the space charge of the sample ions and the visible total charge $Q_v$ of one amount of sample ions injected and trapped in the ion trapping mass analyser, which are evaluated in the two preceding steps from one mass spectrum of the one amount of sample ions detected in the ion trapping mass analyser. The relative m/z shift of the one amount of sample ions is evaluated from the one detected mass spectra by determination of the relative difference of the m/z value of at least one sample ion, for which the m/z ratio is known, in the one detected mass spectrum to its known m/z ratio. When the relative difference of m/z values is determined for more than one species of sample ions, then the relative m/z shift of the one amount of sample ions is derived from the determined relative differences of m/z values of the more than one species of sample ions by deriving from the determined relative differences of m/z values of the more than one species of sample ions a typical value of the relative differences of m/z values of sample ions. This typical value—the relative m/z shift of the one amount of sample ions—is preferably derived from the determined relative differences of m/z values of the more than one species of sample ions by averaging the determined relative differences of m/z values.

This sample slope can be in another embodiment of the inventive method calculated as the ratio of the difference of the relative m/z shift induced by the space charge of the sample ions and the difference of the visible total charge $Q_v$ of two different amounts of sample ions injected and trapped in the ion trapping mass analyser, which are evaluated in the two preceding steps from the two detected mass spectra of the two amounts of sample ions detected in the ion trapping mass analyser. The difference of the relative m/z shift of the two amounts of sample ions is evaluated from the two detected mass spectra by determination of the relative difference of the m/z value of at least one sample ion, for which the m/z ratio is known, in the two detected mass spectra of the two amounts of sample ions to its known m/z ratio. When the relative difference of m/z values is determined for more than the one species of sample ions, then the difference of the relative m/z shift of the two amounts of sample ions is derived from the evaluated relative m/z shift of the each of two amounts of sample ions.

It has already described before, how the relative m/z shift of one amount of sample ions cans derived from the determined relative differences of m/z values of more than one species of sample ions, for which the m/z ratio is known.

The sample slope describes for the sample, for which the mass analysis shall be performed, how the relative m/z shift observed in the mass spectra of the sample ions is correlated with the visible total charge $Q_v$ which can be determined from a detected mass spectrum of the sample ions. Further embodiments to determine and in particular to calculate the sample slope are described below.

Because the correlation of the relative m/z shift with the visible total charge $Q_v$ of a sample is a linear function by means of the sample slope of the linear function, the relative m/z shift can be determined for any observed visible total charge $Q_v$ of an amount of investigated sample ions.

In one embodiment of the inventive method of claim 5 the mass spectrum of one amount of sample ions is used to calculate the sample slope of the linear correlation of the relative m/z shift with the visible total charge $Q_v$ of mass spectra of sample ions detected with the ion trapping mass analyser, as exemplified before. Preferably in this method one amount of sample ions has been selected, for which a mass spectrum will be detected. Then the sample slope of the linear correlation can be calculated by evaluating the detected mass spectrum. The investigated amount of sample ions can be e.g. selected by defining an injection time period, in which sample ions are injected into the ion storage unit, which are then injected into the ion trapping mass analyser to detect their mass spectrum.

In another embodiment of the inventive method of claim 5 the mass spectra of two amounts of sample ions are used to calculate the sample slope of the linear correlation of the relative m/z shift with the visible total charge $Q_v$ of mass spectra of sample ions detected with the ion trapping mass analyser, as exemplified before. Preferably in this method two different amounts of sample ions have been selected, for which mass spectra will be detected. Then the sample slope of the linear correlation can be calculated by evaluating the two detected mass spectra. The investigated amounts of sample ions can be e.g. selected by defining two different injection time periods, in which sample ions are injected into the ion storage unit, which are then injected into the ion trapping mass analyser to detect their mass spectra.

Also the mass spectra of more than two different amounts of sample ions can be used in the inventive method of claim 5 to determine the sample slope of the linear correlation of the relative m/z shift with the visible total charge $Q_v$ of mass spectra of sample ions detected with the ion trapping mass analyser.

So it is possible, that in another embodiment, in a first step of determining the sample slope the ratio of the difference of the relative m/z shift and the difference of the visible total charge $Q_v$ is determined for mass spectra of different pairs of two of the different amounts of sample ions and then the sample slope of the linear correlation of the relative m/z shift with the visible total charge $Q_v$ of mass spectra of sample ions detected with the ion trapping mass analyser is calculated by averaging the ratios determined for the different pairs of two of the different amounts of sample ions.

In another embodiment the mass spectra detected for the different amounts of sample ions are used to determine the the sample slope of the linear correlation of the relative m/z shift with the visible total charge $Q_v$ of mass spectra of sample ions detected with the ion trapping mass analyser, wherein a linear fit is used. This fit is taking into account the evaluated relative m/z shifts and the evaluated visible total charges $Q_v$ of the mass spectra of the different amounts of sample ions. Based on these values can be created a two-dimensional data set of the relative m/z shifts and correlated values of visible total charges $Q_v$ of mass spectra of sample ions detected with the ion trapping mass analyser, to which a linear fit method can be applied which is determining the sample slope of the linear correlation of the relative m/z shift with the visible total charge $Q_v$ of the these mass spectra, which is the slope of the fitted linear function.

In the following step of the inventive method of claim 5, a compensation factor c is determined, which is used for adjusting the ion injection time period $t_{opt,v}$ of sample ions injected into the ion storage unit to perform a mass analysis. The ion injection time period $t_{opt,v}$ is the injection time period, which is related to the optimised visible charge $Q_{ref,opt}$ of a reference sample. The optimised visible charge $Q_{ref,opt}$ of the reference sample is that amount of the visible total charge $Q_v$, which is visible in a mass spectrum of the reference sample, when the real total charge $Q_{real}$ of investigated amount of reference ions, which are the ions ionised from the reference sample, has the value of the optimised real total charge $Q_{opt}$. Accordingly when the optimised visible charge $Q_{ref,opt}$ of the reference ions is visible in a mass spectrum of the reference sample, the mass spectrum has been detected with the optimised real total charge $Q_{opt}$ of the investigated ions. In this case of the amount of the investigated reference ions the mass spectrum of the reference sample is detected with a high quality performance. The ion injection time period $t_{opt,v}$, in which sample ions are injected into the ion storage unit to perform the mass analysis, is defining that ion injection time period, due to which the optimised visible charge $Q_{ref,opt}$ of a reference sample is observed as visible charge in a mass spectrum of the sample ions, when the sample ions injected in the ion storage unit have been ejected into the ion trapping mass analyser for the detection of the mass spectrum. Because normally another ratio of the real total charge $Q_{real}$ is visible as visible total charge $Q_v$ in the mass spectrum of the sample ions compared with the ratio of real total charge $Q_{real}$ visible as visible total charge $Q_v$ in the mass spectrum of the reference ions, the mass spectrum of the sample ions is not detected with optimised total charge $Q_{opt}$, when they are injected into the ion storage unit during the ion injection time period $t_{opt,v}$. Accordingly the inventive method of claim 5 is determining the compensation factor c to adjust the ion injection time period $t_{opt,v}$ in that way, the an amount of the sample ions of the optimised total charge $Q_{opt}$ is injected into the ion storage unit and then analysed with the ion trapping mass analyser. The ion injection time period $t_{opt,v}$ is determined only from the visible total charge $Q_v$ evaluated from at least one mass spectrum detected with the ion trapping mass analyser of at least one amount of the sample ions and the corresponding injection time period of the sample ions. The linear correlation between the visible total charge $Q_v$ in the detected mass spectra and the injection time period of the sample ions is used to define the ion injection time period $t_{opt,v}$, when optimised visible charge $Q_{ref,opt}$ of the reference ions is visible in a mass spectrum of sample ions.

At least one amount of the sample ions is injected into the ion trapping mass analyser to determine the ion injection time period $t_{opt,v}$, wherein this amount is correlated with the injection time period of the sample ions. For each of these amounts of sample ions the ion trapping mass analyser is detecting a mass spectrum and then from these mass spectra is evaluated the visible total charge $Q_v$. From the observed visible total charge $Q_v$ of the amounts of the sample ions and their corresponding injection time period is the ion injection time period $t_{opt,v}$ determined, which is related to the optimised visible charge $Q_{ref,opt}$ of the reference sample.

The ion injection time period $t_{opt,v}$ is preferably determined using the at least one detected mass spectrum of the least one amount of sample ions of the first step.

The ion injection time period $t_{opt,v}$ can be also determined, wherein further mass spectra are detected for at least some of the at least one amount of the sample ions providing additional values of the visible total charge $Q_v$. This can be done to improve the accuracy of the visible total charge $Q_v$ of an amount of sample ions by improved statistics. Preferably an average value is determined from the values of the visible total charge $Q_v$ of an amount of sample ions. This method has to be applied to determine the ion injection time period $t_{opt,v}$, when an ion flow with fluctuations is providing sample ions to the ion storage unit.

Other preferred embodiments to determine the ion injection time period $t_{opt,v}$ have been already described before and can also be used in the inventive method of claim 5.

If the actual total charge $Q_{real}$ of the sample ions is visible in the detected spectrum, the ion injection time period $t_{opt,v}$ which is related to the optimised visible charge $Q_{opt}$ of a clean sample determined from the visible total charge $Q_v$ evaluated from mass spectra of sample ions is the optimised accumulation time $t_{opt,real}$ for the optimised total ion charge $Q_{opt}$ because the optimised visible charge $Q_{clean,opt}$ is also the optimised total charge $Q_{opt}$. Accordingly the compensation factor is then 1.

But the compensation factor c can be determined by the inventive method of claim 5 also for experiments, wherein the complete real total charge $Q_{real}$ of an ion package of sample ions is not visible in the detected spectrum, so that $Q_v<Q_{real}$. Accordingly the observed relative m/z shift is larger than expected from the visible total charge value $Q_v$ evaluated from mass spectra of sample ions, if this value would be the value real total charge $Q_{real}$. Further the optimised ion injection time period $t_{opt,v}$, which is related to the optimised visible charge $Q_{opt}$ of a clean sample, determined from the visible total charge $Q_v$ has a value of $t_{opt,v}$, which is too high, because $Q_v$ is not representing the complete total charge $Q_{real}$ as required to determine $t_{opt}$. To compensate this, the compensation factor c is provided. It is determined by dividing the clean slope of the linear correlation of the relative m/z shift with the visible total charge $Q_v$ of mass spectra of clean sample ions detected with the ion trapping mass analyser by the sample slope determined before. More details about the clean slope are already provided regarding the inventive methods of the claims 1 and 2. The same clean slope is also used in the inventive method of claim 5.

In general in this step of the inventive method, the compensation factor c is also determined from any kind of reference sample, not only a clean sample. For such a reference sample the complete total charge $Q_{real}$ of an ion package may not be visible in its detected spectrum. Accordingly the on injection time period $t_{opt,v}$ is defined based on equation (1) taking into account the optimised value of visible total charge $Q_{ref,opt}$ for detecting mass spectra of the reference sample replacing in the equation the optimised total charge $Q_{opt}$ of a clean sample. So the ion injection time period $t_{opt,v}$, which is related to the optimised visible charge $Q_{ref,opt}$ of the reference sample, is the injection time period of sample ions to perform the mass analysis, when for the ion package of sample ions the optimised visible charge $Q_{ref,opt}$ of the reference sample is visible in their detected mass spectrum. The ion injection time period $t_{opt,v}$ is determined only from the visible total charge $Q_v$ trapped in the ion trapping mass analyser evaluated from the detected mass spectrum of at least one amount of the sample ions and the corresponding injection time periods of the sample ions. So when sample ions are injected to the ion storage unit with the optimised ion injection time period $t_{opt,v}$, which is related to the optimised visible charge $Q_{ref,opt}$ of the reference sample, the optimised visible total charge $Q_{ref,opt}$ for detecting mass spectra of the reference sample is also visible in the mass spectrum of the analysed sample.

But when the ratio of the real total charge of the trapped sample ions visible in the mass spectra to the real total charge of the trapped sample ions of the analysed sample deviates from the ratio of the total charge of the trapped reference ions visible in the mass spectra to the real total charge of the trapped reference ions of the reference sample, the assumption is not correct, that the sample is also analysed at the optimised ion injection time period $t_{opt,real}$ which is the case for the reference sample, which is explained in more details before.

To compensate this the compensation factor c is determined by dividing the reference slope of the linear correlation of the relative m/z shift with the visible total charge $Q_v$ of mass spectra of reference ions ionised from the reference sample detected with the ion trapping mass analyser by the sample slope of the linear correlation of the relative m/z shift with the visible total charge $Q_v$ of mass spectra of sample ions detected with the ion trapping mass analyser, which has been determined in the step before of the inventive method of claim 5. Then the optimised ion injection time period $t_{opt,real}$ to analyse sample ions and in particular to detect mass spectra of sample ions is determined by multiplication of the ion injection time period $t_{opt,v}$ of sample ions, which is related to the optimised visible charge $Q_{ref,opt}$ of the reference sample, with the determined compensation factor c.

The reference slope of the linear correlation of the relative m/z shift with the visible total charge $Q_v$ of mass spectra of reference ions detected with the ion trapping mass analyser is the slope of the linear correlation of the relative m/z shift with the visible total charge $Q_v$ of mass spectra detected with the ion trapping mass analyser, when reference ions are investigated, which are ionised from the reference sample.

A reference sample, for which the reference slope of the linear correlation of the relative m/z shift with the visible total charge $Q_v$ of mass spectra of its reference ions detected with the ion trapping mass analyser is determined, is a sample, for which a specific portion of the real total charge $Q_{real}$ of an investigated ion package of the reference ions is visible in its mass spectra, the visible total charge $Q_v$. For a reference sample preferably at least 20% of the real total charge $Q_{real}$ of an investigated ion package of the reference ions is visible, more preferably at least 65% of the real total charge $Q_{real}$ of an investigated ion package of the reference ions is visible and most preferably 90% of the real total charge $Q_{real}$ of an investigated ion package of the reference ions is visible.

In claim 9 is provided a method using the determined compensation factor c to perform a mass analysis of sample ions ionised from the sample in an ion trapping mass analyser. The optimised ion injection time period $t_{opt,real}$ of sample ions in the ion storage unit to perform a mass analysis of sample ions is defined by $$t_{opt,real}=C\,t_{opt,v}. \tag{13}$$

The fourth object regarding the mass shift correction is solved by the methods of the claims 10 and 11.

The sample slope of the linear correlation of the relative m/z shift with the visible total charge $Q_v$ of a sample, which describes how the change of the relative m/z shift is correlated with the change of the visible total charge $Q_v$ in the mass spectra of sample ions ionised from the sample and which can be determined from one detected mass spectrum or more than one detected mass spectra of the ions of the investigated sample described above, can be used in the methods to correct the mass shift observed in a mass spectrum of sample ions detected by an ion trapping mass analyser. Because this correlation is a linear function, in this case by the determined sample slope the relative m/z shift is determined for each observed visible total charge $Q_v$ of an amount of investigated ions. The relative m/z shift is determined by multiplying the observed visible total charge $Q_v$ of an amount of investigated sample ions with the sample slope, which describes how the change of the relative m/z shift is correlated with the visible total charge $Q_v$. The determined relative m/z shift is then used to correct the m/z values of the detected mass spectrum of the sample ions.

All detailed embodiments how to determine the sample slope of a sample described regarding the methods of the claims 1, 2 and 5 can be also used in the methods of the claims 10 and 11.

In a preferred embodiment of the inventive methods, the ion trapping mass analyser is a Fourier transform mass analyser. In particular in the mass spectra of Fourier transform mass analyser not the complete total charge of the injected ion package of sample ions might be visible, because strong destructive interference effects of the image current signal and also coalescence effects due ion interactions in the mass analyser might occur.

In other ion trapping mass analysers such as linear ion trap mass analysers and 3D ion trap mass analysers detecting the ions with an detector for example the complete total charge of the injected ion package of sample ions might not be visible due to saturation effects of the detector.

In an embodiment of the inventive methods, the mass analysis of the sample ions is performed by detecting a mass spectrum.

In an embodiment of the inventive methods, the mass spectra are detected for two different amounts of the sample ions.

In another embodiment of the inventive methods, the mass spectra are detected for at least three different amounts of the sample ions.

In an embodiment of the inventive methods, the observed increased relative m/z shift in relation to the visible total charge $Q_v$ in the detected mass spectra of the different amounts of ions is induced by low peak intensities, interfering and/or non-resolved ions peaks in the at least one detected mass spectrum of sample ions, which do not contribute to the visible total charge $Q_v$. Preferably, the sample ions of the interfering and/or non-resolved ions peaks are sample ions which have a high charge state. In many samples the sample ions have a high charge state, if their charge state is higher than the charge state of 80% of the sample ions. Preferably in many samples the sample ions have only a high charge state, if their charge state is higher than the charge state of 90% of the sample ions. More preferably in many samples the sample ions have only a high charge state, if their charge state is higher than the charge state of 95% of the sample ions. Which sample ions have a high charge state, depends on the investigated sample, in particular the size of the sample ions. If a sample comprises for example complete proteins, then sample ions of a high charge state can have a charge state of at least 20 and higher, preferably of at least 15 and higher and particular preferably of at least 10 and higher. If a sample comprises for example peptides, which are the constituents of proteins, then sample ions of a high charge state can have a charge state of at least 6 and higher, preferably of at least 4 and higher and particular preferably of at least 3 and higher.

In an embodiment of the inventive method, the observed increased relative m/z shift in relation to the visible total charge $Q_v$ in the detected mass spectra of the different amounts of sample ions is induced by large molecules which are comprised in the sample from which the sample ions are ionised. Typically large molecules have a mass which is at least 1.4 times, in particular at least 1.6 times larger than the average mass of the molecules of the sample.

The observed increased relative m/z shift in relation to the visible total charge $Q_v$ in the detected mass spectra of the different amounts of sample ions is induced for large molecules, when their sample ions have a m/z value, at which a mass difference of 1 u (unified atomic mass unit) is not resolved by the ion trapping mass analyser. Then the single isotope peaks of the molecules are not resolved when one atom of the molecule is replaced by an isotope of the atom having another mass and therefore the not resolved isotope peaks do not contribute to the visible total charge $Q_v$ in the detected mass spectra.

Preferably the observed increased relative m/z shift in relation to the visible total charge $Q_v$ in the detected mass spectra of the different amounts of sample ions is induced for large molecules, when the peaks of their isotopologues of their isotope distribution are not resolved by the ion trapping mass analyser. Then the single isotope peaks of the sample ions of the molecules are not resolved, which result from the different mass defects of different atoms comprised in the molecule (e.g. from isotopologues in which the different atoms are replaced by a heavier isotope) and therefore the unresolved isotope peaks do not contribute to the visible total charge $Q_v$ in the detected mass spectra.

Preferably the large molecules, which are comprised in the sample, are eluted from a chromatography column, in particular liquid chromatography column, at a long retention time. The large molecules are typically eluted at the retention time, which is higher than the retention time of 80% of all eluted molecules comprised in the sample from which the sample ions are ionised. Preferably the large molecules are eluted at the retention time, which is higher than the retention time of 90% of all eluted molecules. More preferably the large molecules are eluted at the retention time, which is higher than the retention time of 95% of all eluted molecules. At which time the large molecules are eluted can be defined by the experimental details of the used chromatography process. Important is that the observed increased relative m/z shift in relation to the visible total charge $Q_v$ in the detected mass spectra of the different amounts of ions is induced in particular for molecules, which are eluted from the chromatography column at the end of the chromatography process.

In an embodiment of the inventive methods, the observed increased relative m/z shift in relation to the visible total charge $Q_v$ for at least one of the amounts of the injected sample ions in a Fourier transform mass analyser is caused by coalescence of peaks in the mass spectrum of specific sample ions of the injected ions having nearly the same mass. In such an embodiment, these specific sample ions of the injected ions are not used to evaluate the observable difference of the relative m/z shift or relative m/z shift, though the m/z ratio of the specific sample ions is known.

In an embodiment of the inventive methods, the mass spectra are detected for different amounts of the sample ions injected from the ion storage unit into the ion trapping mass analyser, wherein the difference of the different amounts of the ions sample ionised results from a fluctuation of the supply of the sample ions to the ion storage unit. In this case preferably the different amounts of sample ions are injected into the ion storage unit at different instants of time with the same injection time period. The fluctuation of the supplied sample ions can be induced by the LC process, ionization conditions, gas flow, sample flow, voltage fluctuations, current fluctuations and AGC imperfections.

The difference of the different amounts of the sample ions can also be controlled by varying the injection time period of the ions into the ion storage unit or other experimental parameters.

In an embodiment of the inventive methods, the successive detection of mass spectra of different amounts of the sample ions is executed with a time delay of 0.3 to 60 seconds, preferably of 1 to 30 seconds and particular preferably of 3 to 10 seconds.

In an embodiment of the inventive methods, the detection of the at least one mass spectrum of at least one amount of the sample ions is repeated over the time with a time delay of the successive detection of the at least one mass spectrum of 0.3 to 60 seconds, preferably of 1 to 30 seconds and particular preferably of 3 to 10 seconds.

In an embodiment of the inventive methods, the successive detection of mass spectra of different amounts of the sample ions is repeated over the time with a time delay of the successive detection of mass spectra of 0.3 to 60 seconds, preferably of 1 to 30 seconds and particular preferably of 3 to 10 seconds.

In an embodiment of the inventive methods, a time delay of the successive detection of mass spectra of the at least one amount of sample ions, preferably of the different amounts of the sample ions, depends on the compensation factor determined before, in particular from the detected mass spectra of the different amounts of the sample ions.

If for the compensation factor has been determined a value, which is close to 1, the time delay of the repeated detection of the at least one mass spectrum can be extended. Typically the time delay will be extended, when the determined value of the compensation factor is between 0.7 and 1.3, preferably when the determined value of the compensation factor is between 0.8 and 1.2 and in particular preferably when the determined value of the compensation factor is between 0.9 and 1.1. Typically the value of the time delay will be extended about 50% of its value, preferably about 100% of its value and particular preferably about 300% of its value.

If for the compensation factor has been determined a value, which is not close to 1, the time delay of the repeated detection of the at least mass spectrum can be reduced. Typically the time delay will be reduced, when the determined value of the compensation factor is below 0.2 or above 3, preferably when the determined value of the compensation factor is below 0.35 or above 2 and in particular preferably when the determined value of the compensation factor is below 0.5 or above 1.5. Typically the value of the time delay will be reduced about 50% of its value, preferably about 65% of its value and particular preferably about 80% of its value.

If the determined value of the compensation factor varies over time, the time delay of the repeated detection of mass spectra can be reduced. Typically the time delay will be reduced, when the value of compensation factor varies over time about 0.2, preferably about 0.1 and particular preferably about 0.05. Typically the value of the time delay will be reduced about 50% of its value, preferably about 65% of its value and particular preferably about 80% of its value.

In a preferred embodiment of the inventive methods 1 or 2, the relative difference of the m/z values of the peaks of sample ions observed in the detected mass spectra of at least two of the different amounts of the ions by comparison is determined for at least 3, preferably at least 100 and particular preferably at least 1,000 species of the sample ions.

In a preferred embodiment of the inventive methods 1 or 5, the relative difference of m/z value of a peak of a sample ion, for which the m/z ratio is known, in the at least one detected mass spectrum to its known m/z ratio is determined for at least 2, preferably at least 5 and particular preferably at least 20 species of the sample ions.

In a preferred embodiment of the inventive methods 1 or 2, the relative difference of the m/z values of the peaks of sample ions observed in the detected mass spectra of at least two of the different amounts of the ions by comparison is determined for species of the sample ions, when its peak has a signal-to-noise ratio in the detected mass spectra higher than 5, preferably higher than 10 and in particular preferably higher than 50.

In a preferred embodiment of the inventive methods 1 or 5, the relative difference of m/z value of a peak of a sample ion, for which the m/z ratio is known, in the at least one detected mass spectrum to its known m/z ratio is determined for species of the sample ions, when its peak has a signal-to-noise ratio in an detected mass spectra higher than 5, preferably higher than 10 and in particular preferably higher than 50.

In a preferred embodiment of the inventive methods 1 and 2, the relative difference of the m/z shift values of the peaks of sample ions observed in the detected mass spectra of at least two of the different amounts of the ions by comparison is determined for species of the sample ions having a peak shape in the detected mass spectra, which peak width deviates not more than 20% from the peak width of an expected peak shape, preferably deviates not more than 5% from the peak width of an expected peak shape and particular preferably deviates not more than 2% from the peak width of an expected peak shape.

In a preferred embodiment of the inventive methods 1 or 5, the relative difference of m/z value of a peak of a sample ion, for which the m/z ratio is known, in a detected mass spectrum to its known m/z ratio is determined for species of the sample ions having a peak shape in the detected mass spectrum, which peak width deviates not more than 20% from the peak width of an expected peak shape, preferably deviates not more than 5% from the peak width of an expected peak shape and particular preferably deviates not more than 2% from the peak width of an expected peak shape.

In another preferred embodiment of the inventive methods 1 or 2, the relative difference of the m/z values of the peaks of sample ions observed in the detected mass spectra of at least two of the different amounts of the sample ions by comparison is evaluated for species of the sample ions having a peak shape in the detected mass spectra, which deviates with a mean square error of not more than 20% from an expected peak shape, preferably deviates with a mean square error of not more than 5% from an expected peak shape and particular preferably deviates with a mean square error of not more than 2% from an expected peak shape.

In a preferred embodiment of the inventive methods 1 or 5, the relative difference of m/z value of a peak of a sample ion, for which the m/z ratio is known, in a detected mass spectrum to its known m/z ratio is determined for species of the sample ions having a peak shape in the detected mass spectrum, which peak width deviates with a mean square error of not more than 20% from an expected peak shape, preferably deviates with a mean square error of not more than 5% from an expected peak shape and particular preferably deviates with a mean square error of not more than 2% from an expected peak shape.

In a preferred embodiment of the inventive methods 1 or 2, the relative difference of the m/z values of the peaks of sample ions observed in the detected mass spectra of at least two of the different amounts of the ions by comparison is determined for several species of the sample ions and the relative difference of the m/z values of the peaks of sample ions ("the collective relative difference of the relative m/z values") of the several species of sample ions is determined only from such species of the several species of sample ions when their evaluated relative difference of the m/z values of their peaks deviates not more than an expected value from the average relative difference of the m/z values of the peaks of all several species of ions. The expected value is related to the variation of the relative difference of the m/z values expected for the ion trapping mass analyser and is typically 1.5 times the variation, preferably the variation and particular preferably 0.7 times the variation.

In a preferred embodiment of the inventive methods 1 or 5, the relative difference of m/z value of a peak of a sample ion, for which the m/z ratio is known, in a detected mass spectrum to its known m/z ratio is determined for several species of the sample ions, for which the m/z ratio is known, and the relative difference of the m/z value of the peak of sample ion ("the collective relative difference of the m/z value to the known m/z ratio") of the several species of sample ions is determined only from such species of the several species of sample ions when their determined relative difference of the m/z value of their peaks to its known m/z ratio deviates not more than an expected value from the average relative difference of the m/z values of the peaks of all several species of ions. The expected value is related to the variation of the relative difference of the m/z values expected for the ion trapping mass analyser and is typically 1.5 times the variation, preferably the variation and particular preferably 0.7 times the variation.

In an embodiment of the inventive methods 1 or 2 the relative difference of the m/z values of the peaks of sample ions observed in the detected mass spectra of at least two of the different amounts of the ions by comparison is determined for species of the sample ions, which are members of an isotopic pattern of an ionised molecule in the detected mass spectra, i.e. species that are isotopologues of the isotopic pattern of an ionised molecule observed in the detected mass spectra as part of this isotopic pattern.

In a preferred embodiment of the inventive methods 1 and 5, the relative difference of m/z value of a peak of a sample ion, for which the m/z ratio is known, in a detected mass spectrum to its known m/z ratio is determined for all species of sample ions, which are members of an peak pattern of a standard component, in particular isotopic peak pattern of the sample ions of a standard component, i.e. for all species of sample ions that are isotopologues of the isotopic pattern of the standard component.

In an embodiment of the inventive methods of claim 1 or 2, the relative difference of the m/z values of the peaks of sample ions observed in the detected mass spectra of at least two of the different amounts of the ions by comparison is determined only for one or more species of the sample ions, which are not removed from the mass spectra, or classified, as an outlier.

Outliers are peaks in a mass spectrum with extreme values of the intensity that deviate from the majority of the observed data.

Outliers are also peaks, for which a relative difference of its m/z values is determined from the mass spectra, that deviate from an expected value of the relative difference of observed m/z values. This expected value of the relative difference of observed m/z values can be pre-determined in measurements or by theoretical considerations taking into account the configuration of the electrodes in the ion trapping mass analyser, the applied fields and the distribution of the injected ions in the ion trapping mass analyser. Typically the deviation from the expected value should be not more than 80%. Preferably the deviation should be not more than 50%. In particular preferably the deviation should be not more than 35%.

This evaluation of the relative difference of a the m/z values of the peaks of sample ions can be performed by a statistical outlier removal algorithm known by a skilled person which is excluding species of sample ions for which the relative difference of the m/z values of their peaks is too large or small and/or peaks with extreme values of the intensity.

In an embodiment of the inventive methods 1 and 5, the relative difference of m/z value of a peak of a sample ion, for which the m/z ratio is known, in a detected mass spectrum to its known m/z ratio is determined only for one or more species of the sample ions, which are not removed from the mass spectra, or classified, as an outlier.

Outliers are also peaks of a sample ion, for which the m/z ratio is known, for which the relative difference of its m/z value in a detected mass spectrum to the known m/z ratio of the sample ion deviates from an expected value of the relative difference. This expected value of the relative difference of the observed m/z values to the known m/z ratio of a sample ion can be pre-determined in measurements or by theoretical considerations taking into account the configuration of the electrodes in the ion trapping mass analyser, the applied fields and the distribution of the injected ions in the ion trapping mass analyser. Typically the deviation from the expected value should be not more than 80%. Preferably the deviation should be not more than 50%. In particular preferably the deviation should be not more than 35%.

In an embodiment of the inventive methods, the clean slope of the linear correlation of the relative m/z shift with the visible total charge $Q_v$ of a clean sample trapped in the ion trapping mass analyser is determined by a calibration process.

In another embodiment of the inventive methods, the reference slope of the linear correlation of the relative m/z shift with the visible total charge $Q_v$ of a reference sample trapped in the ion trapping mass analyser is determined by a calibration process.

These calibration processes may be executed one time for the ion trapping mass analyser or at certain calibration times. In such calibration processes at least one mass spectrum of an amount of the sample ions ionised from the clean sample, the clean sample ions, respectively the reference sample, the reference ions, is detected and then from this at least one mass spectrum is the clean slope respectively reference slope of the linear correlation of the relative m/z shift with the visible total charge $Q_v$ of mass spectra of the clean sample respectively the reference sample detected with the ion trapping mass analyser determined in the same way as the determined sample slope of the linear correlation of the relative m/z shift with the visible total charge $Q_v$ of mass spectra of the sample ions detected with the ion trapping mass analyser in the inventive methods, which are providing a parameter for controlling the amount of injected sample ions into the ion trapping transform mass analyser, when not the complete total charge of the amount of sample ions is visible in a detected mass spectrum. Such a sample is not a clean sample and mostly the portion of the total charge of the amount of sample ions visible in a detected mass spectrum of the sample is smaller than the portion of the total charge of the amount of reference ions visible in a detected mass spectrum of the reference sample.

In a preferred embodiment a clean sample is used as calibration sample to determine its clean slope of the linear correlation of the relative m/z shift with the visible total charge $Q_v$ of its mass spectra. About a clean sample is well-known that the complete total charge $Q_{real}$ of an analysed ion package of the clean sample is visible, or substantially visible, in its mass spectra.

Also a reference sample can be used as the calibration sample to determine the its reference slope of the linear correlation of the relative m/z shift with the visible total charge $Q_v$ of its mass spectra detected in the ion trapping mass analyser. For such a calibration sample it is well-known which portion of the complete total charge $Q_{real}$ of an analysed ion package of the calibration sample is visible in its mass spectra.

In an embodiment of the inventive methods, the clean slope of the linear correlation of the relative m/z shift with the visible total charge $Q_v$ of the mass spectra of the clean sample ions trapped in the ion trapping mass analyser is provided by a theoretical approach. Such an approach in provided by Ledford et al. "Space Charge Effects in Fourier Transform Mass Spectrometry. Mass Calibration" Anal. Chem. 1984, 56, 2744-2748. In general mathematical or numerical approaches can be used which are taking into account the electromagnetic fields and the charge distribution of the ions in the ion trapping mass analyser which are providing the m/z shift behaviour of the ion trapping mass analyser.

In an embodiment of the inventive methods, the determined compensation factor is stored for the mass analysis of sample ions comparable with, in particular similar to, the sample used to determine the compensation factor. Samples are e.g. comparable if they have the same origin, e.g. blood, specific cells etc. and/or are created by the same experimental conditions. They may be e.g. ionised from the same spot of a MALDI sample or created in a specific time range of an liquid chromatography run, when experimental condition are nearly constant, in particular changing with a small gradient over time. The experimental parameter of comparable samples typically are not changing more than 20%, preferably not more than 10%, more preferably not more than 5% and most preferably not more than 2%.

In an embodiment of the inventive methods, the compensation factor or the sample slope of the linear correlation of the relative m/z shift with the visible total charge $Q_v$ is determined by repeated determination of compensation factor values or sample slope values determined from the at least one detected mass spectrum, in particular by comparing the detected mass spectra of the different amounts of the sample ions, and averaging the determined compensation factor values or sample slope values over the time. By this averaging the determination is based on a better statistics.

For example a rolling average of a specific number of N cycles of the last measurements and correlated determinations of the compensation factor c or the sample slope can be used for this determination.

It a prerequisite for the determination of the compensation factor or the sample slope of the linear correlation of the relative m/z shift with the visible total charge $Q_v$ by averaging of compensation factor values or sample slope values, which have been determined over the time, that the characteristics of the measured sample does not change in the time period of the repeated determination considerably. For example, when MS spectra are measured in an LC run, the results from consecutive scans can be averaged within a certain time frame, as the properties of consecutive scans (in terms of visible/invisible charge ratio) do change slowly, as already described before.

Claim 14 is claiming a control unit of an ion trapping mass spectrometer comprising an ion storage unit, which is executing the inventive methods of the claims 1, 2 and 5 and corresponding subclaims.

A control unit comprises at least one processor or at least one electrical circuit, which is receiving signals and/or data, e.g. image currents or mass spectra, and is providing data and/or signals, e.g. the compensation factor c or the ion injection time period $t_{opt,real}$ or signals related to these values.

claim 15 is claiming a mass spectrometer comprising an ion storage unit and an ion trapping mass analyser, which is able to execute, preferably is executing, the inventive methods.

Other aspects of the invention may be as described or embodied in one or more of the following clauses.

Clause 1. A method for determining a parameter for controlling an amount of sample ions ionised from a sample, which is injected from an ion storage unit into an ion trapping mass analyser to perform a mass analysis of the sample ions comprising the steps:

detecting at least one mass spectrum for at least one amount of the sample ions injected from the ion storage unit with the ion trapping mass analyser;

determining from the at least one detected mass spectrum the sample slope of a linear correlation of the relative m/z shift with the visible total charge $Q_v$ of mass spectra of sample ions detected with the ion trapping mass analyser; and determining a compensation factor c to adjust an ion injection time period $t_{opt,v}$ of sample ions into the ion storage unit, which is related to the optimised visible charge $Q_{ref,opt}$ of a reference sample, to perform a mass analysis of sample ions, wherein the ion injection time period $t_{opt,v}$ is determined from the visible total charge $Q_v$ evaluated from at least one mass spectrum of at least one amount of the sample ions detected with the ion trapping mass analyser and the corresponding injection time period of the sample ions, by dividing the reference slope of a linear correlation of the relative m/z shift with the visible total charge $Q_v$ of mass spectra of reference ions ionised from the reference sample, detected with the ion trapping mass analyser by the determined sample slope.

Clause 2. A method for determining a parameter for controlling an amount of sample ions ionised from a sample, which is injected from an ion storage unit into an ion trapping mass analyser to perform a mass analysis of the sample ions comprising the steps:

detecting mass spectra for different amounts of the sample ions injected from the ion storage unit with the ion trapping mass analyser;

evaluating the observable difference of a relative m/z shift from the detected mass spectra of at least two of the different amounts of the sample ions induced by a space charge of the sample ions by determination of the relative difference of m/z values of at least one species of sample ions from these detected mass spectra;

evaluating a visible total charge $Q_v$ and/or the difference of a visible total charge $Q_v$ from the detected mass spectra of the at least two of the different amounts of the sample ions;

determining, preferably calculating, from the evaluated observable differences of the relative m/z shift and the evaluated visible total charges $Q_v$ and/or the differences of the visible total charge $Q_v$ the sample slope of a linear correlation of the relative m/z shift with the visible total charge $Q_v$ of mass spectra of sample ions detected with the ion trapping mass analyser; and determining a compensation factor c to adjust an ion injection time period $t_{opt,v}$ of sample ions into the ion storage unit, which is related to the optimised visible charge $Q_{ref,opt}$ of a reference sample, to perform a mass analysis of sample ions, wherein the ion injection time period $t_{opt,v}$ is determined from the visible total charge $Q_v$ evaluated from at least one mass spectrum of at least one amount of the sample ions detected with the ion trapping mass analyser and the corresponding injection time period of the sample ions, by dividing the reference slope of a linear correlation of the relative m/z shift with the visible total charge $Q_v$ of mass spectra of reference ions ionised from the reference sample detected with the ion trapping mass analyser by the determined sample slope.

Clause 3. The method of clause 2, wherein the observable difference of the relative m/z shift is evaluated from the detected mass spectra by determination of the relative difference of m/z values of at least 3, preferably at least 100 and particular preferably at least 1,000 species of sample ions from these detected mass spectra.

Clause 4. The method of clause 2 or clause 3, wherein the observable difference of a relative m/z shift is evaluated from the detected mass spectra by determination of the relative difference of m/z values of species of sample ions from these detected mass spectra, wherein these species of sample ions have a signal-to-noise ratio in the detected mass spectra higher than 5, preferably higher than 10 and in particular preferably higher than 50.

Clause 5. A method for determining a parameter for controlling an amount of sample ions ionised from a sample, which is injected from an ion storage unit into an ion trapping mass analyser to perform a mass analysis of the sample ions, wherein the m/z ratio of at least one of the sample ions is known, comprising the steps:

detecting at least one mass spectrum for at least one amount of the sample ions injected from the ion storage unit with the ion trapping mass analyser;

evaluating the relative m/z shift from the at least one detected mass spectrum of the at least one amount of the sample ions induced by a space charge of the sample ions by determination of a relative difference of m/z values of at least one sample ion, for which the m/z ratio is known, in the at least one detected mass spectrum to its known m/z ratio;

evaluating a visible total charge $Q_v$ from the at least one detected mass spectrum of the at least one amount of the sample ions;

determining, preferably calculating, from the evaluated relative m/z shift value or values and the evaluated visible total charge or charges $Q_v$ the sample slope of a linear correlation of the relative m/z shift with the visible total charge $Q_v$ of mass spectra of sample ions detected with the ion trapping mass analyser; and determining a compensation factor c to adjust the ion injection time period $t_{opt,v}$ of sample ions into the ion storage unit, which is related to the optimised visible charge $Q_{ref,opt}$ of a reference sample, to perform a mass analysis of sample ions, wherein the ion injection time period $t_{opt,v}$ is determined from the visible total charge $Q_v$ evaluated from at least one mass spectrum of at least one amount of the sample ions detected with the ion trapping mass analyser and the corresponding injection time period of the sample ions, by dividing the reference slope of a linear correlation of the relative m/z shift with the visible total charge $Q_v$ of mass spectra of reference ions ionised from the reference sample detected with the ion trapping mass analyser by the determined sample slope.

Clause 6. The method of at any one the clauses 1 to 5, wherein the reference sample is a clean sample.

Clause 7. The method of any one of the clauses 1 to 6, wherein the ion trapping mass analyser is a Fourier transform mass analyser.

Clause 8. The method of any one of the clauses 1 to 7, wherein the compensation factor c is determined by repeated determination of compensation factor values and averaging over the time.

A method for performing a mass analysis of sample ions ionised from a sample, wherein an amount of the sample ions is injected from an ion storage unit into an ion trapping mass analyser to perform the mass analysis and the injected amount of the sample ions has been adapted by a compensation factor c determined by the method of any one of the clauses 1 to 8, wherein an optimised ion injection time period $t_{opt,real}$ is used to inject sample ions into the ion storage unit to perform a mass analysis of sample ions, which is defined by $$t_{opt,real}=ct_{opt,v}$$

Clause 10. A method for correcting the m/z values observed in a mass spectrum of sample ions ionised from a sample detected by an ion trapping mass analyser comprising the steps:

detecting mass spectra for different amounts of the sample ions injected from a ion storage unit with the ion trapping mass analyser;

evaluating the observable difference of a relative m/z shift from the detected mass spectra of at least two of the different amounts of the sample ions induced by a space charge of the sample ions by determination of the relative difference of m/z values of at least one species of sample ions from these detected mass spectra;

evaluating a visible total charge $Q_v$ and/or the difference of a visible total charge $Q_v$ from the detected mass spectra of the at least two of the different amounts of the sample ions;

determining, preferably calculating, from the evaluated observable differences of the relative m/z shift and the evaluated visible total charges $Q_v$ and/or the differences of the visible total charge $Q_v$ the sample slope of a linear correlation of the relative m/z shift with the visible total charge $Q_v$ of mass spectra of sample ions detected with the ion trapping mass analyser;

determining the relative m/z shift of the sample ions detected in the mass spectrum, in which the m/z values shall be corrected, by multiplying the visible total charge $Q_v$ trapped in the ion trapping mass analyser evaluated from the mass spectrum, in which the m/z values shall be corrected, with the determined sample slope; and correcting the m/z values in the mass spectrum, in which the m/z values shall be corrected, using its determined relative m/z shift of the sample ions.

Clause 11. A method for correcting the m/z values observed in a mass spectrum of sample ions ionised from a sample detected by an ion trapping mass analyser, wherein the m/z ratio of at least one of the sample ions is known, comprising the steps:

detecting at least one mass spectrum for at least one amount of the sample ions injected from the ion storage unit with the ion trapping mass analyser;

evaluating the relative m/z shift from at least one detected mass spectrum of the at least one amount of the sample ions induced by a space charge of the sample ions by determination of a relative difference of m/z values of at least one sample ion, for which the m/z ratio is known, in the at least one detected mass spectrum to its known m/z ratio;

evaluating a visible total charge $Q_v$ from the at least one detected mass spectrum of the at least one amount of the sample ions;

determining, preferably calculating, from the evaluated relative m/z shift value or values and the evaluated visible total charge or charges $Q_v$ the sample slope of a linear correlation of the relative m/z shift with the visible total charge $Q_v$ of mass spectra of sample ions detected with the ion trapping mass analyser;

determining the relative m/z shift of the sample ions detected in the mass spectrum, in which the m/z values shall be corrected, by multiplying the visible total charge $Q_v$ trapped in the ion trapping mass analyser evaluated from the mass spectrum, in which the m/z values shall be corrected, with the determined sample slope; and correcting the m/z values in the mass spectrum, in which the m/z values shall be corrected, using its determined relative m/z shift of the sample ions.

Clause 12. The method of any one of the clauses 1 to 11, wherein the sample slope is determined from the mass spectra detected for two pre-selected amounts of the sample ions.

Clause 13. The method of any one of the clauses 1 to 11, wherein the sample slope is determined from the mass spectra detected for the different amounts of the sample ions by using a linear fit.

Clause 14. A control unit of an ion trapping mass spectrometer comprising an ion storage unit and an ion trapping mass analyser executing the method of any one of the clauses 1 to 8 or clause 12 in reference to any one of the clauses 1 to 8 and clause 13 in reference to on any one of the clauses 1 to 8.

Clause 15. A mass spectrometer comprising a control unit, an ion storage unit and an ion trapping mass analyser, which is able to execute any one of the methods of the clauses 1 to 13, preferably executing any one of the methods of the clauses 1 to 13.

DETAILED DESCRIPTION OF PREFERRED EMBODIMENTS

Figure 1:
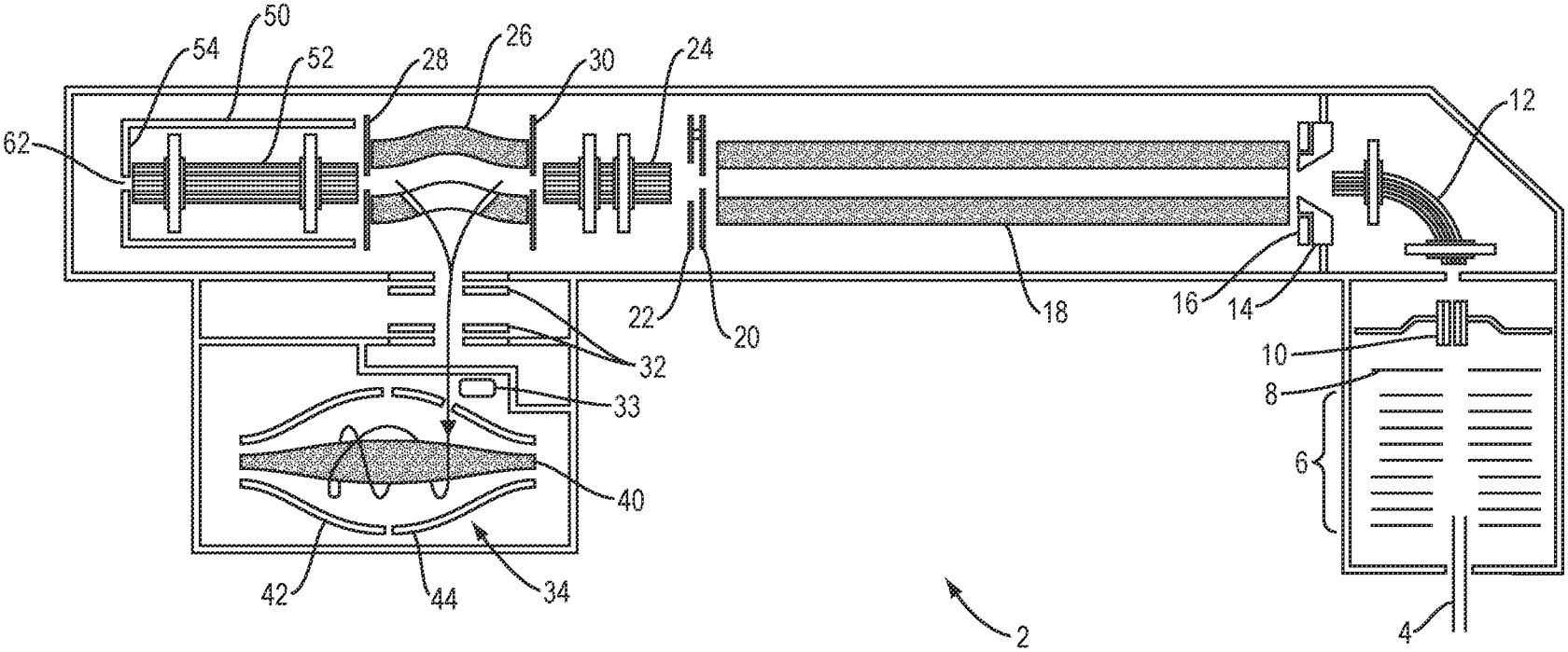
FIG. 1 shows an embodiment of a Fourier transform mass spectrometer in which the invention can be applied.

FIG. 1 shows an embodiment of a Fourier transform mass spectrometer 2 in which sample ions are generated from a sample in an ion source (not shown), which may be a conventional ion source such as an electrospray ionisation ion source. Sample ions may be generated as a continuous stream in the ion source as in an electrospray ionisation ion source, or in a pulsed manner as in a MALDI source. The sample which is ionised in the ion source may come from an interfaced instrument such as a liquid chromatograph (not shown). The ions pass through a heated capillary 4 (typically held at 320° C.), are transferred by an RF only S-lens 6 (RF amplitude 0-350 Vpp, being set mass dependent), and pass the S-lens exit lens 8 (typically held at 25V). The ions in the ion beam are next transmitted through an injection flatapole 10 and a bent flatapole 12 which are RF only devices to transmit the sample ions. The sample ions then pass through a pair of lenses (with inner lens 14 typically at about 4.5V, and outer lens 16 typically at about −100V) and enter a mass resolving quadrupole 18.

The quadrupole 18 DC offset is typically 4.5 V. The differential RF and DC voltages of the quadrupole 18 are controlled to either transmit a wide mass range of sample ions (RF only mode) or select sample ions of particular m/z for transmission by applying RF and DC according to the Mathieu stability diagram. It will be appreciated that, in other embodiments, instead of the mass resolving quadrupole 18, an RF only quadrupole or multipole may be used as an ion guide but the spectrometer would lack the capability of mass selection before analysis. In still other embodiments, an alternative mass resolving device may be employed instead of quadrupole 18, such as a linear ion trap, magnetic sector or a time-of-flight analyser. Such a mass resolving device could be used for mass selection and/or ion fragmentation. Turning back to the shown embodiment, the ion beam which is transmitted through quadrupole 18 exits from the quadrupole through a quadrupole exit lens 20 (typically held at −35 to 0V, the voltage being set mass dependent) and is switched on and off by a split lens 22. Then the ions are transferred through a transfer multipole 24 (RF only, RF amplitude being set mass dependent) and collected in an ion storage unit, a curved linear ion trap (C-trap) 26. The C-trap is elongated in an axial direction (thereby defining a trap axis) in which the sample ions enter the trap. Voltage on the C-trap exit lens 28 can be set in such a way that sample ions cannot pass and thereby get stored within the C-trap 26. Similarly, after the desired ion injection time period, which is also the ion accumulation time (or number of ion pulses e.g. with MALDI) into the C-trap has been reached, the voltage on C-trap entrance lens 30 is set such that sample ions cannot pass out of the trap and sample ions are no longer injected into the C-trap. More accurate gating of the incoming ion beam is provided by the split lens 22. The sample ions are trapped radially in the C-trap by applying RF voltage to the curved rods of the trap in a known manner.

Sample ions which are stored within the C-trap 26 can be ejected orthogonally to the axis of the trap (orthogonal ejection) by pulsing DC to the C-trap in order for the sample ions to be injected, in this case via Z-lens 32, and deflector 33 into a Fourier transform mass analyser 34, which in this case is an electrostatic orbital trap, and more specifically an Orbitrap™ FT mass analyser made by Thermo Fisher Scientific Inc. The orbital trap 34 comprises an inner electrode 40 elongated along the orbital trap axis and a split pair of outer electrodes 42, 44 which surround the inner electrode 40 and define there between a trapping volume in which ions are trapped and oscillate by orbiting around the inner electrode 40 to which is applied a trapping voltage whilst oscillating back and forth along the axis of the trap. The pair of outer electrodes 42, 44 function as detection electrodes to detect an image current induced by the oscillation of the ions in the trapping volume and thereby provide a detected signal. The outer electrodes 42, 44 thus constitute a first detector of the system. The outer electrodes 42, 44 typically function as a differential pair of detection electrodes and are coupled to respective inputs of a differential amplifier (not shown), which in turn forms part of a digital data acquisition system (not shown) to receive the detected signal. The detected signal can be processed using Fourier transformation to obtain a mass spectrum. The digital data acquisition system can be a part of or connected with a control unit of the mass spectrometer 2.

The control unit may comprise one or processors to process the detected signal using e.g. Fourier transformation and/or to generate a mass spectrum. The control unit is configured or programmed to execute at least one of the methods of the invention. The control unit may comprise an instrument interface, which is adapted to send commands to or operate the mass spectrometer. The control unit may comprise a storage unit for storing data in data sets. Connection between the control unit and the spectrometer may be established by a wire or a glass fibre or wirelessly via radio communication. Preferably, the control unit further comprises visualization means, in particular a display and/or a printer, and interaction means, in particular a keyboard and/or a mouse, so that a user can view and enter information. When the control unit comprises visualization means and interaction means, operation of the spectrometer is preferably controlled via a graphical user interface (GUI). The control unit can be realized as a standard personal computer or in a distributed form with a number of processing devices interconnected by a wired or wireless network.

The mass spectrometer 2 further comprises a collision or reaction cell 50 downstream of the C-trap 26. Sample ions collected in the C-trap 26 can be ejected orthogonally as a pulse to the mass analyser 34 without entering the collision or reaction cell 50 or the sample ions can be transmitted axially to the collision or reaction cell for processing before returning the processed sample ions to the C-trap for subsequent orthogonal ejection to the mass analyser. The C-trap exit lens 28 in that case is set to allow sample ions to enter the collision or reaction cell 50 and sample ions can be injected into the collision or reaction cell by an appropriate voltage gradient between the C-trap and the collision or reaction cell (e.g. the collision or reaction cell may be offset to negative potential for positive sample ions). The collision energy can be controlled by this voltage gradient. The collision or reaction cell 50 comprises a multipole 52 to contain the sample ions. The collision or reaction cell 50, for example, may be pressurised with a collision gas so as to enable fragmentation (collision induced dissociation) of sample ions therein, or may contain a source of reactive ions for electron transfer dissociation (ETD) of sample ions therein. The ions are prevented from leaving the collision or reaction cell 50 axially by setting an appropriate voltage to a collision cell exit lens 54. The C-trap exit lens 28 at the other end of the collision or reaction cell 50 also acts as an entrance lens to the collision or reaction cell 50 and can be set to prevent ions leaving whilst they undergo processing in the collision or reaction cell if need be. In other embodiments, the collision or reaction cell 50 may have its own separate entrance lens. After processing in the collision or reaction cell 50 the potential of the cell 50 may be offset so as to eject processed sample ions back into the C-trap (the C-trap exit lens 28 being set to allow the return of the ions to the C-trap) for storage, for example the voltage offset of the cell 50 may be lifted to eject positive charged processed sample ions back to the C-trap. The processed sample ions thus stored in the C-trap may then be injected into the mass analyser 34 as described before. For clarity, processed sample ions are sample ions, because they are in a first step ionised from the investigated sample.

It will be appreciated that the path of the ion beam of sample ions through the spectrometer and in the mass analyser is under appropriate evacuated conditions as known in the art, with different levels of vacuum appropriate for different parts of the spectrometer.

The mass spectrometer 2 is under the control of a control unit, such as an appropriately programmed computer (not shown), which controls the operation of various components and, for example, sets the voltages to be applied to the various components and which receives and processes data from various components including the detectors. The computer is configured to use an algorithm, e.g. contained in a computer program, in accordance with the present invention to determine the settings (e.g. injection time periods or number of ion pulses, amounts of ions, compensation factor c, sample slope of the linear correlation of the relative m/z shift with the visible total charge $Q_v$ in the mass spectra) for the injection of sample ions into the C-trap for analytical scans in order to achieve the desired sample ion content (i.e. number of sample ions) therein which avoids space charge effects whilst optimising the statistics of the collected data from the analytical scan. Preferably the computer is also configured to use an algorithm in accordance with the present invention to correct the m/z shift of mass spectra.

The inventive methods of the claims 1, 2 and 5 are determining a parameter for controlling the amount of sample ions, which are injected into an ion trapping mass analyser, in particular into a Fourier transform mass analyser, e.g. the Orbitrap™ FT mass analyser of the Fourier transform mass spectrometer shown in FIG. 1, for which a mass analysis shall be performed in the Fourier transform mass analyser. These sample ions are injected in a very short time period of typically 0.03 milliseconds to 300 milliseconds from the ion storage unit into the Fourier transform mass analyser. In the Fourier transform mass spectrometer shown in FIG. 1 the stored sample ions within the C-trap 26 are ejected orthogonally to the axis of the trap (orthogonal ejection) by pulsing DC to the C-trap in order for the sample ions to be injected via Z-lens 32 and deflector 33 into the Orbitrap™ FT mass analyser 34.

The amount of sample ions stored in the ion storage unit, which in the embodiment of FIG. 1 is the C-trap, is defined by the injection time period $t_{inj}$, also termed ion accumulation or fill time, in which sample ions flow into the ion storage unit, normally with a constant or nearly constant total ion current TIC (constant over time). Instead of the constant total ion current TIC sample ions can be also supplied by a number of sample ion pulses during the injection time period $t_{inj}$ into the ion storage unit.

Figure 2A:
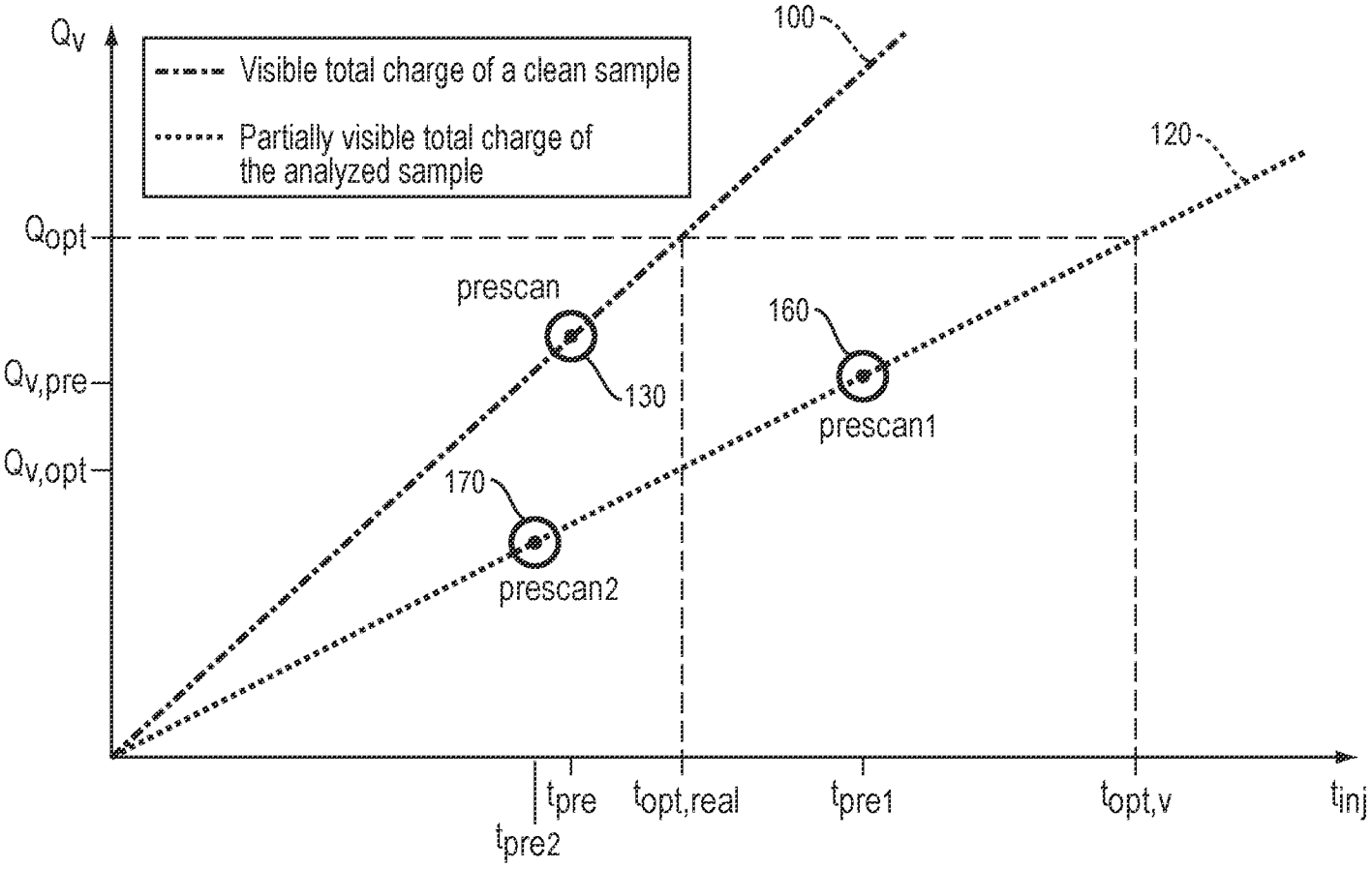
FIG. 2A shows the correlation of the visible total charge of an ion package with the injection time period of the ions into an ion storage unit for a sample which shall be analysed and a clean sample.

In FIG. 2A is shown the correlation between the visible total charge $Q_v$ of the ion package stored in the ion storage unit and the injection time period, i.e. accumulation time, $t_{inj}$ of the ions, i.e. time taken to accumulate ions in the ion storage unit. The visible total charge $Q_v$ of the ions can be derived from a mass spectrum detected by the ion trapping mass analyser to which the ion package is injected from the ion storage unit as explained before. The correlation is shown for the ion packages of two different samples injected into the ion storage unit with the same total ion current TIC, which is taking into account the real, i. e. actual, total charge of the ions $Q_{real}$. The correlation 100 shows the correlation when the real (i.e. actual) total charge $Q_{real}$ of the ion package of a clean sample is visible in a detected mass spectrum, so that $Q_v=Q_{real}$. Due to a constant total ion current TIC of ions from the ion source the correlation is provided by a linear function, a straight line. When a prescan 130 is executed as explained above with the injection time period of the prescan $t_{pre}$ and the visible charge $Q_{v,pre}$ ($=Q_{real,pre}$) is determined from the mass spectrum of the prescan 130, the optimised accumulation time $t_{opt,real}$ can be determined for an optimised total charge $Q_{opt}$ of the ion trapping mass analyser by the formula (1) described before:

$$t_{opt,real} = \frac{Q_{opt}}{Q_{v,pre}} \times t_{pre} \tag{14}$$

The second correlation 120 shows the correlation of the injection time period $t_{inj}$ and the visible total charge $Q_v$, when the real total charge $Q_{real}$ of the ion package of the sample ions of a sample, which shall be analysed, is not completely visible in a detected mass spectrum, so that $Q_v<Q_{real}$. If now the injection time period would be optimised according the formula mentioned before, the reduced amount of the visible total charge $Q_v$ would result in an increased optimised injection time period $t_{opt,v}$ which would be related to the value $Q_v=Q_{opt}$, because it is determined from the visible total charge $Q_v$ evaluated from detected mass spectra. Therefore another method is required to define an optimised accumulation time $t_{opt,real}$ when the complete total charge $Q_{real}$ of an ion package of sample ions is not visible in its detected mass spectrum.

Figure 3:
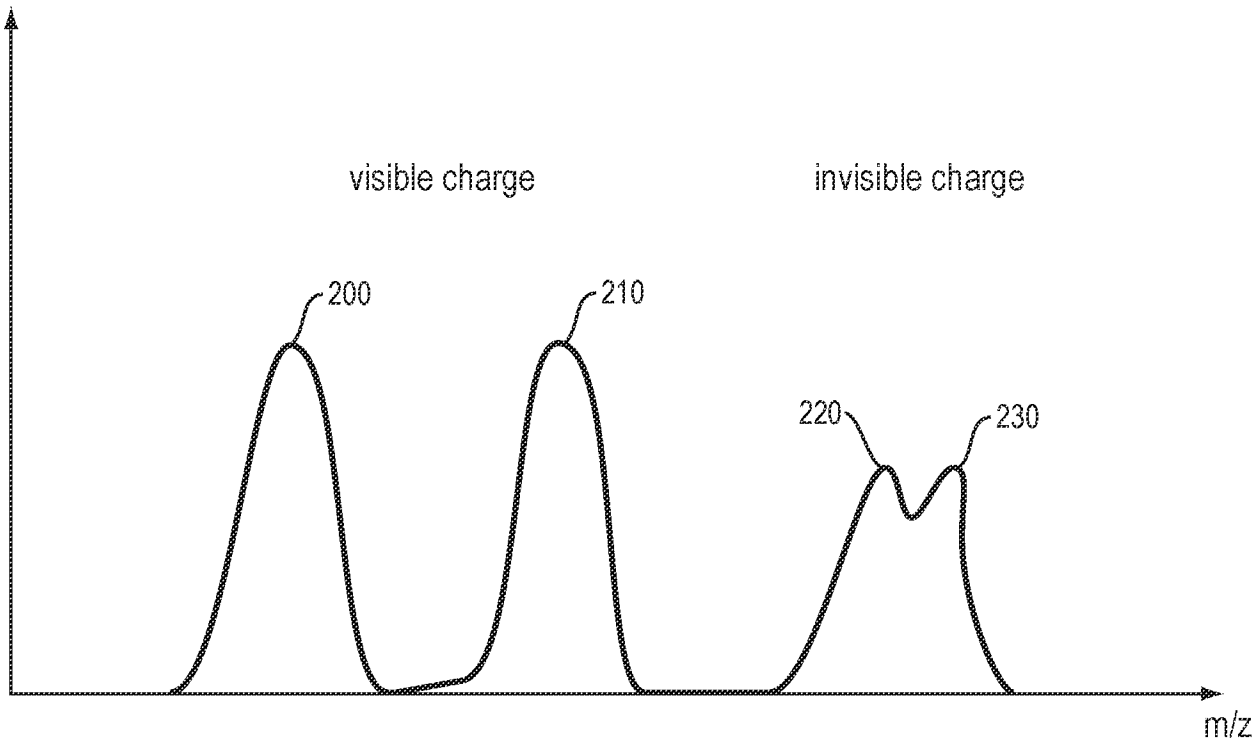
FIG. 3 shows an example of a mass spectrum with several mass peaks.
Figure 4:
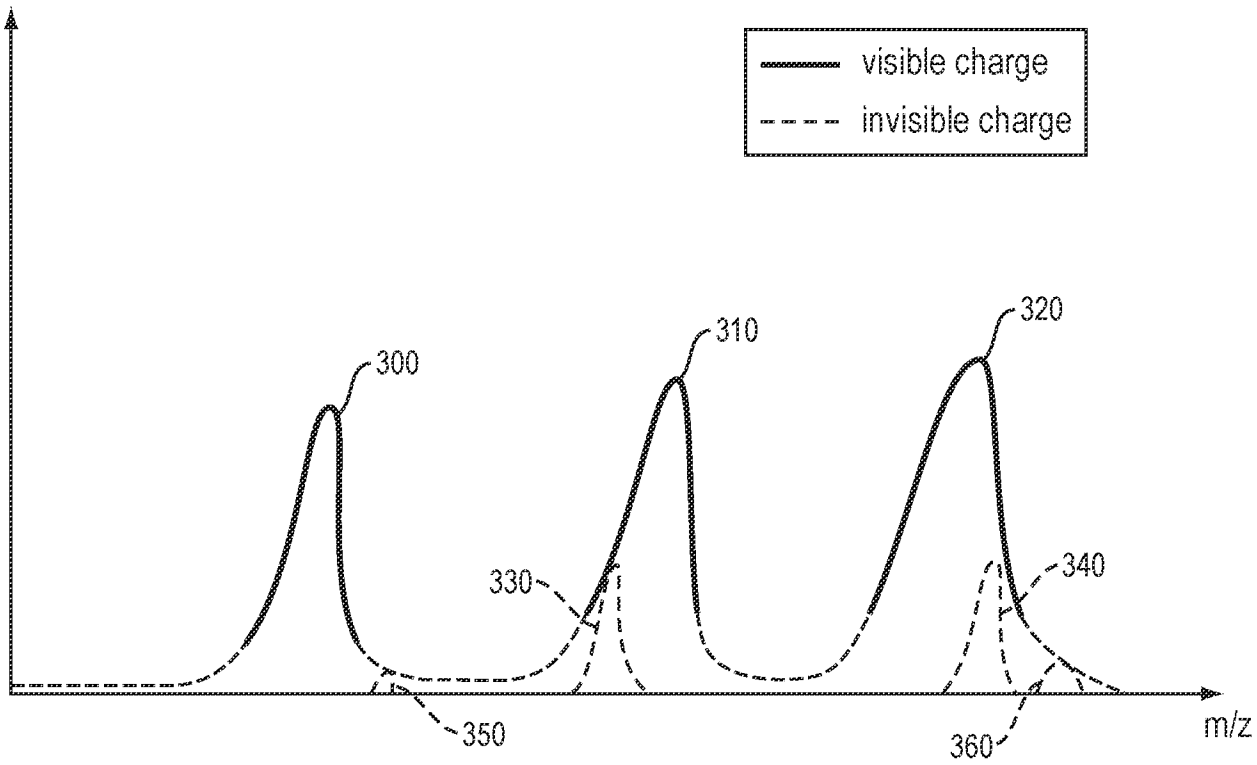
FIG. 4 shows another example of a mass spectrum with several mass peaks.

In the mass spectra shown in the FIGS. 3 and 4 it is schematically explained why sometimes the charge of sample ions is not visible in their detected mass spectrum.

In the mass spectrum of FIG. 3 are shown 4 mass peaks 200, 210, 220 and 230 of sample ions having different m/z values. The peaks 200 and 210 are separated from each other and therefore their full intensity is used to calculate the visible total charge $Q_v$ of the analysed ion package. The mass peaks 220 and 230 are interfering and therefore their separate intensity is reduced, when the peaks are convoluted. Therefore the visible total charge $Q_v$ of the sample ions of these peaks is lowered in comparison to their real charge $Q_{real}$.

In the mass spectrum of FIG. 4 are shown 3 large mass peaks 300, 310, and 320 of sample ions having a signal-to-noise ratio of a level above a threshold that they are taken into account to determine the visible total charge $Q_v$ of the mass spectrum. Other mass peaks 330 and 340 of sample ions are superposed by the larger peaks and therefore not taken into account to determine the visible total charge $Q_v$ of the investigated sample ions from the mass spectrum. Also the very small peaks 350 and 360, which are related to specific sample ions of low abundance in the ion package, are not taken into account to determine the visible charge $Q_v$ of the sample ions form the mass spectrum because their signal-to-noise ratio is too low. So the visible total charge $Q_v$ (solid line) evaluated from the mass spectrum is below the real total charge $Q_{real}$ of the investigated ion package of the sample ions, because there are invisible charges shown by the dashed line.

To solve the problem to determine the optimised injection time period $t_{opt,real}$, when not all charges are visible in a mass spectrum, the invention uses the effect that the relative m/z shift of the mass peaks in a mass spectrum induced by the space charge of the ion package of sample ions is related to the real total charge $Q_{real}$ of an ion package of the sample ions, wherein the relative m/z shift of the mass peaks is proportional to the real total charge $Q_{real}$.

$$\frac{\Delta m/z}{m/z} \propto Q_{real} \tag{15}$$

Figure 5A:
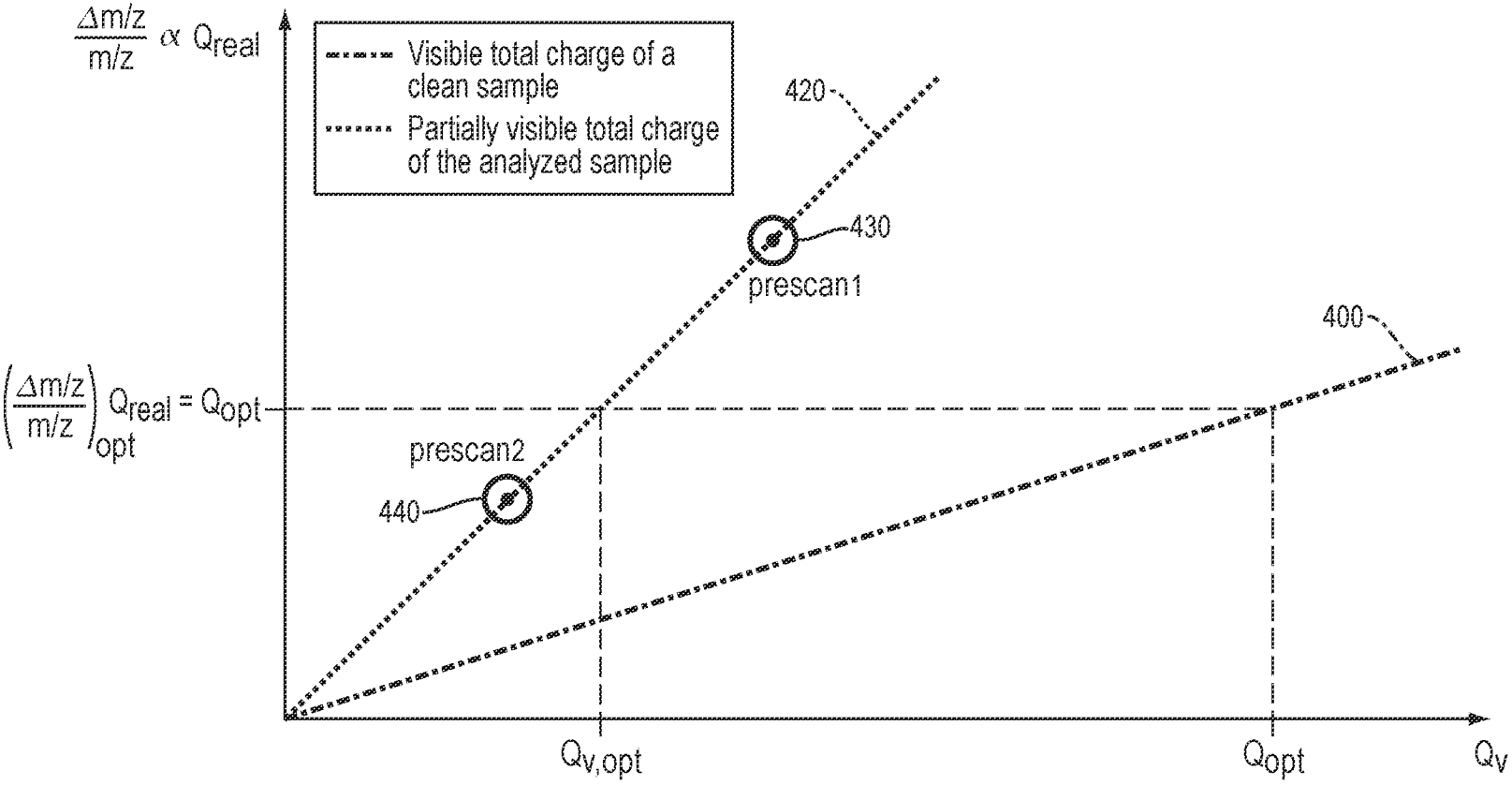
FIG. 5A shows the correlation of the relative m/z shift in a mass spectrum of an ion package with the visible total charge of an ion package for a sample which shall be analysed and a clean sample.

In FIG. 5A is shown the correlation of the relative m/z shift of the mass peaks of a mass spectrum of an ion package detected with an ion trapping mass analyser with the visible total charge $Q_v$ of the ion package derived from its detected mass spectrum.

The first correlation 400 shows the correlation of the relative m/z shift of the mass peaks with the visible total charge $Q_v$ of mass spectra of a clean sample, when the real total charge $Q_{real}$ of the ion package of clean sample ions is visible in a detected mass spectrum. This correlation 400 is provided by a linear function, a straight line. The slope of this function, the clean sample slope is a standard value, which is only related to the type of the particular used ion trapping mass analyser and defined by the geometry and the electromagnetic fields of the specific mass analyser type. In FIG. 5A is also shown optimised total charge $Q_{opt}$ of the ion trapping mass analyser on the horizontal axis showing the visible total charge $Q_v$. Therefore it can be deduced from the first correlation 400 the relative m/z shift of a mass spectrum, when an ion package of the optimised total charge $Q_{opt}$ is analysed in the ion trapping mass analyser, the relative m/z shift at the optimised total charge $Q_{opt}$, having the value:

$$\left(\frac{\Delta m/z}{m/z}\right)_{opt} \tag{16}$$

The second correlation 420 shows the correlation of the relative m/z shift of the mass peaks with the visible total charge $Q_v$ of a sample, which shall be analysed, when the total charge $Q_{real}$ of the ion package of the sample ions is only partially visible in a detected mass spectrum. Also, this correlation 420 is assumed by a linear function, a straight line. But the function has a greater slope, because the visible total charge $Q_v$ of the sample ions which can be derived from a mass spectrum is reduced.

It should be emphasised that the values of the relative m/z values and visible total charge $Q_v$ observed for specific measured mass spectra may deviate from this linear correlation due to measurement errors and higher-order physical effects. This has to be taken into account when the sample slope of the linear correlation of the relative m/z shift with the visible total charge $Q_v$ of the sample is determined. Therefore it is advantageous to use at least three different amounts of sample ions, preferably to use more than five different amounts of sample ions and particular preferably to use more than 10 different amounts of sample ions to determine from their mass spectra the sample slope of the linear correlation. In preferred embodiments then the sample slope is determined by using a linear fit or averaging method, as described in detail before. The sample slope can be determined e.g. by averaging the ratio of the relative m/z shift to the visible total charge $Q_v$ of the different amounts of sample ions, when the m/z ratio of at least one of the sample ions is known in a method of claim 5, or the ratio of the difference of the relative m/z shift and the difference of the visible total charge $Q_v$ of different pairs of the different amounts of sample ions, when the m/z ratio of at least one of the sample ions is known in a method of claim 5. The sample slope can be determined in a method of claim 2 e.g. by averaging the ratio of the observable difference of the relative m/z shift to the difference of the visible total charge $Q_v$ determined from detected mass spectra of different pairs of the different amounts of sample ions.

For the relative m/z shift at the optimised total charge $Q_{opt}$ $$\left(\frac{\Delta m/z}{m/z}\right)_{opt} \tag{17}$$

the visible total charge $Q_{v,opt}$ can be determined. When this visible total charge $Q_{v,opt}$ is derived from a mass spectrum of the sample ions, described by the correlation 420, the investigated ion package of the sample ions is actually comprising the optimised real total charge $Q_{opt}$.

Therefore, when the real total charge $Q_{real}$ of the ion package of sample ions is only partially visible in a detected mass spectrum, the accumulation time $t_{opt,real}$ to detect the ion package of the optimised total charge $Q_{opt}$, which is accordingly related to the optimised visible charge of the clean sample $Q_{clean,opt}=Q_{opt}$, can be derived from the total ion current of the visible charge $TIC_v$ shown by the second correlation 120 in FIG. 2A:

$$TIC_v = \frac{Q_{opt}}{t_{opt,v}} = \frac{Q_{v,opt}}{t_{opt,real}} \tag{18}$$

So the optimised ion injection time period, which is the optimised accumulation time, $t_{opt,real}$ of sample ions, whose real total charge $Q_{real}$ of the ion package of sample ions is only partially visible in a detected mass spectrum, is correlated with the ion injection time period $t_{opt,v}$ of the sample ions into the ion storage unit to perform a mass analysis of sample ions, when the visible total charge $Q_v$ of the sample ions has the value of the optimised real total charge $Q_{opt}$, determined from the visible total charge $Q_v$ in the detected mass spectra of the sample ions:

$$t_{opt,real} = \frac{Q_{v,opt}}{Q_{opt}} t_{opt,v} \tag{19}$$

The ratio $Q_{v,opt}/Q_{opt}$ can be derived from the correlations in FIG. 5A taking into account the clean slope s(clean) of the correlation 400 of a clean sample and the sample slope s(sample) of the correlation 420 of the sample, for which the real total charge $Q_{real}$ of the ion package of sample ions is only partially visible in a detected mass spectrum.

$$\frac{Q_{v,opt}}{Q_{opt}} = \frac{s(\text{clean})}{s(\text{sample})} \tag{20}$$

The inventive method is now using this correlation and is determining the correlation factor c:

$$c = \frac{Q_{v,opt}}{Q_{opt}} = \frac{s(\text{clean})}{s(\text{sample})} \tag{21}$$

So the correlation factor c is determined by dividing the clean slope s(clean) of the linear correlation of the relative m/z shift with the visible total charge $Q_v$ of mass spectra of the clean sample detected with the ion trapping mass analyser by the sample slope s(sample) of the linear correlation of the relative m/z shift with the visible total charge $Q_v$ of mass spectra of the sample detected with the ion trapping mass analyser.

Then the optimised accumulation time $t_{opt,real}$ of sample ions, whose real total charge $Q_{real}$ of their ion package of ions is only partially visible in a detected mass spectrum, is correlated with the ion injection time period $t_{opt,v}$ of sample ions in the ion storage unit determined from their visible total charge $Q_v$, as described above:

$$t_{opt,real} = c t_{opt,v} \tag{22}$$

The clean slope s(clean) of the correlation 400 of a clean sample is a standard value, which is only related to the type of used ion trapping mass analyser. The clean slope s(clean) is the standard ratio of the type of used ion trapping mass analyser of the relative m/z shift to the visible total charge $Q_{v,cl}$ of a mass spectrum of clean sample ions and of the difference of the relative m/z shift to the difference of the visible total charge $Q_{v,cl}$ of two mass spectra of two amounts of clean sample ions trapped in the ion trapping mass analyser and can be determined by a calibration process of the ion trapping transform mass analyser. These values can be determined directly from the mass spectra detected during the calibration process, when at least for one of the clean sample ions the m/z ratio is known. Then the clean slope is determined in the same way as the sample slope in the method of the claim 5. It can be sufficient to determine by the calibration process the slope of the type of used ion trapping mass analyser by executing the calibration process only for one or a few instruments. Preferably the standard value of the slope of the type of used ion trapping mass analyser is determined by averaging the clean slope s(clean) of the linear correlation of the relative m/z shift with the visible total charge $Q_{v,cl}$ of the mass spectra of clean sample ions determined for a few instruments. As usual the clean slope s(clean) can be determined from test measurements (pre-experiments) of clean samples defining the correlation 400. In particular the clean slope s(clean) can be determined using a linear fit, which is applied to the correlation 400 defined by the test measurements (pre-experiments). The clean slope s(clean) of the ion trapping mass analyser can be also provided by a theoretical approach describing the m/z shift in the ion trapping mass analyser and its dependency on the total charge $Q_{real}$ of an investigated ion package of the clean sample ions.

If no sample ion of the clean sample has a known m/z value, if would be also possible to determine the clean slope of the clean sample according to the approach of the method of claim 2 to determine a sample slope. Then mass spectra of different amounts of clean sample ions have to be detected and from these mass spectra the observable difference of a relative m/z shift has to be evaluated from the detected mass spectra of at least two of the different amounts of the clean sample ions by determination of the relative difference of m/z values of at least one species of clean sample ions from these detected mass spectra. Additional the visible total charge $Q_v$ and/or the difference of a visible total charge $Q_v$ has to be evaluated from the detected mass spectra of the at least two of the different amounts of the clean sample ions. Then the clean slope can be determined from the evaluated observable difference of the relative m/z shift and the evaluated values of the visible total charge $Q_v$ and/or the difference of a visible total charge $Q_v$ as explained in detail before for the determination of the sample slope. Because many different samples are known as clean samples and accordingly for at least of their sample ions its m/z ratio is known, this approach to determine the clean slope is only sometimes used.

The sample slope s(sample) of the correlation 420 of the sample, for which real total charge $Q_{real}$ of the ion package of sample ions is only partially visible in a detected mass spectrum, can be determined by prescans of different amounts of the investigated sample ions in the ion trapping mass analyser.

In FIG. 5A the sample slope s(sample) is determined by two pre-experiments prescan1, and prescan2, in which for two different amounts of sample ions a mass spectrum is detected in the ion trapping mass analyser. The ion injection time period of the investigated sample ions in the ion storage unit of these prescans is shown in FIG. 2A. The prescan1 is shown by the circle 160 having an ion injection time period $t_{pre1}$ and the prescan2 is shown by the circle 170 having an ion injection time period $t_{pre2}$. The parameters of prescan1 are shown in FIG. 5A by the circle 430 and the parameters of prescan2 are shown in FIG. 5A by the circle 440.

In this embodiment the sample slope s(sample) is evaluated by the steps:

- Evaluation of the observable difference of a relative m/z shift from the detected mass spectra of prescan1 and prescan2 by determination of the relative difference of m/z values of at least one species of samples ions from the mass spectra of prescan1 and prescan2
- Evaluation the difference of a visible total charge $Q_v$ from the detected mass spectra of prescan1 and prescan2 of the amounts of sample ions trapped in the ion trapping mass analyser
- Determination of the sample slope s(sample) by calculating the ratio of the evaluated observable difference of the relative m/z shift of the mass spectra of prescan1 and prescan2 and the evaluated difference of the visible total charge $Q_v$ of the mass spectra of prescan1 and prescan2.

This approach to determine the sample slope and is used in the inventive method of claim 2 and can be used in the inventive method of claim 1 for determining a parameter for controlling the amount of sample ions injected from an ion storage unit into a ion trapping mass analyser to perform a mass analysis of sample ions, which enables a mass analysis with ion packages of samples ions of the optimised total charge $Q_{opt}$, when the real total charge $Q_{real}$ of an ion package of sample ions is not visible in and/or derivable from a detected mass spectrum. The method relies only on the measurements of mass spectra with the ion trapping mass analyser and the AGC approach to derive the visible total charge $Q_v$ from the detected mass spectra. Other charge detection is not required in the ion trapping mass spectrometer.

Figure 2B:
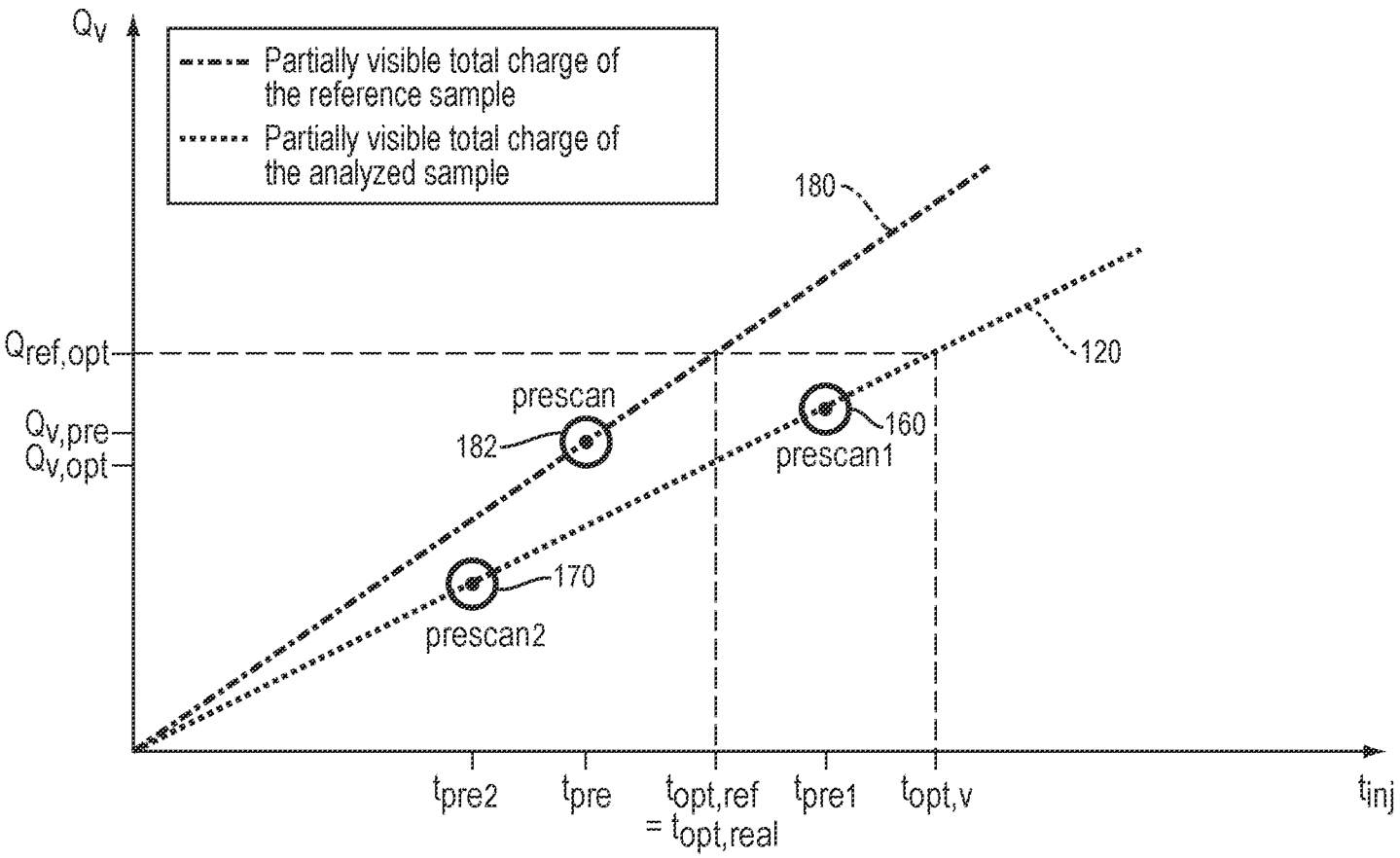
FIG. 2B shows the correlation of the visible total charge of an ion package with the injection time period of the ions into an ion storage unit for a sample which shall be analysed and a reference sample.

In FIG. 2B is shown the correlation between the visible total charge $Q_v$ of the ion package stored in the ion storage unit and the injection, i.e. accumulation, time $t_{inj}$ of the ions, i.e. time taken to accumulate ions in the ion storage unit. The visible total charge $Q_v$ can be derived from a mass spectrum detected by the ion trapping mass analyser to which the ion package is injected from the ion storage unit as explained before. The correlation is shown for the ion packages of two different samples injected into the ion storage unit with the same total ion current TIC, which is taking into account the real total charge of the ions $Q_{real}$. The correlation 180 shows the correlation when the complete real total charge $Q_{real}$ of the ion package of reference ions of a reference sample is only partially visible as visible total charge $Q_{v,ref}$ in a detected mass spectrum, so that $Q_{v,ref}<Q_{real}$. Due to a constant total ion current TIC of reference ions from the ion source the correlation is provided by a linear function, a straight line. When a prescan 182 is executed as explained above with the injection time period of the prescan $t_{pre}$ and the visible charge $Q_{v,pre}$ determined from the mass spectrum of the prescan 182, the optimised accumulation time $t_{opt,ref}$ of reference ions can be determined for an optimised total charge $Q_{ref,opt}$ of the reference ions of the ion trapping mass analyser by the formula already described before:

$$t_{opt,real} = t_{opt,ref} = \frac{Q_{ref,opt}}{Q_{v,pre}} t_{pre} \tag{23}$$

The second correlation 120 shows the correlation of the injection time period $t_{inj}$ and the visible total charge $Q_v$, when the real total charge $Q_{real}$ of the ion package of sample ions of a sample, which shall be analysed, is not completely visible in a detected mass spectrum, so that $Q_v<Q_{real}$. Further the visible total charge $Q_v$ of the sample ions, which shall be analysed, is smaller than visible total charge $Q_{v,ref}$ of the reference ions, so that $Q_v<Q_{v,ref}<Q_{real}$. If now the injection time period would be optimised according the formula mentioned before, the reduced amount of the visible total charge $Q_v$ would result in an increased injection time period $t_{opt,v}$, which is related to the optimised visible charge $Q_{opt,ref}$ of the reference sample, because it is determined from the visible total charge $Q_v$ evaluated from detected mass spectra of sample ions. Therefore another method is required to define an optimised accumulation time $t_{opt,real}$ when the visible total charge $Q_{v,ref}$ of an ion package of a reference sample is not completely visible in detected mass spectrum of a sample, which shall be investigated.

It should be noted, that it is also possible, that the visible total charge $Q_v$ of the sample ions can be larger than the visible total charge $Q_{v,ref}$ of the reference ions.

To solve the problem to determine the optimised injection time period $t_{opt,real}$, when not all charges are visible in a mass spectrum, the invention uses the effect that the relative m/z shift of the mass peaks in a mass spectrum induced by the space charge of the ion package is related to the real charge $Q_{real}$ of an ion package, wherein the relative m/z shift of the mass peaks is proportional to the real charge $Q_{real}$.

$$\frac{\Delta m/z}{m/z} \propto Q_{real} \tag{24}$$

Figure 5B:
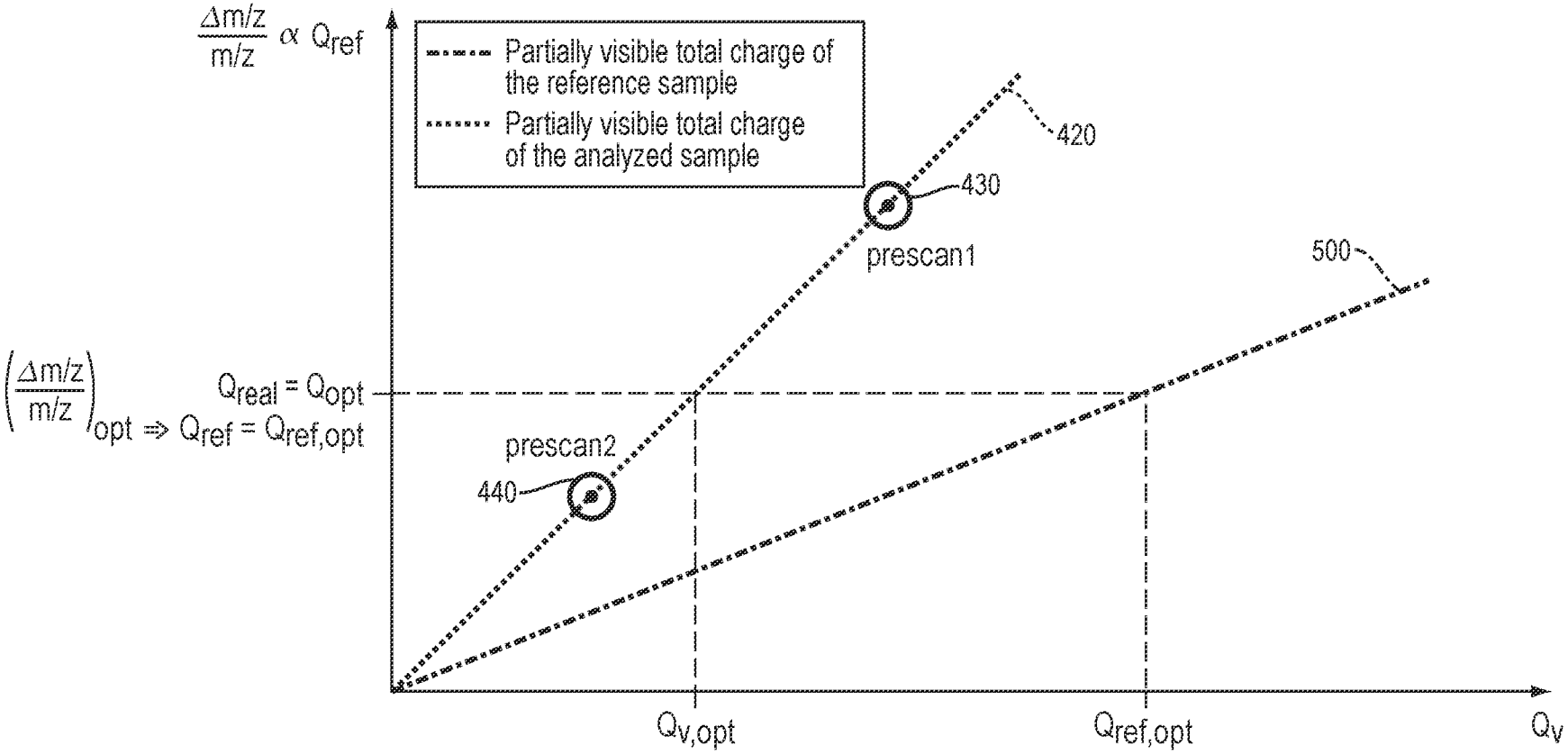
FIG. 5B shows the correlation of the relative m/z shift in a mass spectrum of an ion package with the visible total charge of an ion package for a sample which shall be analysed and a reference sample.

In FIG. 5B is shown the correlation of the relative m/z shift of the mass peaks of a mass spectrum of an ion package detected with an ion trapping mass analyser with the visible total charge $Q_v$ of the ion package derived from its detected mass spectrum.

The first correlation 500 shows the correlation of the relative m/z shift of the mass peaks with the visible total charge $Q_v$ of reference ions of a reference sample, when the real total charge $Q_{real}$ of the ion package is only partially visible in a detected mass spectrum as visible total charge $Q_{v,ref}$. This correlation 500 is provided by a linear function, a straight line. The slope of this function, the reference slope, is a standard value, which is only related to the reference sample and to the type of the particular ion trapping mass analyser being used and defined by the geometry and the electromagnetic fields of the specific mass analyser type. In FIG. 5B is also shown optimised visible total charge $Q_{ref,opt}$ of the reference sample of the ion trapping mass analyser on the horizontal axis showing the visible total charge $Q_v$. Therefore it can be deduced from the first correlation 500 the relative m/z shift of a mass spectrum, when an ion package of reference ions of the optimised visible total charge $Q_{ref,opt}$ of the reference ions is analysed in the ion trapping mass analyser having the optimised real total charge $Q_{opt}$, which has to be also the relative m/z shift of the real optimised total charge $Q_{opt}$ of the ion package of reference ions. This relative m/z shift of the mass spectrum of the ion package of the optimised total charge $Q_{opt}$ is having the value:

$$\left(\frac{\Delta m/z}{m/z}\right)_{opt} \tag{25}$$

The second correlation 420 shows the correlation of the relative m/z shift of the mass peaks with the visible total charge $Q_v$ of sample ions of a sample, which shall be analysed, when the real total charge $Q_{real}$ of the ion package of the sample ions is only partially visible in a detected mass spectrum. Also, this correlation 420 is provided by a linear function, a straight line. But the function has a greater slope compared to the reference sample, because the visible total charge $Q_v$ of the sample ions which can be derived from a mass spectrum is reduced compared to the reference sample.

It should be emphasised again that the values of the relative m/z values and visible charge observed for specific measured mass spectra may deviate from this linear correlation due to measurement errors and higher-order physical effects. This has to be taken into account when the sample slope of the linear correlation of the relative m/z shift with the visible total charge $Q_v$ of mass spectra of the sample ions detected with the ion trapping mass analyser is determined as explained in detail before.

For the relative m/z shift at the optimised total charge $Q_{opt}$ $$\left(\frac{\Delta m/z}{m/z}\right)_{opt} \tag{26}$$

can be determined the visible total charge $Q_{v,opt}$. When this visible total charge $Q_{v,opt}$ is derived from a mass spectrum of the sample ions detected with the ion trapping mass analyser, described by the correlation 420, the investigated ion package of the sample ions is actually comprising the optimised total charge $Q_{opt}$.

Therefore, when the real total charge $Q_{real}$ of the ion package of sample ions is only partially visible in a detected mass spectrum, the optimised accumulation time $t_{opt,real}$ to detect the ion package of sample ions of the optimised total charge $Q_{opt,ref}$ can be derived from the total ion current of the visible charge $TIC_v$ shown by the second correlation 120 in FIG. 2B:

$$TIC_v = \frac{Q_{ref,opt}}{t_{opt,v}} = \frac{Q_{v,opt}}{t_{opt,real}} \tag{27}$$

So the optimised accumulation time $t_{opt,real}$ of a sample ions, whose real total charge $Q_{real}$ of the ion package of sample ions is only partially visible in a detected mass spectrum, is correlated with the ion injection time period $t_{opt,v}$ of sample ions in the ion storage unit to perform a mass analysis of ions, which is related to the optimised visible total charge $Q_{ref,opt}$ of the reference sample, determined from the visible total charge $Q_v$ in the detected mass spectra of the sample ions:

$$t_{opt,real} = \frac{Q_{v,opt}}{Q_{ref,opt}} t_{opt,v} \tag{28}$$

The ratio $Q_{v,opt}/Q_{ref,opt}$ can be derived from the correlations in FIG. 5B taking into account the reference slope s(reference) of the correlation 500 of an reference sample and the sample slope s(sample) of the correlation 420 of the sample, for which the real total charge $Q_{real}$ of the ion package of sample ions is only partially visible in a detected mass spectrum.

$$\frac{Q_{v,opt}}{Q_{ref,opt}} = \frac{s(\text{reference})}{s(\text{sample})} \tag{29}$$

The inventive method of the claims 1, 2 and 5 is now using this correlation and is determining the correlation factor c:

$$C = \frac{Q_{v,opt}}{Q_{ref,opt}} = \frac{s(\text{reference})}{s(\text{sample})} \tag{30}$$

So the correlation factor c is determined by dividing the reference slope s(reference) of the linear correlation of the relative m/z shift with the visible total charge $Q_v$ of mass spectra of the reference ions detected with the ion trapping mass analyser by the sample slope s(sample) of the linear correlation of the relative m/z shift with the visible total charge $Q_v$ of mass spectra of sample ions detected with the ion trapping mass analyser.

Then the optimised accumulation time $t_{opt,real}$ of sample ions, whose total charge $Q_{real}$ of the ion package of sample ions is only partially visible in a detected mass spectrum, is correlated with the ion injection time period $t_{opt,v}$ of sample ions in the ion storage unit, which is related to the optimised visible charge $Q_{ref,opt}$ of a reference sample and determined from the visible total charge $Q_v$ of the sample ions, as described above:

$$t_{opt,real} = ct_{opt,v} \tag{31}$$

The reference slope s(reference) of the correlation 500 of the reference sample is a standard value, which is only related to the reference sample and to the type of used ion trapping mass analyser. The reference slope s(reference) is the standard ratio of the type of used ion trapping mass analyser of the relative m/z shift to the visible total charge $Q_{v,cl}$ of a mass spectrum of the reference ions and of the difference of the relative m/z shift to the difference of the visible total charge $Q_{v,ref}$ of two amounts of reference ions trapped in the ion trapping mass analyser and can be determined by a calibration process of the ion trapping transform mass analyser. These values can be determined directly from the mass spectra detected during the calibration process, when at least for one of the reference ions the m/z ratio is known. Then the reference slope is determined in the same way as the sample slope in the method of the claim 5.

It can be sufficient to determine by the calibration process the reference slope of the type of used ion trapping mass analyser regarding the reference sample by executing the calibration process only for one or a few instruments. Preferably the standard value of the reference slope of the type of used ion trapping mass analyser is determined by averaging the reference slope s(reference) of the linear correlation of the relative m/z shift with the visible total charge $Q_v$ of the mass spectra of reference ions determined for the few instruments. As usual the reference slope s(reference) can be determined from test measurements (pre-experiments) of the reference sample defining the correlation 500. In particular the reference slope s(reference) can be determined using a linear fit, which is applied to the correlation 500 defined by the test measurements (pre-experiments).

If no reference ion of the reference sample has a known m/z value, if would be also possible to determine the reference slope of the reference sample according to the approach of the method of claim 2 to determine a sample slope. Then mass spectra of different amounts of reference ions have to be detected and from these mass spectra the observable difference of a relative m/z shift has to be evaluated from the detected mass spectra of at least two of the different amounts of the reference ions by determination of the relative difference of m/z values of at least one species of reference ions from these detected mass spectra. Additional the visible total charge $Q_v$ and/or the difference of a visible total charge $Q_v$ has to be evaluated from the detected mass spectra of the at least two of the different amounts of the reference ions. Then the reference slope can be determined from the evaluated observable difference of the relative m/z shift and the evaluated values of the visible total charge $Q_v$ and/or the difference of a visible total charge $Q_v$ as explained in detail before for the determination of the sample slope. The sample slope s(sample) of the correlation 420 of the sample, for which the real total charge $Q_{real}$ of the ion package of sample ions is only partially visible in a detected mass spectrum, can be determined by prescans of different amounts of the investigated sample ions in the ion trapping transform mass analyser.

In FIG. 5B the sample slope s(sample) is determined by two pre-experiments prescan1 and prescan2, in which for two different amounts of sample ions a mass spectrum is detected in the ion trapping mass analyser. The ion injection time period of the investigated sample ions in the ion storage unit of these prescans is shown in FIG. 2B. The prescan1 is shown by the circle 160 having an ion injection time period $t_{pre1}$ and the prescan2 is shown by the circle 170 having an ion injection time period $t_{pre2}$. The parameters of prescan1 are shown in FIG. 5B by the circle 430 and the parameters of prescan2 are shown in FIG. 5B by the circle 440.

In this embodiment the sample slope s(sample) is evaluated by the steps:

- Evaluation of the observable difference of a relative m/z shift from the detected mass spectra of of prescan1 and prescan2 by determination of the relative difference of m/z values of at least one species of sample ions from the mass spectra of prescan1 and prescan2
- Evaluation the difference of a visible total charge $Q_v$ from the detected mass spectra of prescan1 and prescan2 of the amounts of sample ions trapped in the ion trapping mass analyser
- Determination of the sample slope s(sample) by calculating the ratio of the evaluated observable difference of the relative m/z shift of the mass spectra of prescan1 and prescan2 to the evaluated difference of the visible total charge of the mass spectra of prescan1 and prescan2.

This approach is used in the inventive method of claim 2 and can be used in the inventive method of claim 1 for determining a parameter for controlling the amount of sample ions injected from an ion storage unit into a ion trapping mass analyser to perform a mass analysis of sample ions, which enables a mass analysis with ion packages of sample ions of the optimised total charge $Q_{opt}$, when the real total charge $Q_{real}$ of an ion package of the sample ions is not visible in and/or derivable from a detected mass spectrum. The method relies only on the measurements of mass spectra with the ion trapping mass analyser and the AGC approach to derive the visible total charge $Q_v$ from the detected mass spectra. Other charge detection is not required in the ion trapping mass spectrometer.

Figure 6:
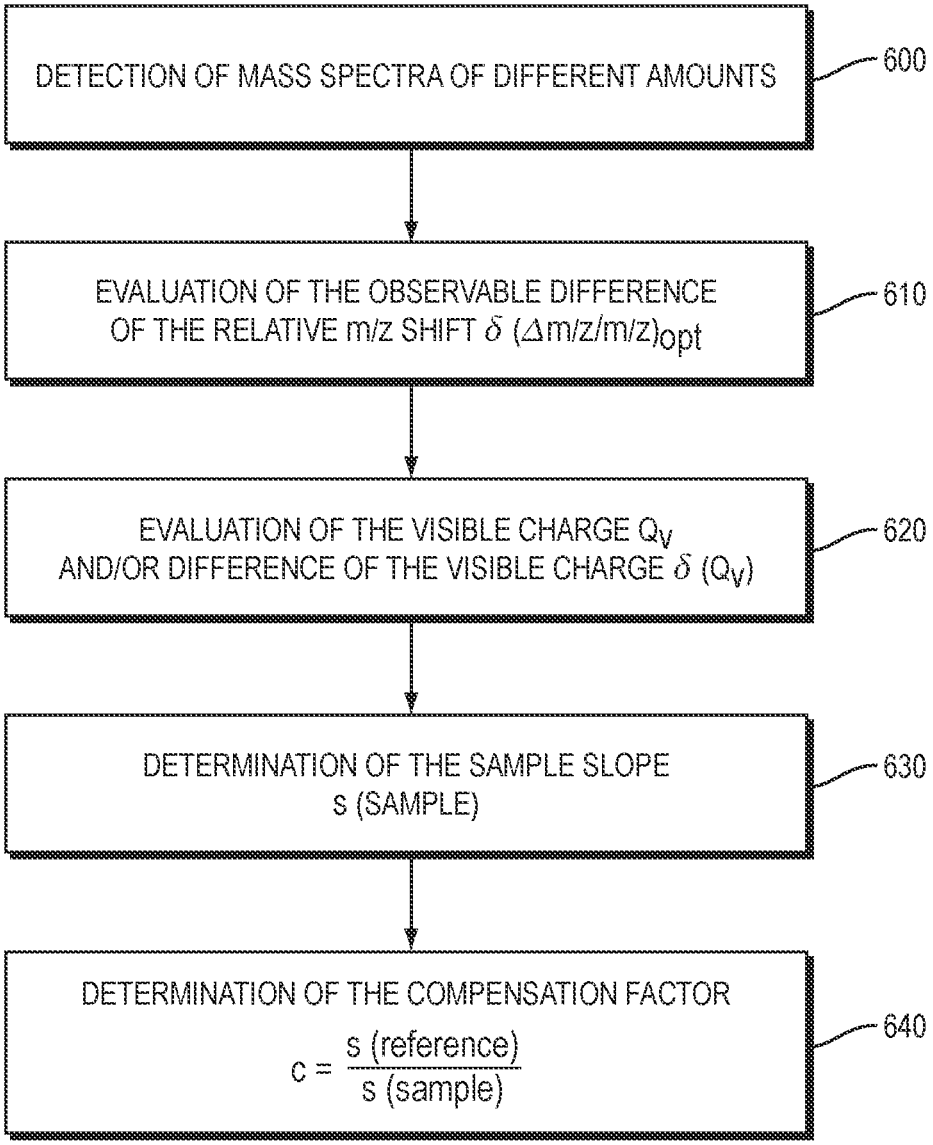
FIG. 6 shows the flow chart of the inventive method of claim 2 for determining a parameter for controlling the amount of sample ions injected from an ion storage unit into an ion trapping mass analyser.

The steps of the inventive method of claim 2 for determining a parameter for controlling the amount of sample ions injected from an ion storage unit into an ion trapping mass analyser to perform a mass analysis of sample ions are shown in FIG. 6. These steps can be also executed in the inventive method of claim 1.

In the first step 600 mass spectra are detected by the ion trapping mass analyser for different amounts of the sample ions. The different amounts of the sample ions are injected from the ion storage unit into the ion trapping mass analyser. It may be sufficient to detect the mass spectra of two different amounts of sample ions. But also a larger number of mass spectra of different amounts of sample ions can be detected.

In a following step 610 the mass spectra of the different amounts of the sample ions are compared to evaluate the observable difference of a relative m/z shift from the mass spectra.

In two mass spectra, for which the observable difference shall be evaluated, For at least one species of sample ions a peak is identified which is assigned to the species of sample ions and then is determined the relative difference of the m/z values of the identified peaks, which is the relative difference of the m/z values of the species of sample ions. The relative difference of m/z values of the at least one species of the ions can be also evaluated using a large number of species of sample ions observed in the mass spectra of the different amounts of the sample ions. Therefore lists of mass peaks observed in the two mass spectra can be compared and similar peak structures can be identified e.g. by having similar peak distances (difference of their m/z ratios) and/or intensity ratios. Then the centroids of the peaks assigned to specific species of sample ions are compared to determine the relative difference of the m/z values of the specific species of sample ions in the two mass spectra. The relative difference of the m/z values can be determined regarding the m/z values of the peaks of one of the two mass spectra or regarding the average value of both m/z values.

Based on the determined relative difference of the m/z values of the specific species of sample ions is the observable difference of a relative m/z shift of the two mass spectra evaluated:

$$\delta\left(\frac{\Delta m/z}{m/z}\right)_{ob} \tag{32}$$

The observable difference of the relative m/z shift of the two mass spectra is evaluated from the determined relative difference of the m/z values of the at least one species of ions by a method which is deriving from these determined relative differences of the at least one species of ions a typical relative difference of the m/z values. Accordingly the observable difference of the relative m/z shift of the two mass spectra is the determined typical relative difference of the m/z values.

As already described before, the observable difference of a relative m/z shift of the two mass spectra can be preferably evaluated e.g. by averaging the determined relative difference of the m/z values of the at least one species of sample ions. Accordingly the observable difference of the relative m/z shift of the two mass spectra is in this embodiment the determined average of the determined relative difference of the m/z values of the at least one species of sample ions.

Preferably the observable difference of a relative m/z shift is determined for two mass spectra as the average value of the relative difference of the m/z values of all investigated species of sample ions.

To identify peaks of the same sample ion in two mass spectra for example in an embodiment of the inventive methods of the claims 1 and 2 for each of the peaks in the list of mass peaks of one mass spectrum it is searched in the list of mass peaks of the other mass spectrum, whether there is a peak where the mass (m/z values) match within a certain tolerance range (for example 20 ppm).

To identify peaks of the same sample ion in two mass spectra in another embodiment of the inventive methods of the claims 1 and 2 for each of the peaks in the list of mass peaks of one mass spectrum it is searched in the list of mass peaks of the other mass spectrum, whether there is a peak where the intensity, the relative abundance value, (peak height) match within a certain tolerance range in a common mass range. Two mass peaks of the two mass spectra match, if the ratio of their intensities is not higher than 3, preferably not higher than 1.7 and preferably not higher than 1.3 (ratio of the higher to the lower intensity).

To identify peaks of the same sample ion in two mass spectra in a preferred embodiment of the inventive methods of the claims 1 and 2 for each of the peaks in the list of mass peaks of one mass spectrum it is searched in the list of mass peaks of the other mass spectrum, whether there is a peak where the mass (m/z values) match within a certain tolerance range (for example 20 ppm) and the intensity (peak height) match within a certain tolerance range.

The evaluation of the observable difference of a relative m/z shift from mass spectra of the different amounts of the sample ions can be executed by automated processing, which is in particular comparing the lists of mass peaks of the mass spectra.

In a preferred embodiment the observable difference of a relative m/z shift is evaluated for two detected mass spectra of different amounts of sample ions.

Figure 7:
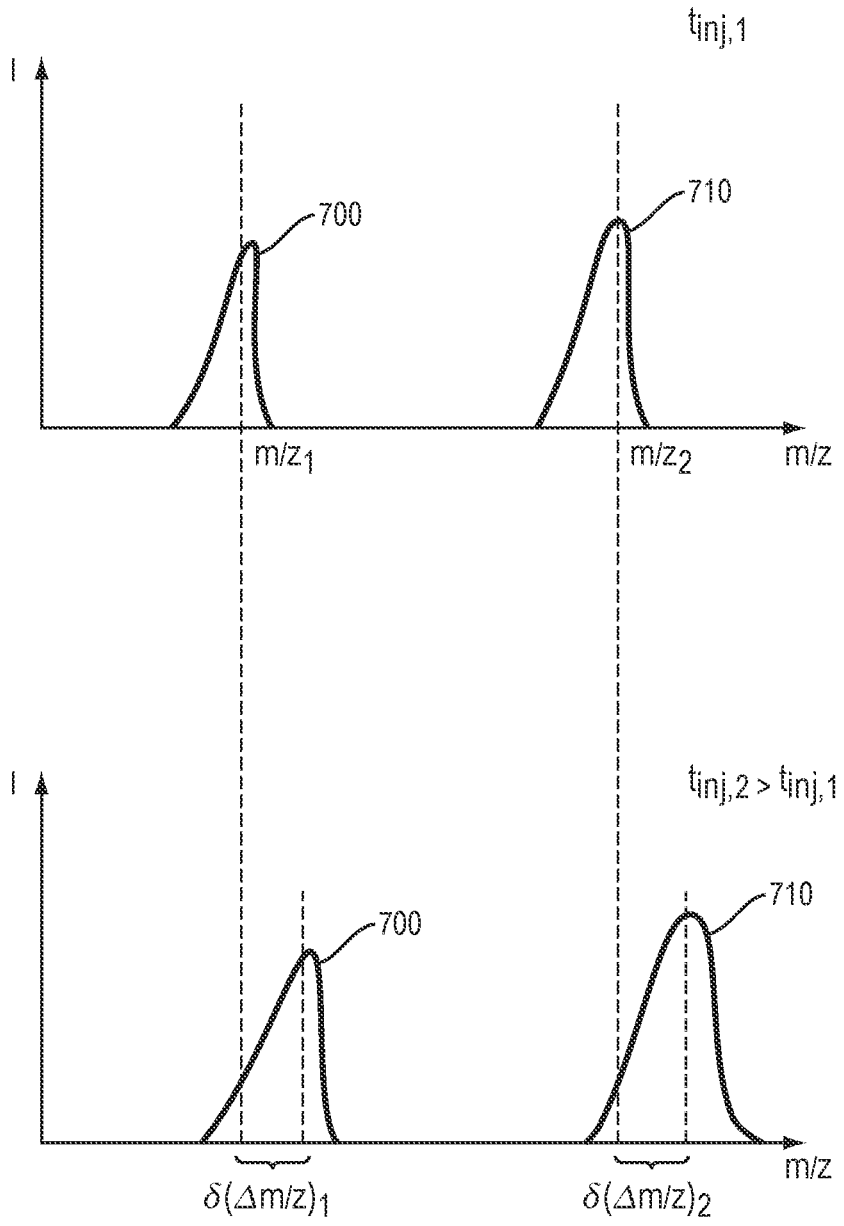
FIG. 7 shows the mass spectra of sample ions of different pre-selected amounts of sample ions.

This is shown in FIG. 7, showing schematically for illustration the mass spectra of a sample ions, wherein the sample ions of the observed ion packages are injected into the ion storage unit in two different injection time periods $t_{inj,1}$ and $t_{inj,2}$.

For the observed peaks 700 and 710 is shown the mass shift by the difference $\delta(\Delta m/z)_1$ and $\delta(\Delta m/z)_2$ of the m/z values of the peaks 700 and 701 which are determined as the m/z values of the peak centroids. The differences of the m/z values of the same sample ions are determined by comparing the mass spectra. From the difference $\delta(\Delta m/z)_1$ and $\delta(\Delta m/z)_2$ of the m/z values of the peaks 700 and 710 can deduced their relative difference, e.g. regarding their m/z value of the first mass spectrum of sample ions injected during the injection time period $t_{inj}$, resulting in the relative differences of the m/z values $\delta(\Delta m/z)_1/(m/z_1)$ of the peak 700 and $\delta(\Delta m/z)_2/(m/z_2)$ of the peak 710 and the corresponding species of sample ions. The observable difference of the relative m/z shift of the mass spectra of the sample ions is then the average of both relative differences of the m/z values of the peaks 700 and 710.

If mass spectra of more than two different amounts of sample ions have been detected, the observable difference of a relative m/z shift can evaluated for pairs of detected mass spectra of different amounts of sample ions. The observable difference of a relative m/z shift can be evaluated from different pairs of detected mass spectra by determination of the relative difference of m/z values of the same species of sample ions or different species of sample ions. It is not important to use the same species of sample ions, because the observable difference of a relative m/z shift of two mass spectra is a value which is only related to the amount of sample ions and not to specific sample ions.

In another step 620, shown in FIG. 6 as the following step, the detected mass spectra of the different amounts of the sample ions are evaluated to determine the visible total charge $Q_v$ of the different amounts of the sample ions trapped in the ion trapping mass analyser or to determine the difference of the visible total charge $Q_v$ $\delta(Q_v)$ of pairs of the different amounts of the sample ions trapped in the ion trapping mass analyser. Preferably the difference $\delta(Q_v)$ of the visible total charge $Q_v$ of two different amounts of the sample ions is determined by subtraction of the visible total charges $Q_v$ determined for each amount of the sample ions.

In a preferred embodiment, the visible total charge $Q_v$ and/or the difference $\delta(Q_v)$ of the visible total charge $Q_v$ is evaluated for the detected mass spectra of two different amounts of sample ions.

If mass spectra of more than two different amounts of ions have been detected, the visible total charge $Q_v$ can be in one embodiment of the invention evaluated for each detected mass spectrum or some of the detected mass spectra.

If mass spectra of more than two different amounts of ions have been detected, the difference $\delta(Q_v)$ of the visible total charge $Q_v$ can evaluated for pairs of two detected mass spectra of different amounts of sample ions in an embodiment of the invention.

In the next step 630, the results of the two preceding steps are used to determine the sample slope of the linear correlation of the relative m/z shift with the visible total charge $Q_v$ of mass spectra of sample ions detected with the ion trapping mass analyser. The sample slope provides for two amounts of the sample ions injected from the ion storage unit into the ion trapping mass analyser the ratio of the difference of their relative m/z shift and their difference of the visible total charge $Q_{v,pre}$ of their mass spectra detected with the ion trapping transform mass analyser. The sample slope describes how the change of the relative m/z shift in the mass spectra of the sample ions is correlated with the visible total charge $Q_v$ which can be determined from a detected mass spectrum of the sample ions.

In a preferred embodiment, in step 630 the results of the two preceding steps are used to calculate for two different amounts of the sample ions injected from the ion storage unit into the ion trapping mass analyser the ratio of their observable difference of the relative m/z shift evaluated from their detected mass spectra to their difference of the visible total charge $Q_v$ of the sample ions trapped in the ion trapping mass analyser evaluated from their detected mass spectra. The calculated ratio corresponds to the sample slope of the linear correlation of the relative m/z shift with the visible total charge $Q_v$ of the mass spectra of the sample ions detected with the ion trapping mass analyser.

In another embodiment, in step 630 the results of the two preceding steps are used to calculate for pairs of two different amounts of the sample ions injected from the ion storage unit into the ion trapping mass analyser the ratio of their observable difference of the relative m/z shift evaluated from their detected mass spectra to their difference of the visible total charge $Q_v$ of the sample ions trapped in the ion trapping mass analyser evaluated from their detected mass spectra.

Then from the calculated ratios of the pairs of different amounts of sample ions a ratio can be determined for two amounts of sample ions in general, e.g. by averaging the calculated values of the ratio. This determined ratio corresponds to the sample slope of the linear correlation of the relative m/z shift with the visible total charge $Q_v$ of mass spectra of sample ions detected with the ion trapping mass analyser.

In another preferred embodiment the sample slope of the linear correlation of the relative m/z shift with the visible total charge $Q_v$ of mass spectra of sample ions detected with the ion trapping mass analyser is determined, preferably calculated, by a linear fit, which is taking into account the observable difference of a relative m/z shift and the visible total charge $Q_v$ and/or the difference $\delta(Q_v)$ of the visible total charge $Q_v$ evaluated from pairs of two detected mass spectra of different amounts of sample ions. Based on this values and/or differences the correlation of the relative m/z shift of the mass peaks of mass spectra of ion packages of sample ions detected with the ion trapping mass analyser with the visible total charge $Q_v$ of the ion packages of sample ions derived from their detected mass spectra is provided, which can be adapted by an linear fit with a linear function. The slope of this linear function is then the sample slope of the linear correlation of the relative m/z shift with the visible total charge $Q_v$ of mass spectra of the sample ions detected with the ion trapping mass analyser.

Because the correlation of the relative m/z shift of the mass peaks of mass spectra of ion packages of investigated sample ions detected with a ion trapping mass analyser with the visible total charge $Q_v$ of the ion packages derived from their detected mass spectra is a linear function, by the determined sample slope of the function the relative m/z shift can be determined for any visible total charge $Q_v$ of an amount of investigated sample ions. This correlation can be used in the inventive method of the claim 10 to correct the m/z shift observed in a mass spectrum, when the complete total charge $Q_{real}$ of an ion package of sample ions is not visible in and/or derivable from the detected mass spectrum of the sample ions detected with an ion trapping mass analyser, however the visible total charge $Q_v$ of the ion package of the sample ions can be derived from its detected mass spectrum.

In following step 640 of the inventive method, a compensation factor c is determined. The compensation factor c is used for adjusting the ion injection time period $t_{opt,v}$ of sample ions, which is related to the optimised visible charge $Q_{ref,opt}$ of a reference sample, into the ion storage unit to perform a mass analysis of sample ions. The optimised visible charge $Q_{ref,opt}$ of the reference sample is that amount of the visible total charge $Q_v$, which is visible in a mass spectrum of the reference sample, when the real total charge $Q_{real}$ of investigated amount of reference ions has the value of the optimised total charge $Q_{opt}$. The ion injection time period $t_{opt,v}$, is defining that ion injection time period of sample ions into the ion storage unit, due to which the optimised visible charge $Q_{ref,opt}$ of a reference sample is observed as visible charge in a mass spectrum of the sample ions. The ion injection time period $t_{opt,v}$ of sample ions is determined from the visible total charge $Q_v$ evaluated from at least one mass spectrum detected with the ion trapping mass analyser of at least one amount of the sample ions and the corresponding injection time period of the sample ions. Due to the observed linear correlation of the visible total charge $Q_v$ of the at least one mass spectrum and the corresponding injection time period of sample ions the ion injection time period $t_{opt,v}$ of sample ions is determined. The compensation factor c is determined by dividing the reference slope of the linear correlation of the relative m/z shift with the visible total charge $Q_v$ of mass spectra of reference ions of the reference sample, which is preferably a clean sample, by the sample slope determined in step 630.

In a preferred embodiment the sample slope is determined in step 630 from the detected mass spectra of two different amounts of sample ions is used in step 640 to determine the compensation factor c. The sample slope of the sample is calculated by the ratio of the observable difference of the relative m/z shift evaluated from the detected mass spectra of the two different amounts of sample ions and the difference of the visible total charge $Q_v$ evaluated from the detected mass spectra of the two different amounts of sample ions trapped in the ion trapping mass analyser.

In another preferred embodiment the calculated ratio of the observable difference of the relative m/z shift to the difference of the visible total charge $Q_v$ of pairs of two different amounts of the sample ions, as described in detail in the paragraph before, can be used in step 640 as the sample slope to determine the compensation factor c for each pair of two different amounts of the sample ions. Then a general compensation factor c is determined by averaging the compensation factors c determined for each pairs of two different amounts of sample ions.

This above described approach to determine the optimised accumulation time $t_{opt,real}$ of sample ions, whose real total charge $Q_{real}$ of the ion package of sample ions a sample is only partially visible in a detected mass spectrum detected with an ion trapping mass analyser, is also used in the inventive method of claim 9 to perform a mass analysis of the sample ions in the ion trapping mass analyser.

Figure 8:
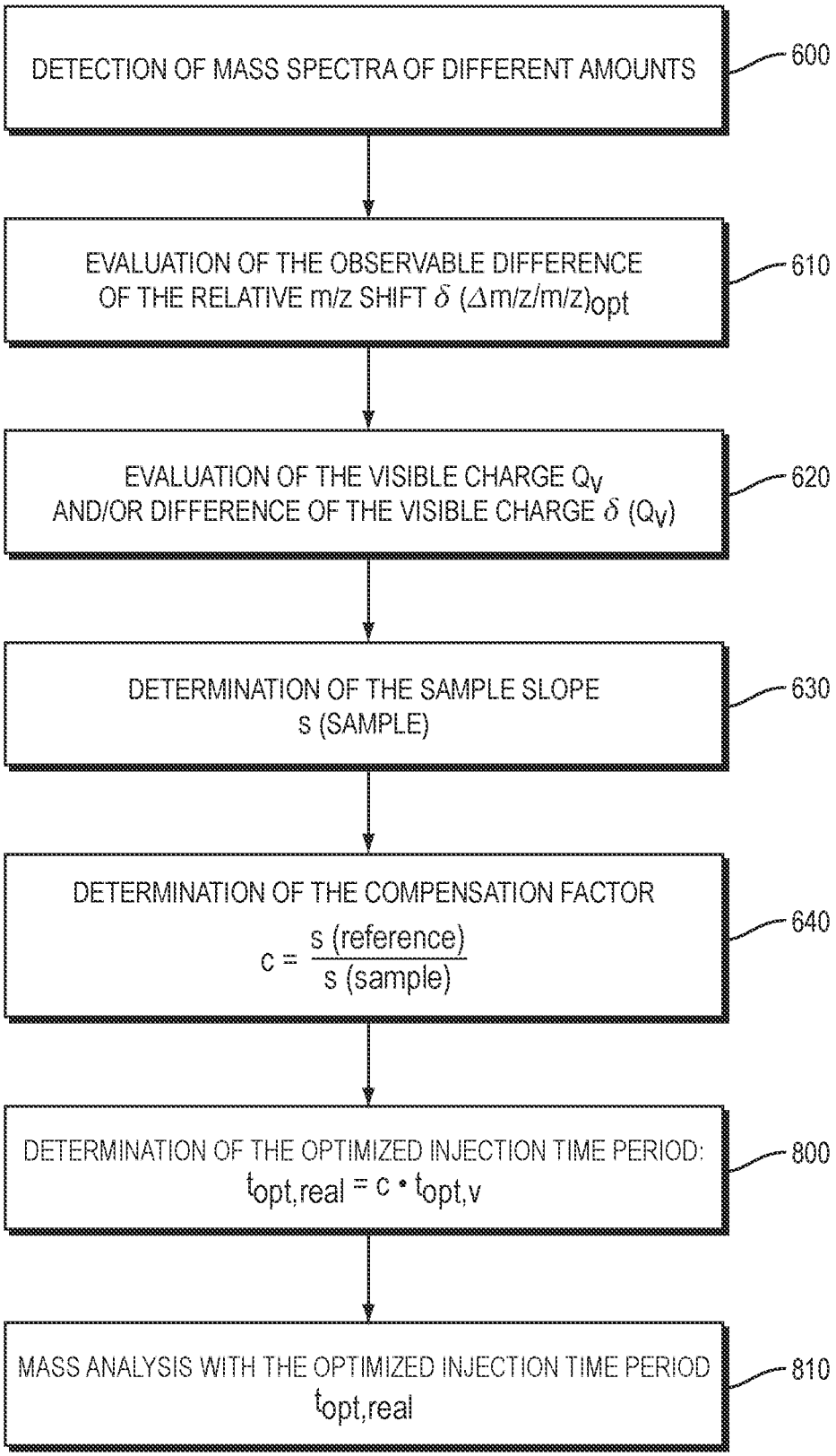
FIG. 8 shows the flow chart of an embodiment of the inventive method of claim 9 for performing a mass analysis of sample ions in an ion trapping transform mass analyser.

A flow chart of this method is shown in FIG. 8. The method is also using the steps 600, 610, 620, 630, 640 described before regarding FIG. 6. Additionally, the optimised real injection time period $t_{opt,real}$ of the sample ions in the ion storage unit to perform a mass analysis of the sample ions is determined in step 800 to perform the mass analysis with an ion package of the optimised total charge $Q_{opt}$. The determined compensation factor c is used to determine the real ion injection time period $t_{opt,real}$, which is defined by:

$$t_{opt,real}=ct_{opt,v} \tag{33}$$

Then in step 810 a mass analysis of sample ions is performed in the ion trapping mass analyser using real optimised ion injection time period $t_{opt,real}$ to inject sample ions into the ion storage unit of the ion trapping mass spectrometer. The mass analysis, in particular the detection of a mass spectrum, is thereby performed with an optimised amount of sample ions for a sample having the real total charge $Q_{opt}$, wherein this real total charge is not visible in the detected mass spectrum.

Several of the processes of the inventive methods can be supported by computers and processors, being stand alone or connected or in a cloud system and by software to execute the processes.

The inventive methods might be used for each ion trapping mass spectrometer, when the m/z shift observed in mass spectra is in at least one detectable mass range of sample ions higher than 10% of the value of the accuracy of the ion trapping mass spectrometer to determine a position of a peak of ions, which is the m/z value of the peak of the ions, typically of the centroid or maximum of the peak.

So the m/z shift due to different amounts of analysed sample ions cannot be observed due to a low accuracy of the position of a peak.

The inventive methods might be preferably used for each ion trapping mass spectrometer, when the m/z shift observed in mass spectra is in at least one detectable mass range of sample ions higher than 50% of the value of the accuracy of the ion trapping mass spectrometer to determine a position of a peak of ions.

The inventive methods might be more preferably used for each ion trapping mass spectrometer, when the m/z shift observed in mass spectra is in at least one detectable mass range of sample ions higher than 100% of the value of the accuracy of the ion trapping mass spectrometer to determine a position of a peak of ions.

The inventive methods might be in particular preferably used for each ion trapping mass spectrometer, when the m/z shift observed in mass spectra is in at least one detectable mass range of sample ions higher than 200% of the value of the accuracy of the ion trapping mass spectrometer to determine a position of a peak of ions.

Some investigated samples comprise at least one standard component. When for at least one sample ion generated by ionisation from a standard component comprised in the sample the m/z ratio is known, the inventive method of claim 5 can be used for determining a parameter for controlling the amount of sample ions injected from the ion storage unit into the ion trapping mass analyser to perform a mass analysis of the sample ions, which is the compensation factor c.

Figure 2C:
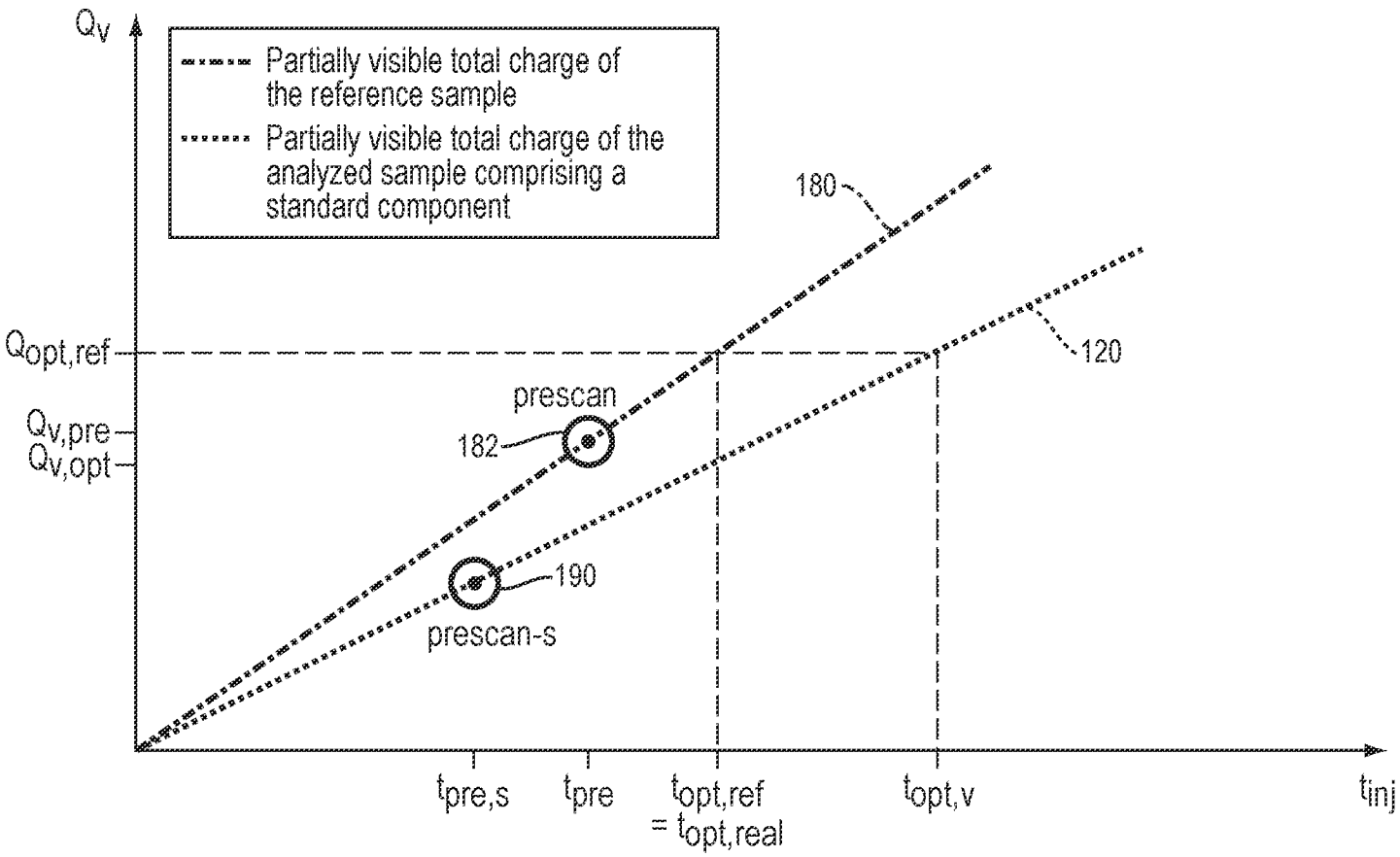
FIG. 2C shows the correlation of the visible total charge of an ion package with the injection time period of the ions into an ion storage unit for a sample comprising a standard component which shall be analysed and a reference sample.

In FIG. 2C is shown the correlation between the visible total charge $Q_v$ of the ion package stored in the ion storage unit and the injection, i.e. accumulation, time $t_{inj}$ of the ions, i.e. time taken to accumulate ions in the ion storage unit. The visible total charge $Q_v$ can be derived from a mass spectrum detected by the ion trapping mass analyser to which the ion package is injected from the ion storage unit as explained before. The correlation is shown for the ion packages of two different samples injected into the ion storage unit with the same total ion current TIC, which is taking into account the real total charge of the ions $Q_{real}$. The correlation 180 shows the correlation when the complete total charge $Q_{real}$ of the ion package of reference ions of a reference sample is only partially visible as visible total charge $Q_{v,ref}$ in a detected mass spectrum, so that $Q_{v,ref}<Q_{real}$. Due to a constant total ion current TIC of reference ions from the ion source the correlation is provided by a linear function, a straight line. When a prescan 182 is executed as explained above with the injection time period of the prescan $t_{pre}$ and the visible charge $Q_{v,pre}$ is determined from the mass spectrum of the prescan 182, the optimised accumulation time $t_{opt,ref}$ of the reference ions can be determined for an optimised total charge $Q_{ref,opt}$ of the reference ions of the ion trapping mass analyser by the formula already described before:

$$t_{opt,real} = t_{opt,ref} = \frac{Q_{ref,opt}}{Q_{v,pre}} t_{pre} \tag{34}$$

The second correlation 120 shows the correlation of the injection time period $t_{inj}$ and the visible total charge $Q_v$, when the real total charge $Q_{real}$ of the ion package of sample ions of a sample, which shall be analysed, is not completely visible in a detected mass spectrum, so that $Q_v<Q_{real}$.

The sample comprises at least one standard component. The m/z ratio of at least one sample ion generated by ionisation of the at least one standard component is known.

Further the visible total charge $Q_v$ of the sample ions, which shall be analysed, is smaller than visible total charge $Q_{v,ref}$ of the reference sample, so that $Q_v<Q_{v,ref}<Q_{real}$. If now the injection time period would be optimised according the formula mentioned before, the reduced amount of the visible total charge $Q_v$ would result in an increased injection time period $t_{opt,v}$ which is related to the optimised visible charge $Q_{opt,ref}$ of the reference sample, because it is determined from the visible total charge $Q_v$ evaluated from detected mass spectra of sample ions. Therefore another method is required to define an optimised accumulation time $t_{opt,real}$ when the visible total charge $Q_{v,ref}$ of an ion package of a reference sample is not completely visible in detected mass spectrum of the sample, which shall be investigated.

It should be noted, that it is also possible, that the visible total charge $Q_v$ of the sample ions can be larger than the visible total charge $Q_{v,ref}$ of the reference ions of a reference sample.

To solve the problem to determine the optimised injection time period $t_{opt,real}$, when not all charges are visible in a mass spectrum, the invention uses the effect that the relative m/z shift of the mass peaks in a mass spectrum induced by the space charge of the ion package is related to the real charge $Q_{real}$ of an ion package, wherein the relative m/z shift of the mass peaks is proportional to the real charge $Q_{real}$.

$$\frac{\Delta m/z}{m/z} \propto Q_{real} \tag{35}$$

Figure 5C:
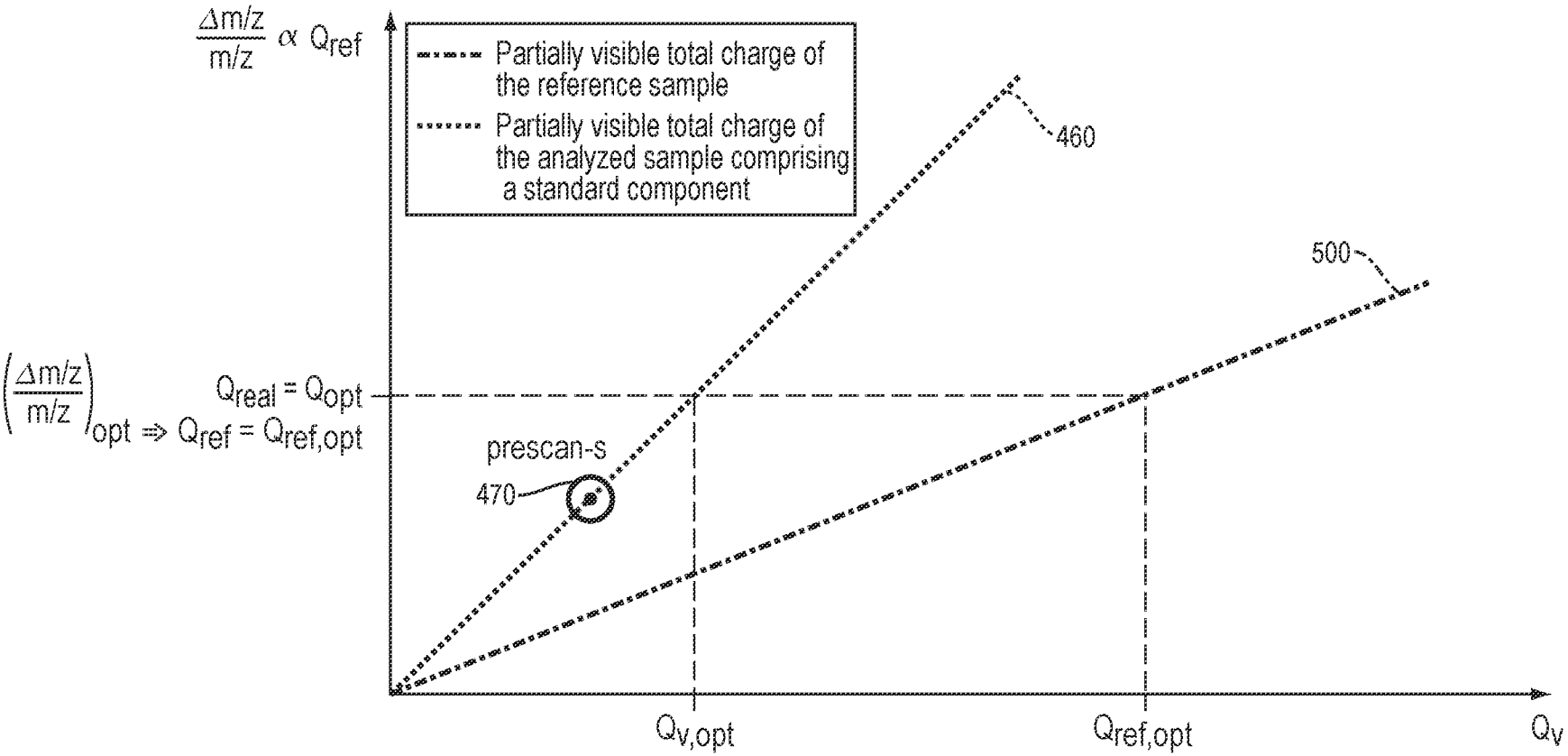
FIG. 5C shows the correlation of the relative m/z shift in a mass spectrum of an ion package with the visible total charge of an ion package for a sample comprising a standard component which shall be analysed and a reference sample.

In FIG. 5C is shown the correlation of the relative m/z shift of the mass peaks of a mass spectrum of an ion package detected with an ion trapping mass analyser with the visible total charge $Q_v$ of the ion package derived from its detected mass spectrum.

The first correlation 500 shows the correlation of the relative m/z shift of the mass peaks with the visible total charge $Q_v$ of a reference sample, when the real total charge $Q_{real}$ of the ion package is only partially visible in a detected mass spectrum as visible total charge $Q_{v,ref}$. This correlation 500 is provided by a linear function, a straight line. The slope of this function, the reference slope, is a standard value, which is only related to the reference sample and to the type of the particular ion trapping mass analyser being used and defined by the geometry and the electromagnetic fields of the specific mass analyser type. In FIG. 5C is also shown optimised visible total charge $Q_{ref,opt}$ of the reference sample of the ion trapping mass analyser on the horizontal axis showing the visible total charge $Q_v$. Therefore it can be deduced from the first correlation 500 the relative m/z shift of a mass spectrum, when an ion package of the optimised visible total charge $Q_{ref,opt}$ of the reference sample is analysed in the ion trapping mass analyser having the optimised real total charge $Q_{opt}$, which has to be also the relative m/z shift of the real optimised total charge $Q_{opt}$ of the ion package of reference ions. This relative m/z shift of the mass spectrum of the ion package of the optimised total charge $Q_{opt}$ is having the value:

$$\left(\frac{\Delta m/z}{m/z}\right)_{opt} \tag{36}$$

The second correlation 460 shows the correlation of the relative m/z shift of the mass peaks with the visible total charge $Q_v$ of sample ions of a sample, which shall be analysed, when the total charge $Q_{real}$ of the ion package is only partially visible in a detected mass spectrum and the m/z ratio of at least one of the sample ions is known. Also, this correlation 460 is provided by a linear function, a straight line. But the function has a greater slope compared to the reference sample, because the visible total charge $Q_v$ which can be derived from a mass spectrum is reduced compared to the reference sample.

It should be emphasised again that the values of the relative m/z values and visible charge observed for specific measured mass spectra may deviate from this linear correlation due to measurement errors and higher-order physical effects. This has to be taken into account when the sample slope of the linear correlation of the relative m/z shift with the visible total charge $Q_v$ of the sample is determined as explained in detail before.

For the relative m/z shift at the optimised total charge $Q_{opt}$ $$\left(\frac{\Delta m/z}{m/z}\right)_{opt} \tag{37}$$

the visible total charge $Q_{v,opt}$ can be determined. When this visible total charge $Q_{v,opt}$ is derived from a mass spectrum of the sample ions, described by the correlation 460, the investigated ion package of the sample ions is actually comprising the optimised total charge $Q_{opt}$.

Therefore, when the real total charge $Q_{real}$ of the ion package of sample ions is only partially visible in a detected mass spectrum, the optimised accumulation time $t_{opt,real}$ to detect the ion package of the optimised total charge $Q_{opt,ref}$ can be derived from the total ion current of the visible charge $TIC_v$ shown by the second correlation 120 in FIG. 2C:

$$TIC_v = \frac{Q_{ref,opt}}{t_{opt,v}} = \frac{Q_{v,opt}}{t_{opt,real}} \tag{38}$$

So the optimised accumulation time $t_{opt,real}$ of a sample ions, whose real total charge $Q_{real}$ of the ion package of sample ions is only partially visible in a detected mass spectrum and for which the m/z ratio of at least one of the sample ions is known, is correlated with the ion injection time period $t_{opt,v}$ of sample ions in the ion storage unit to perform a mass analysis of ions, which is related to the optimised visible total charge $Q_{ref,opt}$ of the reference sample, determined from the visible total charge $Q_v$ in the detected mass spectra of the sample ions:

$$t_{opt,real} = \frac{Q_{v,opt}}{Q_{ref,opt}} t_{opt,v} \tag{39}$$

The ratio $Q_{v,opt}/Q_{ref,opt}$ can be derived from the correlations in FIG. 5C taking into account the reference slope s(reference) of the correlation 500 of an reference sample and the sample slope s(sample) of the correlation 460 of the sample, for which total charge $Q_{real}$ of the ion package of ions ionised from a sample is only partially visible in a detected mass spectrum and the m/z ratio of at least one of the sample ions is known.

$$\frac{Q_{v,opt}}{Q_{ref,opt}} = \frac{s(\text{reference})}{s(\text{sample})} \tag{40}$$

The inventive method of the claims 1, 2 and 5 is now using this correlation and is determining the correlation factor c:

$$C = \frac{Q_{v,opt}}{Q_{ref,opt}} = \frac{s(\text{reference})}{s(\text{sample})} \tag{41}$$

So the correlation factor c is determined by dividing the reference slope s(reference) of the linear correlation of the relative m/z shift with the visible total charge $Q_v$ of mass spectra of the reference ions detected with the ion trapping mass analyser by the sample slope s(sample) of the linear correlation of the relative m/z shift with the visible total charge $Q_v$ of mass spectra of sample ions detected with the ion trapping mass analyser.

Then the optimised accumulation time $t_{opt,real}$ of sample ions, whose total charge $Q_{real}$ of the ion package of sample ions is only partially visible in a detected mass spectrum and for which the m/z ratio of at least one of the sample ions is known, is correlated with the ion injection time period $t_{opt,v}$ of sample ions in the ion storage unit, which is related to the optimised visible charge $Q_{ref,opt}$ of a reference sample and determined from the visible total charge $Q_v$, as described above:

$$t_{opt,real} = ct_{opt,v} \tag{42}$$

The reference slope s(reference) of the correlation 500 of the reference sample is a standard value, which is only related to the reference sample and to the type of used ion trapping mass analyser as explained before.

In FIG. 5C the sample slope s(sample) is determined by one pre-experiment named prescan-s, in which one amount of sample ions a mass spectrum is detected in the ion trapping mass analyser. The ion injection time period of the investigated sample ions in the ion storage unit of the pre-experiment prescan-s is shown in FIG. 2C. The pre-experiment prescan-s is shown by the circle 190 having an ion injection time period $t_{pre}$. The parameters of pre-experiment prescan-s are shown in FIG. 5C by the circle 470.

In this embodiment the sample slope s(sample) is evaluated by the steps:

- Evaluation of the relative m/z shift from the detected mass spectrum of the pre-experiment prescan-s by determination of the relative difference of m/z value of at least one sample ion, for which the m/z ratio is known, in the detected mass spectrum to its known m/z ratio
- Evaluation a visible total charge $Q_v$ from the detected mass spectrum of pre-experiment prescan-s of the amount of sample ions trapped in the ion trapping mass analyser
- Determination of the sample slope s(sample) by calculating the ratio of the relative m/z shift of the mass spectrum of the pre-experiment prescan-s to the evaluated visible total charge of the mass spectrum of the pre-experiment prescan-s.

This approach is used in the inventive method of claim 5 and can be used in the inventive method of claim 1 for determining a parameter for controlling the amount of sample ions injected from an ion storage unit into a ion trapping mass analyser to perform a mass analysis of sample ions, which enables a mass analysis with ion packages of sample ions of the optimised total charge $Q_{opt}$, when the real total charge $Q_{real}$ of an ion package of the sample ions is not visible in and/or derivable from a detected mass spectrum and the m/z ratio of at least one of the sample ions is known. The method relies only on the measurements of mass spectra with the ion trapping mass analyser and the AGC approach to derive the visible total charge $Q_v$ from the detected mass spectra. Other charge detection is not required in the ion trapping mass spectrometer.

Figure 9:
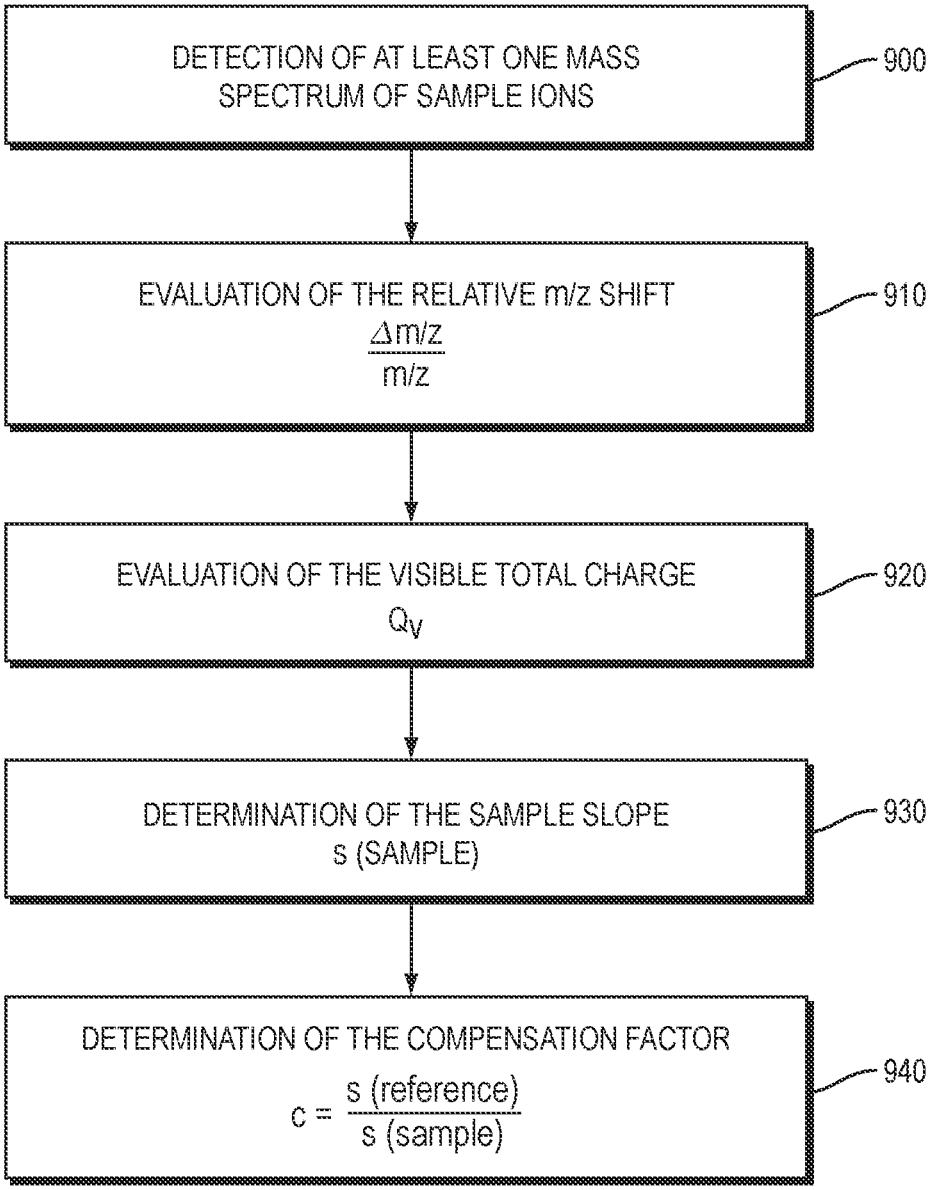
FIG. 9 shows the flow chart of the inventive method of claim 5 for determining a parameter for controlling the amount of sample ions injected from an ion storage unit into an ion trapping mass analyser, wherein the m/z ratio of at least one of the sample ions is known.

The steps of the inventive method of claim 5 determining a parameter for controlling the amount of sample ions injected from an ion storage unit into an ion trapping mass analyser to perform a mass analysis of sample ions are shown in FIG. 9. These steps can be also executed of the inventive method of claim 1.

In the first step 900 at least one mass spectrum is detected by the ion trapping mass analyser for at least one amount of the sample ions. The at least one amount of the sample ions is injected from the ion storage unit into the ion trapping mass analyser. It may be sufficient to detect the mass spectrum of one amount of sample ions. But also a larger number of mass spectra of different amounts of sample ions can be detected.

In a following step 910 the relative m/z shift is evaluated from the at least one mass spectrum of the at least one amounts of the sample ions:

$$\left(\frac{\Delta m/z}{m/z}\right) \tag{43}$$

The relative m/z shift is evaluated from the at least one mass spectrum of the at least one amounts of the sample ions by determination of a relative difference of m/z value of at least one sample ion, for which the m/z ratio is known, in the at least one detected mass spectrum to its known m/z ratio.

The relative difference of the m/z value in the at least one detected mass spectrum to the known m/z ratio can be determined for a large number of species of sample ions, for which the m/z ratio is known, Preferably then the relative m/z shift is determined for the least one mass spectrum of the at least one amounts of the sample ions as the average value of the determined relative differences of the m/z value of all investigated sample ions, for which the m/z ratio is known.

The peak of a sample ion, for which the m/z ratio is known, can be identified in the detected mass spectrum due its specific high relative abundance, the specific peak structure of the peak pattern of sample ions, which are generated by ionisation of that specific standard component, from which the sample ion is generated by the ionisation and/or the known m/z ratio of the sample ion. More details about the identification of a peak of a sample ion, for which the m/z ratio is known, are described before.

The evaluation of the relative m/z shift observed in the at least one mass spectrum of at the least one amount of the sample ions can be executed by automated processing.

In another step 920, shown in FIG. 9 as the following step, the at least one mass spectrum of at least one amount of the sample ions is evaluated to determine the visible total charge $Q_v$ of at least one amount of the sample ions.

In a preferred embodiment, the visible total charge $Q_v$ is evaluated from the detected mass spectra of two different amounts of sample ions.

In the next step 930, the results of the two preceding steps are used to determine the sample slope of the linear correlation of the relative m/z shift with the visible total charge $Q_v$ of mass spectra of sample ions detected with the ion trapping mass analyser. The sample slope provides for two amounts of the sample ions injected from the ion storage unit into the ion trapping mass analyser the ratio of the difference of their relative m/z shift and their difference of the visible total charge $Q_{v,pre}$ of their mass spectra detected with the ion trapping transform mass analyser. The sample slope describes how the change of the relative m/z shift in the mass spectra of the sample ions is correlated with the visible total charge $Q_v$ which can be determined from a detected mass spectrum of the sample ions.

In a preferred embodiment, in step 930 the results of the two preceding steps are used to calculate for one amount of the sample ions injected from the ion storage unit into the ion trapping mass analyser the ratio of the relative m/z shift evaluated from the detected mass spectrum of the one amount of the sample ions to the visible total charge $Q_v$ of the one amount of the sample ions trapped in the ion trapping mass analyser evaluated from the detected mass spectrum of the one amount of the sample ions. The calculated ratio corresponds to the sample slope of the linear correlation of the relative m/z shift with the visible total charge $Q_v$ of the mass spectra of the sample ions detected with the ion trapping mass analyser.

In another embodiment, in step 930 the results of the two preceding steps are used to calculate for two different amounts of the sample ions injected from the ion storage unit into the ion trapping mass analyser the ratio of their difference of the relative m/z shift evaluated from their detected mass spectra to their difference of the visible total charge $Q_v$ of the sample ions trapped in the ion trapping mass analyser evaluated from their detected mass spectra. The calculated ratio corresponds to the sample slope of the linear correlation of the relative m/z shift with the visible total charge $Q_v$ of the mass spectra of the sample ions detected with the ion trapping mass analyser.

In another embodiment, in step 930 the results of the two preceding steps are used to calculate for pairs of two different amounts of the sample ions injected from the ion storage unit into the ion trapping mass analyser the ratio of their difference of the relative m/z shift evaluated from their detected mass spectra and their difference of the visible total charge $Q_v$ of the sample ions trapped in the ion trapping mass analyser evaluated from their detected mass spectra.

Then from the calculated ratios of the pairs of different amounts of sample ions a ratio can be determined for two amounts of sample ions in general, e.g. by averaging the calculated values of the ratio. This determined ratio corresponds to the sample slope of the linear correlation of the relative m/z shift with the visible total charge $Q_v$ of mass spectra of sample ions detected with the ion trapping mass analyser.

In another preferred embodiment the slope of the linear correlation of the relative m/z shift with the visible total charge $Q_v$ of mass spectra of sample ions detected with the ion trapping mass analyser is determined, preferably calculated, by a linear fit, which is taking into account the a relative m/z shift and the visible total charge $Q_v$ evaluated from the detected mass spectra of different amounts of sample ions. Based on this values the correlation of the relative m/z shift of the mass peaks of a mass spectrum of an ion package of sample ions detected with the ion trapping mass analyser with the visible total charge $Q_v$ of the ion package of sample ions derived from its detected mass spectrum is provided, which can be adapted by an linear fit with a linear function. The slope of this linear function is then the the sample slope of the linear correlation of the relative m/z shift with the visible total charge $Q_v$ of mass spectra of the sample ions detected with the ion trapping mass analyser.

Because the correlation of the relative m/z shift of the mass peaks of a mass spectrum of an ion package of investigated sample ions detected with a ion trapping mass analyser with the visible total charge $Q_v$ of the ion package derived from its detected mass spectrum is a linear function, by the determined sample slope of the function the relative m/z shift can be determined for any visible total charge $Q_v$ of an amount of investigated sample ions. This correlation can be used in the inventive method of the claim 11 to correct the m/z shift observed in a mass spectrum of sample ions, when the m/z ratio of at least one of the sample ions is known and the complete total charge $Q_{real}$ of an ion package of sample ions is not visible in and/or derivable from the detected mass spectrum of the sample ions detected with an ion trapping mass analyser, however the visible total charge $Q_v$ of the ion package of the sample ions can be derived from the detected mass spectrum, in which the m/z shift is observed and which this m/z shift shall be corrected.

In following step 940 of the inventive method, a compensation factor c is determined. The compensation factor c is used for adjusting the before explained ion injection time period $t_{opt,v}$ of sample ions, which is related to the optimised visible charge $Q_{ref,opt}$ of a reference sample, into the ion storage unit to perform a mass analysis of sample ions. The ion injection time period $t_{opt,v}$ of sample ions is determined from the visible total charge $Q_v$ evaluated from at least one mass spectrum detected with the ion trapping mass analyser of at least one amount of the sample ions and the corresponding injection time period of the sample ions. Due to the observed linear correlation of the visible total charge $Q_v$ of the at least one mass spectrum and the corresponding injection time period of sample ions the ion injection time period $t_{opt,v}$ of sample ions is determined. The compensation factor c is determined by dividing the reference slope of the linear correlation of the relative m/z shift with the visible total charge $Q_v$ of mass spectra of reference ions of the reference sample, which is preferably a clean sample, by the sample slope determined in step 930.

In a preferred embodiment the sample slope is determined in step 930 from one detected mass spectrum of one amount of sample ions or detected mass spectra of two different amounts of sample ions is used in step 940 to determine the compensation factor c.

If one detected mass spectrum of one amount of sample ions is used for the determination of the sample slope, the sample slope of the sample is calculated by the ratio of the relative m/z shift evaluated from one detected mass spectrum of the one amount of sample ions to the visible total charge $Q_v$ evaluated from the one detected mass spectrum of the one amount of sample ions trapped in the ion trapping mass analyser.

If detected mass spectra of two different amounts of sample ions are is used for the determination of the sample slope, the sample slope of the sample san be calculated by the ratio of the difference of the relative m/z shift evaluated from the detected mass spectra of the two different amounts of sample ions and the difference of the visible total charge $Q_v$ evaluated from the detected mass spectra of the two different amounts of sample ions trapped in the ion trapping mass analyser.

In another embodiment the calculated ratio of the difference of the relative m/z shift and the difference of the visible total charge $Q_v$ of pairs of two different amounts of the sample ions, as described in detail in the paragraph before, can be used in step 940 as the sample slope to determine the compensation factor c for each pair of two different amounts of the sample ions. Then a general compensation factor c is determined by averaging the compensation factors c determined for each pairs of two different amounts of sample ions.

In a preferred embodiment the ratio of the relative m/z shift and the visible total charge $Q_v$ calculated for one amount of the sample ions, as described in detail before, can be used in step 940 as the sample slope to determine the compensation factor c for each of different amounts of the sample ions. Then a general compensation factor c is determined by averaging the compensation factors c determined for each of the different amounts of sample ions.

The above described approach to determine the optimised accumulation time $t_{opt,real}$ of sample ions, whose real total charge $Q_{real}$ of the ion package of sample ions a sample is only partially visible in a detected mass spectrum detected with an ion trapping mass analyser, can be also used in the inventive method of claim 9 to perform a mass analysis of the sample ions in the ion trapping mass analyser, when the m/z ratio of at least one of the sample ions is known.

Figure 10:
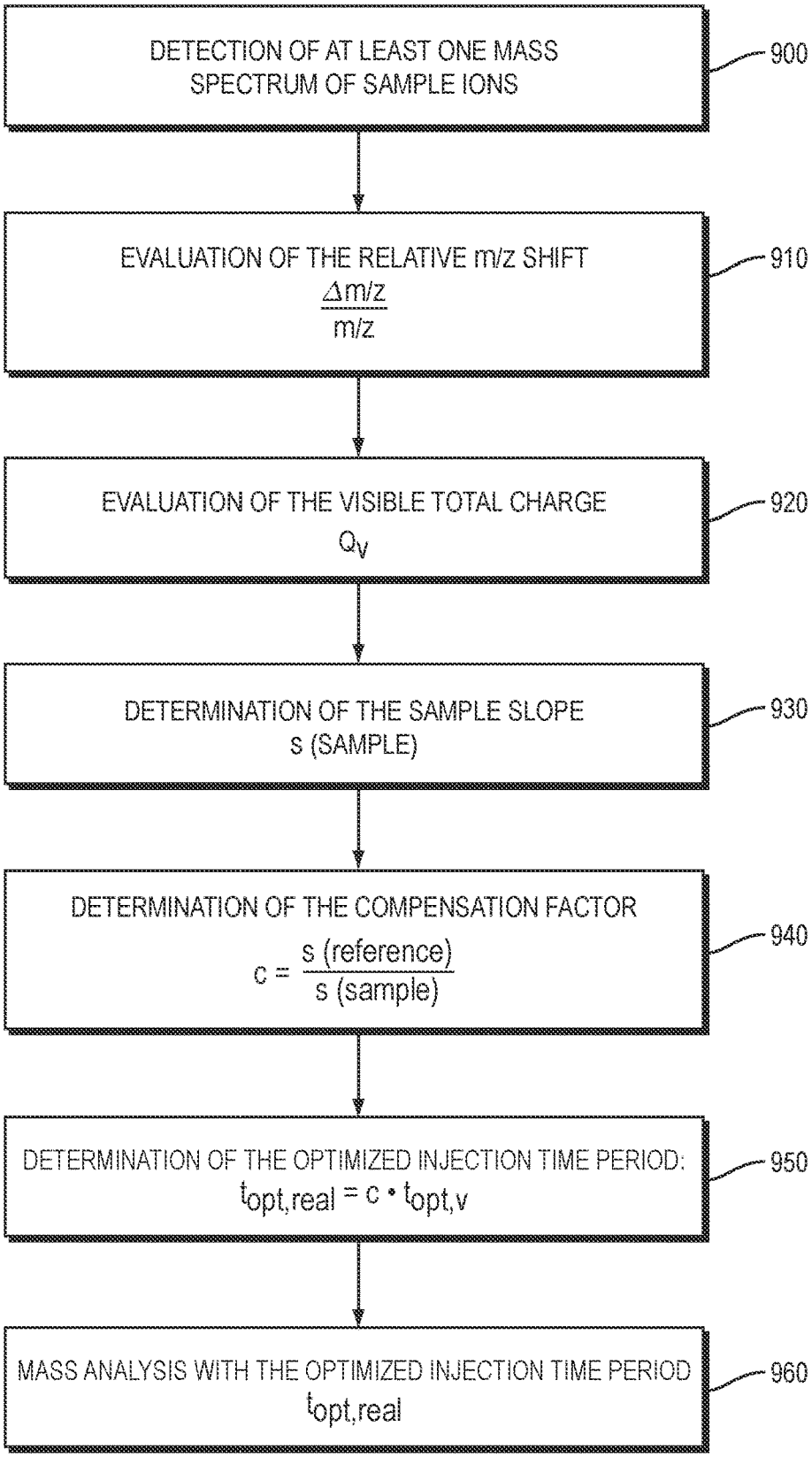
FIG. 10 shows the flow chart of another embodiment of the inventive method of claim 9 for performing a mass analysis of sample ions in an ion trapping transform mass analyser, wherein the m/z ratio of at least one of the sample ions is known.

A flow chart of this method, which is applicable when the m/z ratio of at least one of the sample ions is known, is shown in FIG. 10. The method is also using the steps 900, 910, 920, 930, 940 described before regarding FIG. 9. Additionally, the optimised real injection time period $t_{opt,real}$ of the sample ions in the ion storage unit to perform a mass analysis of the sample ions is determined in step 950 to perform the mass analysis with an ion package of sample ions of the optimised total charge $Q_{opt}$. The determined compensation factor c is used to determine the real ion injection time period $t_{opt,real}$, which is defined by:

$$t_{opt,real}=ct_{opt,v} \tag{44}$$

Then in step 960 a mass analysis of sample ions is performed in the ion trapping mass analyser using real optimised ion injection time period $t_{opt,real}$ to inject sample ions into the ion storage unit of the ion trapping mass spectrometer. The mass analysis, in particular the detection of a mass spectrum, is thereby performed with an optimised amount of sample ions of the real total charge $Q_{opt}$, wherein this real total charge of the sample ions is not visible in the detected mass spectrum and the m/z ratio of at least one of the sample ions is known.

The embodiments described in this application give examples of the inventive methods, control units of an ion trapping mass spectrometer and mass spectrometers. The invention can be realised by each embodiment alone or by a combination of several or all features of the described embodiments without any limitations.

What is claimed is:

1. A method for determining a parameter for controlling an amount of sample ions ionised from a sample, which is injected from an ion storage unit into an ion trapping mass analyser to perform a mass analysis of the sample ions comprising the steps:

detecting mass spectra for different amounts of the sample ions injected from the ion storage unit with the ion trapping mass analyser;

evaluating the observable difference of a relative m/z shift from the detected mass spectra of at least two of the different amounts of the sample ions induced by a space charge of the sample ions by determination of the relative difference of m/z values of at least one species of sample ions from these detected mass spectra;

evaluating a visible total charge $Q_v$ and/or the difference of a visible total charge $Q_v$ from the detected mass spectra of the at least two of the different amounts of the sample ions;

determining from the evaluated observable differences of the relative m/z shift and the evaluated visible total charges $Q_v$ and/or the differences of the visible total charge $Q_v$ the sample slope of a linear correlation of the relative m/z shift with the visible total charge $Q_v$ of mass spectra of sample ions detected with the ion trapping mass analyser; and determining a compensation factor c to adjust an ion injection time period $t_{opt,v}$ of sample ions into the ion storage unit, which is related to the optimised visible charge $Q_{ref,opt}$ of a reference sample, to perform a mass analysis of sample ions, wherein the ion injection time period $t_{opt,v}$ is determined from the visible total charge $Q_v$ evaluated from at least one mass spectrum of at least one amount of the sample ions detected with the ion trapping mass analyser and the corresponding injection time period of the sample ions, by dividing the reference slope of a linear correlation of the relative m/z shift with the visible total charge $Q_v$ of mass spectra of reference ions ionised from the reference sample detected with the ion trapping mass analyser by the determined sample slope.

2. The method of claim 1, wherein the observable difference of the relative m/z shift is evaluated from the detected mass spectra by determination of the relative difference of m/z values of at least 3 species of sample ions from these detected mass spectra.

3. The method of claim 2, wherein the observable difference of the relative m/z shift is evaluated from the detected mass spectra by determination of the relative difference of m/z values of at least 3 species of sample ions from these detected mass spectra.

4. The method of claim 1, wherein the observable difference of a relative m/z shift is evaluated from the detected mass spectra by determination of the relative difference of m/z values of species of sample ions from these detected mass spectra, wherein these species of sample ions have a signal-to-noise ratio in the detected mass spectra greater than 5.

5. The method of claim 2, wherein the observable difference of a relative m/z shift is evaluated from the detected mass spectra by determination of the relative difference of m/z values of species of sample ions from these detected mass spectra, wherein these species of sample ions have a signal-to-noise ratio in the detected mass spectra greater than 5.

6. The method of claim 1, wherein the reference sample is a clean sample.

7. The method of claim 1, wherein the ion trapping mass analyser is a Fourier transform mass analyser.

8. The method of claim 1, wherein the compensation factor c is determined by repeated determination of compensation factor values and averaging over the time.

9. The method of claim 1, wherein the sample slope is determined from the mass spectra detected for two preselected amounts of the sample ions.

10. The method of claim 1, wherein the sample slope is determined from the mass spectra detected for the different amounts of the sample ions by using a linear fit.

11. A method for determining a parameter for controlling an amount of sample ions ionised from a sample, which is injected from an ion storage unit into an ion trapping mass analyser to perform a mass analysis of the sample ions, wherein the m/z ratio of at least one of the sample ions is known, comprising the steps:

detecting at least one mass spectrum for at least one amount of the sample ions injected from the ion storage unit with the ion trapping mass analyser;

evaluating the relative m/z shift from the at least one detected mass spectrum of the at least one amount of the sample ions induced by a space charge of the sample ions by determination of a relative difference of m/z values of at least one sample ion, for which the m/z ratio is known, in the at least one detected mass spectrum to its known m/z ratio;

evaluating a visible total charge $Q_v$ from the at least one detected mass spectrum of the at least one amount of the sample ions;

determining, from the evaluated relative m/z shift value or values and the evaluated visible total charge or charges $Q_v$ the sample slope of a linear correlation of the relative m/z shift with the visible total charge $Q_v$ of mass spectra of sample ions detected with the ion trapping mass analyser; and determining a compensation factor c to adjust the ion injection time period $t_{optv}$ of sample ions into the ion storage unit, which is related to the optimised visible charge $Q_{ref,opt}$ of a reference sample, to perform a mass analysis of sample ions, wherein the ion injection time period $t_{optv}$ is determined from the visible total charge $Q_v$ evaluated from at least one mass spectrum of at least one amount of the sample ions detected with the ion trapping mass analyser and the corresponding injection time period of the sample ions, by dividing the reference slope of a linear correlation of the relative m/z shift with the visible total charge $Q_v$ of mass spectra of reference ions ionised from the reference sample detected with the ion trapping mass analyser by the determined sample slope.

12. The method of claim 11, wherein the reference sample is a clean sample.

13. The method of claim 11, wherein the ion trapping mass analyser is a Fourier transform mass analyser.

14. The method of claim 11, wherein the compensation factor c is determined by repeated determination of compensation factor values and averaging over the time.

* * * * *